US010896684B2

(12) United States Patent
Suzuki et al.

(10) Patent No.: US 10,896,684 B2
(45) Date of Patent: Jan. 19, 2021

(54) AUDIO ENCODING APPARATUS AND AUDIO ENCODING METHOD

(71) Applicant: FUJITSU LIMITED, Kawasaki (JP)

(72) Inventors: Masanao Suzuki, Yokohama (JP); Akira Kamano, Kawasaki (JP); Yohei Kishi, Kawasaki (JP); Miyuki Shirakawa, Fukuoka (JP)

(73) Assignee: FUJITSU LIMITED, Kawasaki (JP)

( * ) Notice: Subject to any disclaimer, the term of this patent is extended or adjusted under 35 U.S.C. 154(b) by 38 days.

(21) Appl. No.: 16/031,466

(22) Filed: Jul. 10, 2018

(65) Prior Publication Data

US 2019/0035413 A1 Jan. 31, 2019

(30) Foreign Application Priority Data

Jul. 28, 2017 (JP) ..... 2017-147119
Oct. 13, 2017 (JP) ..... 2017-199673

(51) Int. Cl.

*G10L 19/028* (2013.01)
*G10L 19/032* (2013.01)
*G10L 19/16* (2013.01)
*G10L 21/038* (2013.01)

(52) U.S. Cl.

CPC ..... *G10L 19/028* (2013.01); *G10L 19/032* (2013.01); *G10L 19/167* (2013.01); *G10L 21/038* (2013.01)

(58) Field of Classification Search

CPC .. G10L 21/038; G10L 19/0204; G10L 19/032
See application file for complete search history.

(56) References Cited

U.S. PATENT DOCUMENTS

2003/0142746 A1* 7/2003 Tanaka ..... H04N 19/63 375/240.11
2007/0156397 A1 7/2007 Chong et al.
(Continued)

FOREIGN PATENT DOCUMENTS

EP 2728577 A2 5/2014
EP 3343560 A1 7/2018
(Continued)

OTHER PUBLICATIONS

Extended European Search Report dated Nov. 20, 2018 for corresponding European Patent Application No. 18182629.8, 9 pages.

*Primary Examiner* — Thomas H Maung
(74) *Attorney, Agent, or Firm* — Fujitsu Patent Center

(57) ABSTRACT

There is provided an audio encoding apparatus including a memory, and a processor coupled to the memory and the processor configured to determine whether a tone is included in a boundary between a low-frequency that is a frequency bandwidth below a predetermined frequency of an input signal and a high-frequency that is a frequency bandwidth above the predetermined frequency of the input signal, suppress a tone in one of the low-frequency and the high-frequency, encode the input signal having the low-frequency to generate a low-frequency code, encode the input signal having the high-frequency to generate a high-frequency code, and generate an encoded stream by multiplexing the low-frequency code and the high-frequency code.

15 Claims, 42 Drawing Sheets

(56) References Cited

U.S. PATENT DOCUMENTS

| | | | | |
|---|---|---|---|---|
| 2010/0106511 | A1* | 4/2010 | Shirakawa | G10L 19/02 704/500 |
| 2011/0054885 | A1* | 3/2011 | Nagel | G10L 21/038 704/203 |
| 2011/0288873 | A1* | 11/2011 | Nagel | G10L 19/265 704/500 |
| 2012/0243526 | A1* | 9/2012 | Yamamoto | G10L 21/038 370/343 |
| 2013/0275142 | A1* | 10/2013 | Hatanaka | G10L 19/0204 704/500 |
| 2015/0162010 | A1* | 6/2015 | Ishikawa | G10L 19/00 704/500 |
| 2015/0170663 | A1* | 6/2015 | Disch | G10L 19/0017 704/500 |
| 2016/0111103 | A1 | 4/2016 | Nagisetty et al. | |

FOREIGN PATENT DOCUMENTS

| | | |
|---|---|---|
| JP | 2016-173597 | 9/2016 |
| WO | 2005/104094 | 11/2005 |
| WO | 2013/124445 | 8/2013 |
| WO | 2014/199632 | 12/2014 |

* cited by examiner

AUDIO ENCODING APPARATUS AND AUDIO ENCODING METHOD

CROSS-REFERENCE TO RELATED APPLICATIONS

This application is based upon and claims the benefit of priority of the prior Japanese Patent Application Nos. 2017-199673, filed on Oct. 13, 2017, and 2017-147119, filed on Jul. 28, 2017, the entire contents of which are incorporated herein by reference.

FIELD

The embodiments discussed herein are related to an audio encoding apparatus and the like.

BACKGROUND

In recent years, a technology called a spectral band replication (SBR) has been used for, for example, television broadcasting, radio broadcasting, Internet radio, or music distribution. The SBR is an encoding technology that compresses and expands sound signals such as the sound and music.

An encoding apparatus that performs a coding based on the SBR and a decoding apparatus in the related art will be described.

FIG. 35 is a diagram illustrating an example of an encoding apparatus in the related art. As illustrated in FIG. 35, the encoding apparatus 10 in the related art includes a low-frequency signal extraction unit 11, a low-frequency encoding unit 12, a high-frequency information extraction unit 13, a high-frequency encoding unit 14, and a multiplexing unit 15.

The low-frequency signal extraction unit 11 is a processing unit that acquires a sound signal from an external device and extracts a low-frequency signal of the sound signal. The low-frequency signal extraction unit 11 outputs the low-frequency signal to the low-frequency encoding unit 12.

FIG. 36 is a diagram illustrating a frequency spectrum of the sound signal. The horizontal axis in FIG. 36 is an axis corresponding to the frequency, and the vertical axis therein is an axis corresponding to the power (value) of the sound signal. For example, a frequency bandwidth below a predetermined frequency is referred to as a "low-frequency," and a frequency bandwidth above the predetermined frequency is referred to as a "high-frequency." The sound signal of the low-frequency is referred to as a "low-frequency signal," and the sound signal of the high-frequency is referred to as a "high-frequency signal." In the example illustrated in FIG. 36, a bandwidth 5*a* becomes a low-frequency and a bandwidth 5*b* becomes a high-frequency.

The low-frequency encoding unit 12 is a processing unit that generates a "low-frequency code" by encoding the low-frequency signal. For example, the low-frequency encoding unit 12 performs an encoding based on an advanced audio coding (AAC). The low-frequency encoding unit 12 outputs a low-frequency code to the multiplexing unit 15.

The high-frequency information extraction unit 13 is a processing unit that acquires a sound signal from an external device and extracts high-frequency information based on the sound signal. The high-frequency information extraction unit 13 outputs the high-frequency information to the high-frequency encoding unit 14.

The high-frequency information includes an envelope power, a tone frequency, and a frequency resolution. The envelope power represents an envelope in the high-frequency of the frequency spectrum of the sound signal and corresponds to, for example, an envelope power 6*a* in FIG. 36.

The tone frequency indicates the frequency at which a tone is present. For example, the tone is a large power with a protruding power value. In the example illustrated in FIG. 36, it is illustrated on a tone 6*b*, and the tone frequency is a frequency corresponding to a line 7. The frequency resolution illustrates the resolution of the frequency (minimum unit).

The high-frequency encoding unit 14 is a processing unit that generates a "high-frequency code" by encoding high-frequency information. The high-frequency encoding unit 14 outputs the high-frequency code to the multiplexing unit 15.

The multiplexing unit 15 is a processing unit that generates a stream by multiplexing the low-frequency code and the high-frequency code. The multiplexing unit 15 transmits the stream to the decoding apparatus via a network.

FIG. 37 is a diagram illustrating an example of a decoding apparatus in the related art. As illustrated in FIG. 37, the decoding apparatus 20 in the related art includes a separation unit 21, a low-frequency decoding unit 22, a high-frequency generation unit 23, a high-frequency decoding unit 24, and a high-frequency shaping unit 25.

The demultiplexing unit 31 is a processing unit that acquires a stream from the encoding apparatus 10 and separates the acquired stream into a low-frequency code and a high-frequency code. The demultiplexing unit 21 outputs the low-frequency code to the low-frequency decoding unit 22. The demultiplexing unit 21 outputs the high-frequency code to the high-frequency decoding unit 24.

The low-frequency decoding unit 22 is a processing unit that extracts a low-frequency signal by decoding the low-frequency code. The low-frequency decoding unit 22 outputs the low-frequency signal to the high-frequency generation unit 23.

The high-frequency generation unit 23 is a processing unit that generates a high-frequency signal by replicating the waveform of the low-frequency signal to a high-frequency side. The high-frequency generation unit 23 outputs the signal information including the low-frequency signal and the high-frequency signal to the high-frequency shaping unit 25.

The high-frequency decoding unit 24 is a processing unit that extracts high-frequency information by decoding the high-frequency code. The high-frequency decoding unit 24 outputs the high-frequency information to the high-frequency shaping unit 25. As described above, the high-frequency information includes an envelope power, a tone frequency, and a frequency resolution.

The high-frequency shaping unit 25 is a processing unit that shapes the high-frequency signal of the signal information based on the high-frequency information. The high-frequency shaping unit 25 outputs the shaped signal information to an external device.

FIG. 38 is a diagram for explaining the processing of the decoding apparatus in the related art. The horizontal axis of the frequency spectrum illustrated in steps S10 and S11 of FIG. 38 is an axis corresponding to the frequency, and the vertical axis thereof is an axis corresponding to the power (value). Step S10 of FIG. 38 will be described. The high-frequency generation unit 23 of the decoding apparatus 20 generates a high-frequency signal 8*b* by replicating the waveform of a low-frequency signal 8*a* to the high-frequency side.

Step S11 of FIG. 38 will be described. The high-frequency shaping unit 25 of the decoding apparatus 20 generates a signal 8*c* by shaping the high-frequency signal 8*b* in accordance with the envelope power at a rough resolution.

Step S12 of FIG. 38 will be described. The high-frequency shaping unit 25 of the decoding apparatus 20 generates signal information 8*e* by adding a tone 8*d* to the signal 8*c* at a frequency position corresponding to the tone frequency. This signal information 8*e* becomes the decoded sound signal.

Related technologies are disclosed in, for example, International Publication Pamphlet No. WO 2014/199632 and Japanese Laid-Open Patent Publication No. 2016-173597.

SUMMARY

According to an aspect of the invention, an audio encoding apparatus includes a memory, and a processor coupled to the memory and the processor configured to determine whether a tone is included in a boundary between a low-frequency that is a frequency bandwidth below a predetermined frequency of an input signal and a high-frequency that is a frequency bandwidth above the predetermined frequency of the input signal, suppress a tone in one of the low-frequency and the high-frequency, encode the input signal having the low-frequency to generate a low-frequency code, encode the input signal having the high-frequency to generate a high-frequency code, and generate an encoded stream by multiplexing the low-frequency code and the high-frequency code.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

In the above-described technology in the related art, there is a problem that the sound quality of a sound signal deteriorates.

For example, there may be a case where, when a tone is at a boundary between the low-frequency and the high-frequency, the resolution on the high-frequency side is coarse, and tones are generated at a frequency shifted from the low-frequency at the time of decoding. When the tones are generated at a frequency shifted from the low-frequency, two adjacent tones are generated, and a vibration is generated to deteriorate sound quality.

Figure 39:
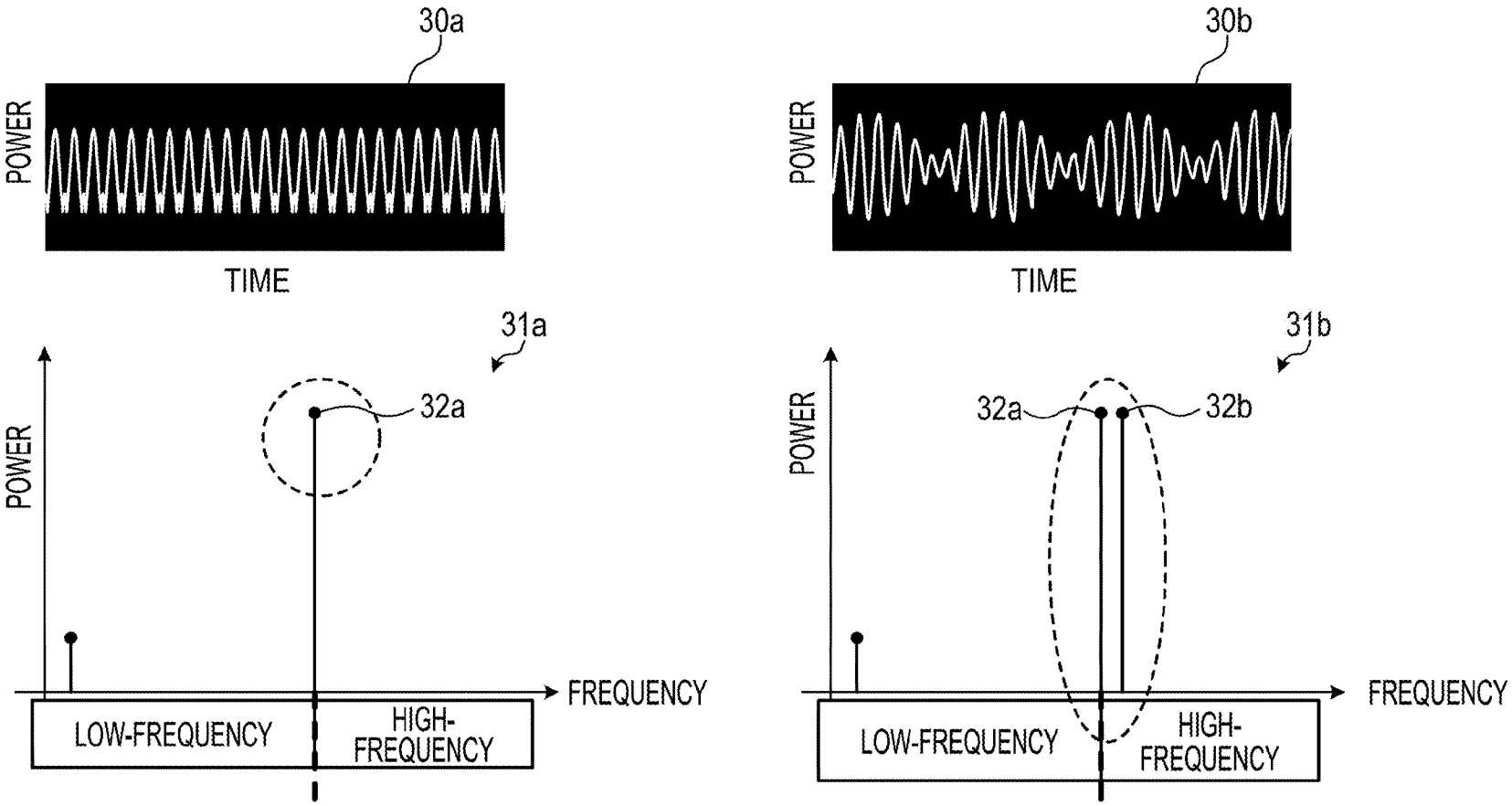
FIG. 39 RELATED ART
FIG. 39 is a diagram for explaining the problem of the technology in the related art.

FIG. 39 is a diagram for explaining the problem of the technology in the related art. For example, the time waveform and the frequency spectrum of an input sound are referred to as a time waveform 30*a* and a frequency spectrum 31*a*, respectively. The time waveform and the frequency spectrum of a decoded sound are referred to as a time waveform 30*b* and a frequency spectrum 31*b*, respectively. The horizontal axis of the time waveforms 30*a* and 30*b* is an axis corresponding to time, and the vertical axis thereof is an axis corresponding to power (value). The horizontal axis of the frequency spectra 31*a* and 31*b* is an axis corresponding to the frequency, and the vertical axis thereof is an axis corresponding to the power (value).

Figure 38:
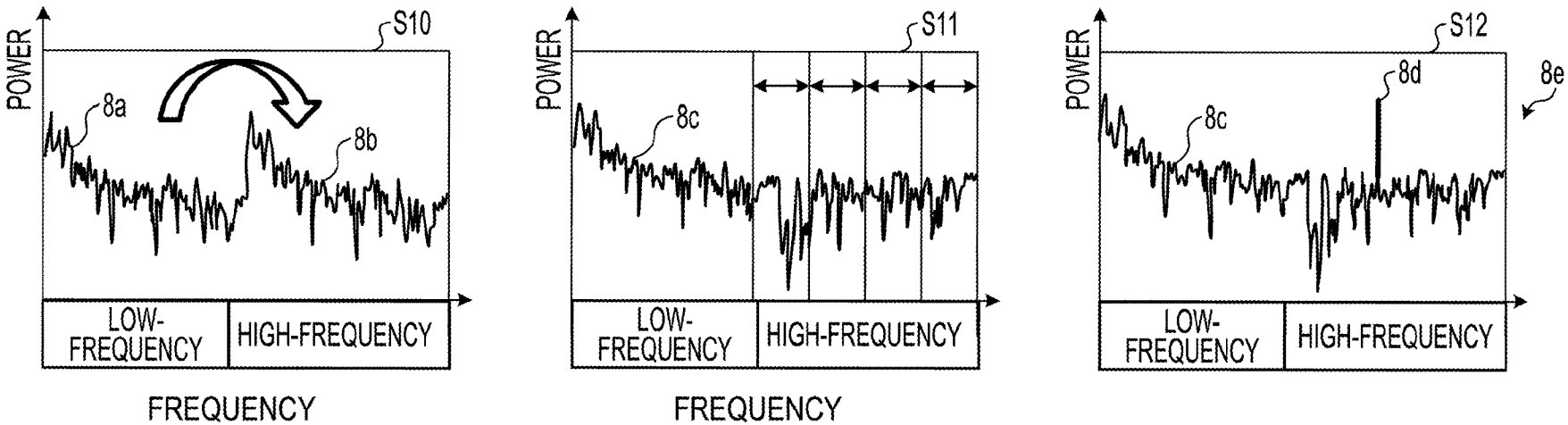
FIG. 38 RELATED ART
FIG. 38 is a diagram for explaining the processing of the decoding apparatus in the related art.

For example, no vibration is generated in the input sound itself, but there is one tone at the boundary between the low-frequency and the high-frequency. Here, as described in FIG. 38, when the decoding apparatus 20 generates signal information, the signal information includes two tones 32*a* and 32*b*, which cause the vibration.

Figure 40:
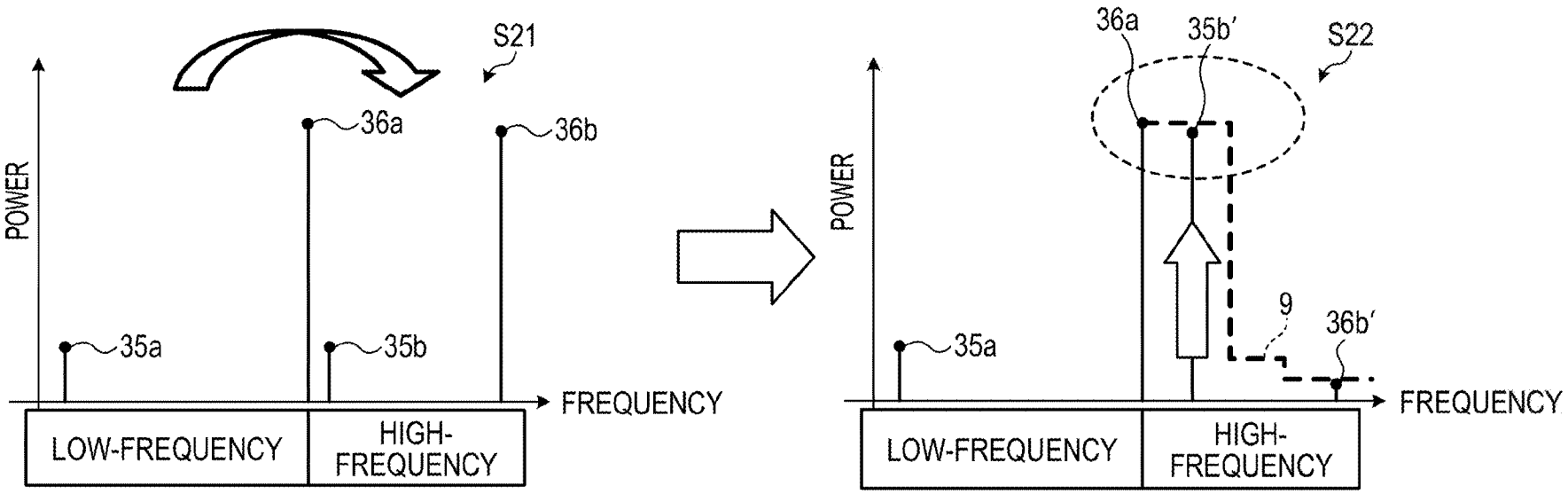
FIG. 40 RELATED ART
FIG. 40 is a diagram for explaining the reason why a high-frequency tone is shifted.

FIG. 40 is a diagram for explaining the reason why a high-frequency tone is shifted. Step S21 will be described. For example, the low-frequency signal has a power value 35*a* and a tone 36*a*, and the frequency at which the tone 36*a* is present is bounded. The high-frequency generation unit 23 of the decoding apparatus 20 generates a high-frequency signal by replicating the low-frequency signal to the high-frequency side. For example, the high-frequency signal includes a power value 35*b* replicated based on the power value 35*a* and a power value (tone) 36*b* replicated based on the tone 36*a*.

Step S22 will be described. The high-frequency shaping unit 25 of the decoding apparatus 20 shapes the high-frequency signal based on envelope information 9. For example, when the resolution is rough, the envelope information 9 is adjusted so that the value of the boundary becomes larger due to the influence of the tone 36*a* and the value of the right end side becomes smaller. Thus, the power value 35*b* is shaped to a power value 35*b*', which is the same size as the tone 36*a*, and the tone 36*b* is shaped to the power value 36*b*'. Of these tones 35*b*' and 36*b*', the tone 36*a* and the power value 35*b*' become vibration components, and the sound quality is deteriorated.

Hereinafter, an embodiment of a technology capable of suppressing the deterioration of the sound quality of a sound signal will be described in detail with reference to the accompanying drawings. However, the present disclosure is not limited to this embodiment.

First Embodiment

Figure 1:
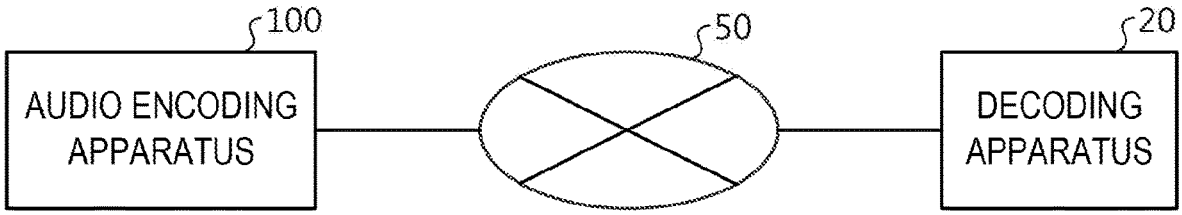
FIG. 1 is a diagram illustrating the configuration of a system according to a first embodiment.

FIG. 1 is a diagram illustrating the configuration of a system according to a first embodiment. As illustrated in FIG. 1, this system includes an audio encoding apparatus 100 and a decoding apparatus 20. The audio encoding apparatus 100 is connected to the decoding apparatus 20 via a network 50.

The audio encoding apparatus 100 is a device that acquires a sound signal from an external device and encodes the sound signal. For example, when the audio encoding apparatus 100 detects that the tone is at the boundary between the low-frequency and the high-frequency, the audio encoding apparatus 100 suppresses one of the tones on a low-frequency side and a high-frequency side, and multiplexes the low-frequency code and the high-frequency code to generate a stream. The audio encoding apparatus 100 transmits the stream to the decoding apparatus 20. The stream corresponds to an encoded stream.

Figure 37:
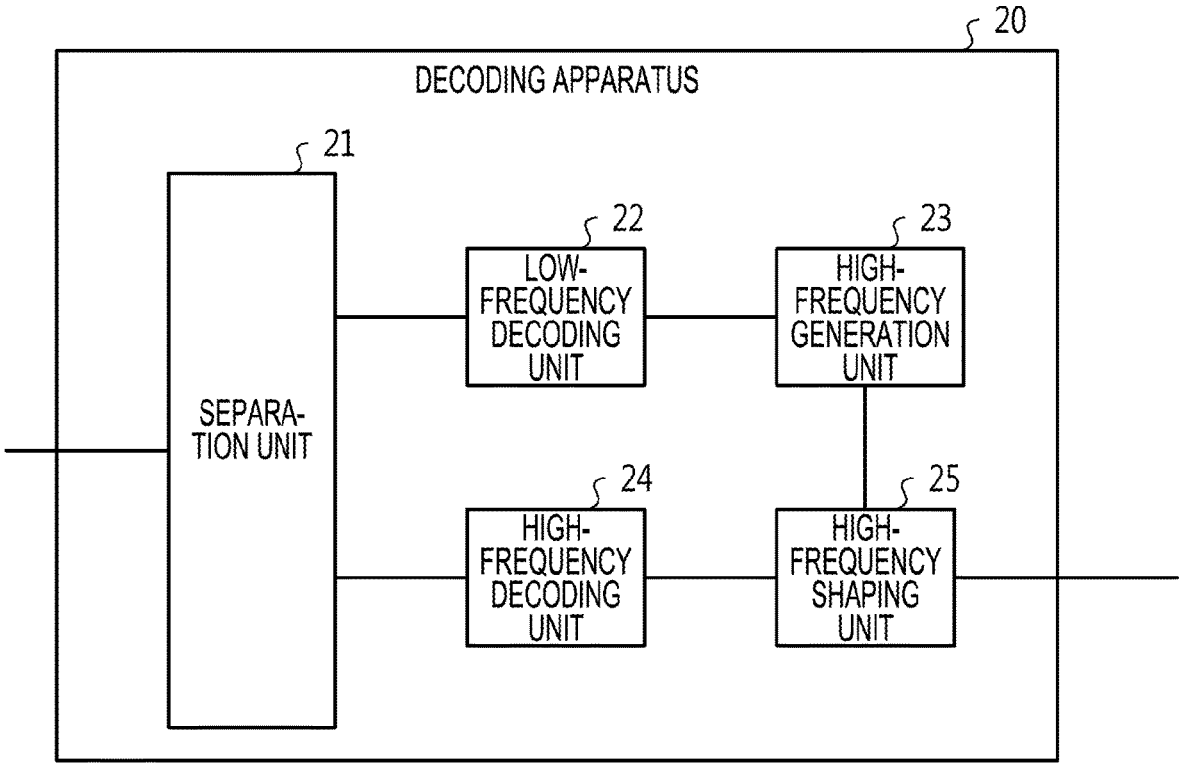
FIG. 37 RELATED ART
FIG. 37 is a diagram illustrating an example of a decoding apparatus in the related art.

The decoding apparatus 20 is a device that receives a stream from the audio encoding apparatus 100 and decodes the stream. The description of the decoding apparatus 20 is the same as that of the decoding apparatus 20 described with reference to FIG. 37.

Figure 2:
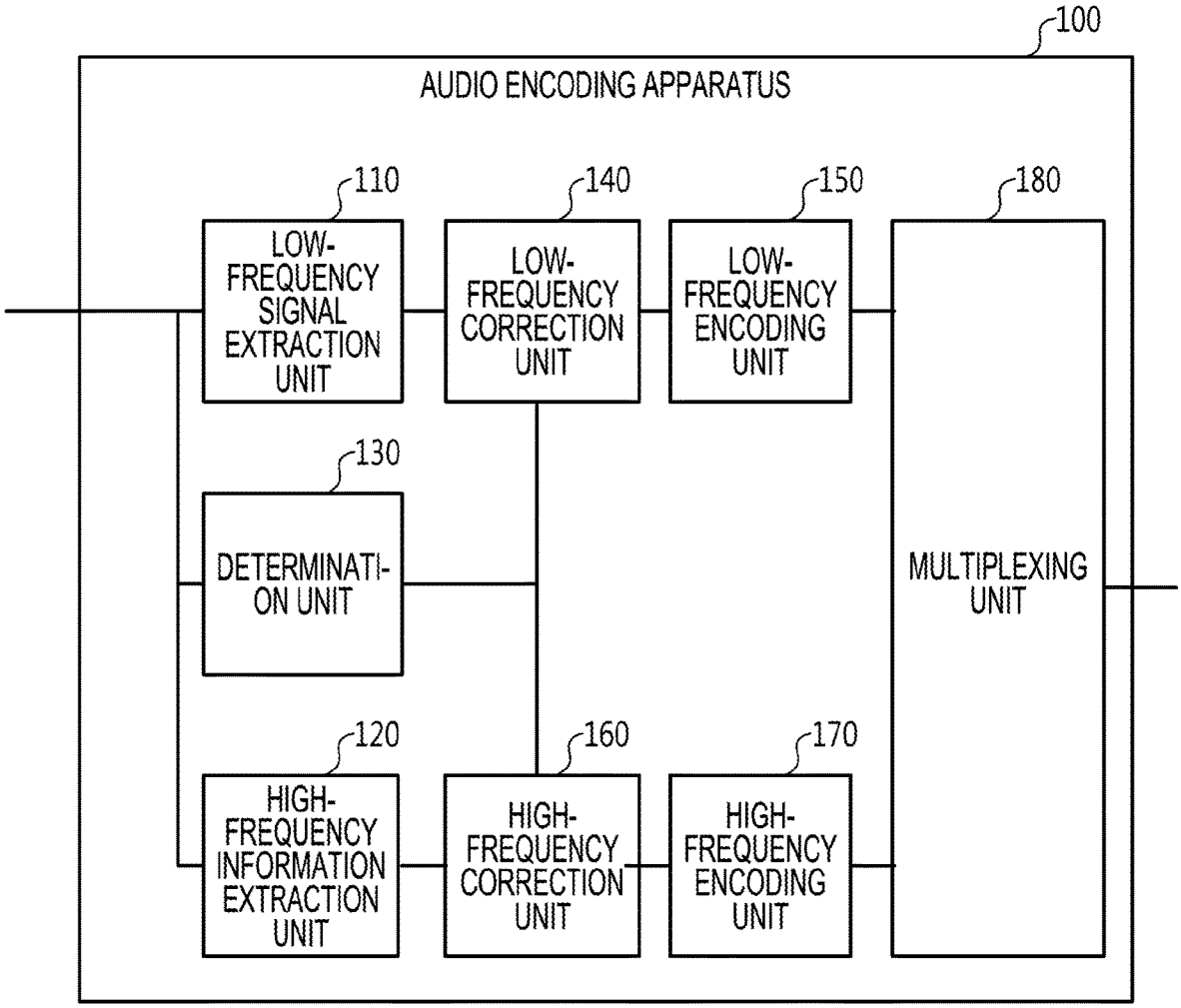
FIG. 2 is a functional block diagram illustrating the configuration of an audio encoding apparatus according to the first embodiment.

FIG. 2 is a functional block diagram illustrating the configuration of an audio encoding apparatus according to the first embodiment. As illustrated in FIG. 2, the audio encoding apparatus 100 includes a low-frequency signal extraction unit 110, a high-frequency information extraction unit 120, a determination unit 130, a low-frequency correction unit 140, a low-frequency encoding unit 150, a high-frequency correction unit 160, a high-frequency encoding unit 170, and a multiplexing unit 180. For example, the low-frequency signal extraction unit 110, the high-frequency information extraction unit 120, the low-frequency correction unit 140, the low-frequency encoding unit 150, the high-frequency correction unit 160, and the high-frequency encoding unit 170 correspond to an encoding unit.

The low-frequency signal extraction unit 110 is a processing unit that acquires a sound signal from an external device and extracts a low-frequency signal included in the low-frequency of the sound signal. The low-frequency signal extraction unit 110 outputs the low-frequency signal to the low-frequency correction unit 140. An administrator is configured to set the upper limit frequency of the low-frequency in advance.

The high-frequency information extraction unit 120 is a processing unit that acquires a sound signal from an external device and extracts high-frequency information from the high-frequency of the sound signal. The high-frequency information extraction unit 120 outputs the high-frequency information to the high-frequency correction unit 160. The high-frequency information includes an envelope power, a tone frequency, and a frequency resolution. The administrator is configured to set the lower limit frequency of the high-frequency in advance. Further, the lower limit frequency of the high-frequency may be lower than the upper limit frequency of the low-frequency.

For example, the high-frequency information extraction unit 120 converts the sound signal into a frequency spectrum, and extracts the shape of the envelope on the high-frequency side of the frequency spectrum as an envelope power. The high-frequency information extraction unit 120 extracts, as a tone frequency, a frequency at which the power is equal to or greater than a threshold value in the high-frequency of the frequency spectrum. The frequency resolution is configured to be set in advance.

The determination unit 130 is a processing unit that acquires a sound signal from an external device and determines whether the tone is included in the boundary between the low-frequency and the high-frequency of the sound signal. In addition, when it is determined that the tone is included in the boundary, the determination unit 130 determines whether the low-frequency tone or the high-frequency tone is suppressed. The boundary between the low-frequency and the high-frequency is a bandwidth between the upper limit of the low-frequency and the lower limit of the high-frequency. Further, a vertical width of the bandwidth between the upper limit of the low-frequency and the lower limit of the high-frequency may be provided. For example, the "width between the lower limit of the boundary bandwidth $-\varepsilon$ and the upper limit of the boundary bandwidth $+\varepsilon$" may be used.

Figure 3:
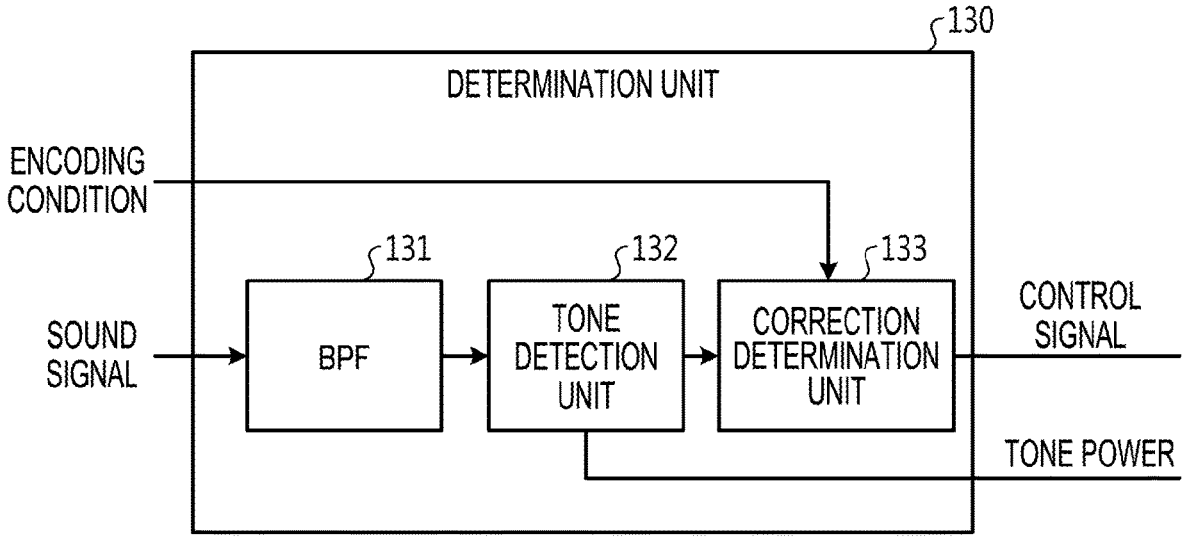
FIG. 3 is a functional block diagram illustrating the configuration of a determination unit according to the first embodiment.

FIG. 3 is a functional block diagram illustrating the configuration of a determination unit according to the first embodiment. As illustrated in FIG. 3, this determination unit 130 includes a band pass filter (BPF) 131, a tone detection unit 132, and a correction determination unit 133.

The BPF 131 is a filter that passes a sound signal near a boundary between a low-frequency and a high-frequency band of the sound signal. The sound signal that passes through the BPF 131 is output to the tone detection unit 132.

Figure 4:
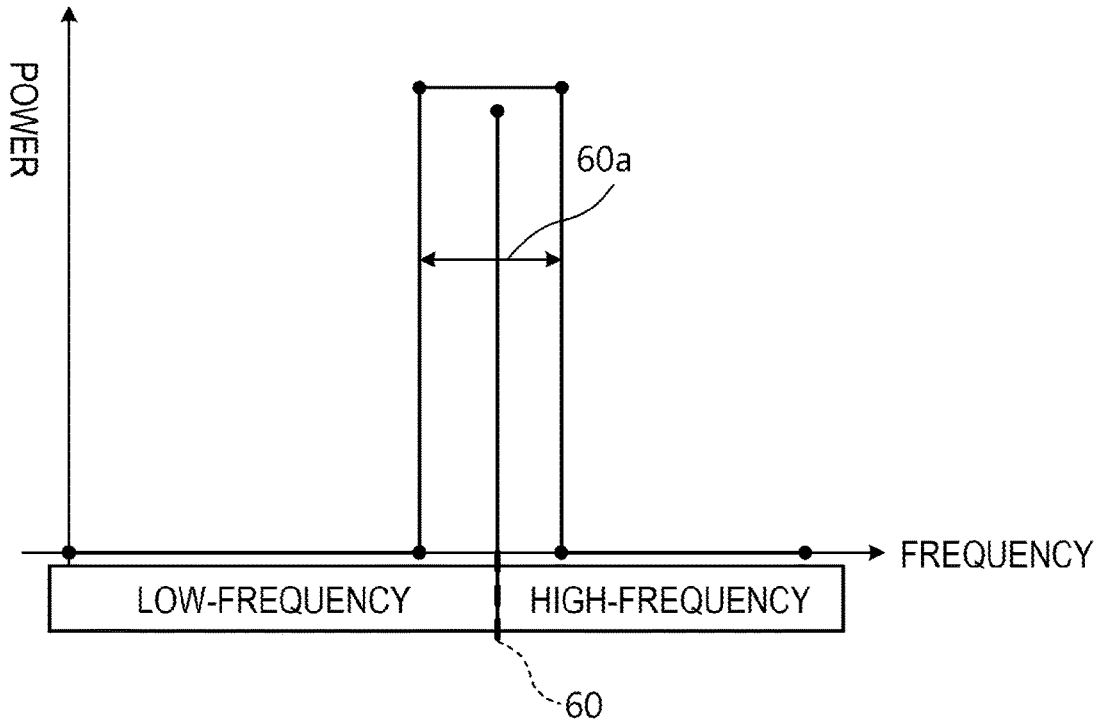
FIG. 4 is a diagram for explaining a BPF.

FIG. 4 is a diagram for explaining a BPF. In FIG. 4, the horizontal axis is an axis corresponding to the frequency and the vertical axis is an axis corresponding to the power. The BPF of a width 60*a* is applied so as to include a boundary 60 between the low-frequency and the high-frequency. The width 60*a* may be determined based on the upper limit of the low-frequency and the lower limit of the high-frequency. For example, the width 60*a* may be defined as "between the upper limit of the low-frequency $-\alpha$ and the lower limit of the high-frequency $+\alpha$." Further, in the case of the lower limit frequency of the high-frequency≤ the lower limit frequency of the low-frequency, the width 60*a* may be defined as "between the lower limit of the high-frequency $-\alpha$ and the upper limit of the low-frequency $+\alpha$."

Here, as an example, a BPF 131 is used to extract a sound signal near a boundary from the sound signal, but the present invention is not limited thereto. For example, a sound signal near the boundary may be extracted using a fast Fourier transform (FFT), a modified discrete cosine transform (MDCT), or a quadrature mirror filter (QMF) conversion.

The tone detection unit 132 is a processing unit that determines whether a tone is included in a sound signal near the boundary. For example, the tone detection unit 132 calculates a numerical value indicating a tone characteristic based on the sound signal near the boundary, and determines that the tone is included when the numerical value indicating the tone characteristic is equal to or larger than a threshold value. In the following description regarding the tone detection unit 132, a sound signal near the boundary is simply expressed as a sound signal. The tone detection unit 132 detects the presence or absence of a tone by performing a first tone detection processing or a second tone detection processing.

An example of the first tone detection processing will be described. The tone detection unit 132 calculates an inverse number of flatness of a power spectrum of the sound signal as a number T1 indicating the tone characteristic based on an equation (1). As the number T1 becomes smaller, the waveform of the frequency spectrum of the sound signal becomes more flat and the tone is less likely to be included. In the equation (1), X (ω) denotes the power of the sound signal corresponding to a frequency ω.

$$T1 = \frac{\frac{1}{N}\sum_{\omega=1}^{N} X(\omega)^2}{\sqrt[N]{\prod_{\omega=1}^{N} X(\omega)^2}} \tag{1}$$

When the number T1 is larger than a threshold value TH1, the tone detection unit 132 determines that the tone is included in the sound signal. In the meantime, when the number T1 is not larger than the threshold value TH1, the tone detection unit 132 determines that the tone is not included in the sound signal.

An example of the second tone detection processing will be described. The tone detection unit 132 obtains an autocorrelation R(j) at a value x(i) of the sound signal at time i with respect to the time domain of the sound signal based on equations (2) and (3a), and calculates the maximum value of the autocorrelation R(j) as a number T2 indicating the tone characteristic. When the number T2 is larger than a threshold value TH2, the tone detection unit 132 determines that the tone is included in the sound signal. In the meantime, when the number T2 is not larger than the threshold value TH2, the tone detection unit 132 determines that the tone is not included in the sound signal.

$$R(j) = \frac{\sum_{i=1}^{N} x(i)x(i-j)}{\sum_{i=1}^{N} x(i)^2} \tag{2}$$

$$T2 = \max(R(j)) \tag{3a}$$

The tone detection unit 132 performs the first tone detection processing or the second tone detection processing, and when it is determined that there is a tone, the tone detection unit 132 outputs information on the presence of a tone to the correction determination unit 133. Further, the tone detection unit 132 outputs the tone power to the low-frequency correction unit 140 and the high-frequency correction unit 160. Tone power is the power of the tones that are present at the boundary between the low-frequency and the high-frequency.

In the meantime, when the tone detection unit 132 determines that there is no tone, the tone detection unit 132 outputs information on the absence of a tone to the correction determination unit 133.

The tone detection unit 133 is a processing unit that acquires an encoding condition when information indicating that the tone is present from the tone detection unit 132 is acquired, and determines whether the low-frequency tone or the high-frequency tone of the sound signal is suppressed based on the encoding condition. The encoding condition includes, for example, information on an encoding bit rate. The information on the encoding condition may be input by the administrator or may be set in the correction determination unit 133 in advance.

The correction determination unit 133 determines that the encoding condition is a high rate when the value of the bit rate included in the encoding condition is equal to or larger than the threshold value. When it is determined that the encoding condition is a high rate, the correction determination unit 133 determines that the high-frequency tone is suppressed, and outputs a control signal to the high-frequency correction unit 160.

The correction determination unit 133 determines that the encoding condition is a low rate when the value of the bit rate included in the encoding condition is less than the threshold value. When it is determined that the encoding condition is a low rate, the correction determination unit 133 determines that the low-frequency tone is suppressed, and outputs the control signal to the low-frequency correction unit 140.

Referring back to FIG. 2, the low-frequency correction unit 140 is a processing unit that corrects the low-frequency signal by suppressing a tone component of the boundary included in the low-frequency signal when the control signal is received from the determination unit 130. The low-frequency correction unit 140 outputs the corrected low-frequency signal to the low-frequency encoding unit 150.

When the control signal is not received from the determination unit 130, the low-frequency correction unit 140 outputs the low-frequency signal received from the low-frequency signal extraction unit 110 to the low-frequency encoding unit 150 as it is.

Figure 5:
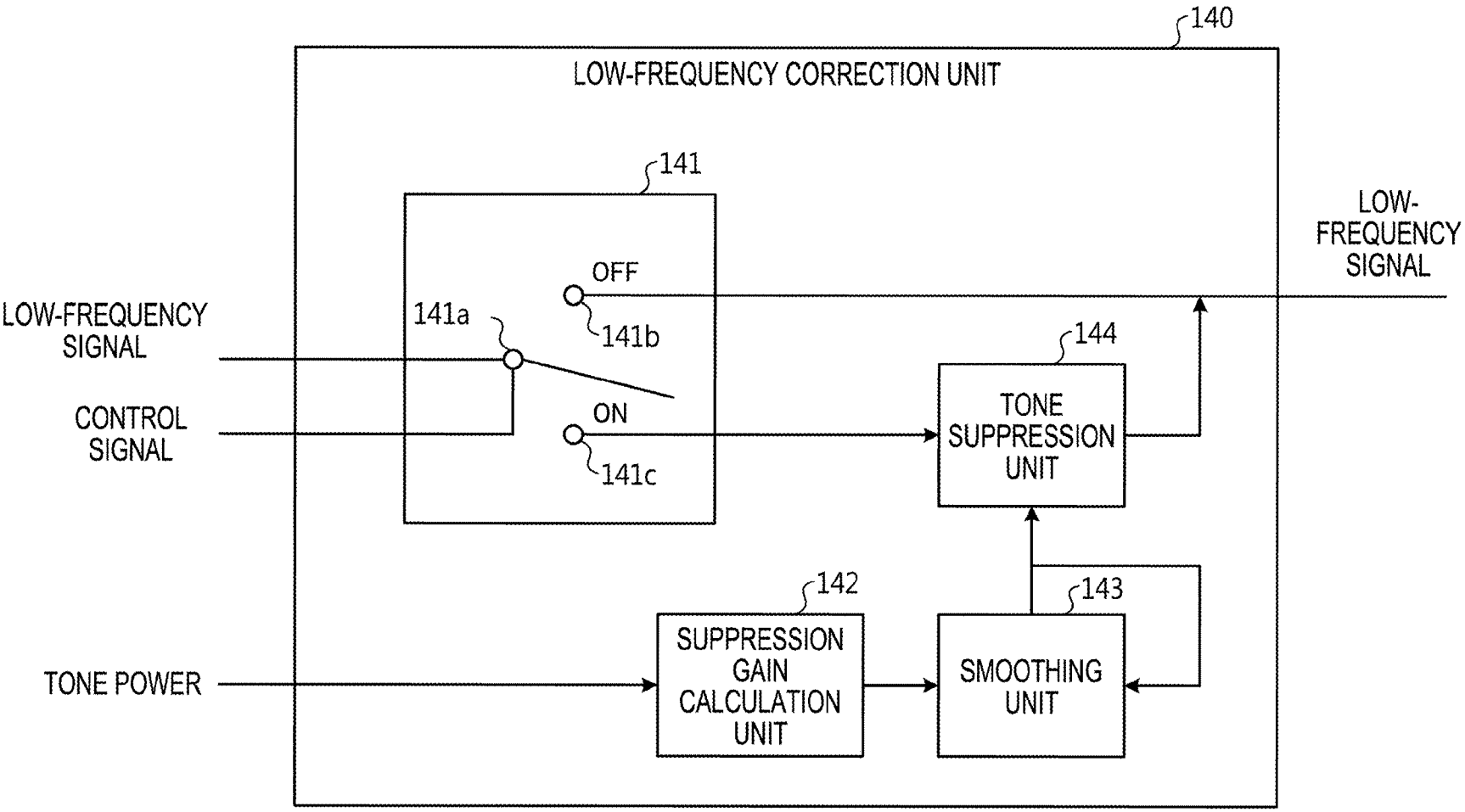
FIG. 5 is a functional block diagram illustrating the configuration of a low-frequency correction unit according to the first embodiment.

FIG. 5 is a functional block diagram illustrating the configuration of a low-frequency correction unit according to the first embodiment. As illustrated in FIG. 5, the low-frequency correction unit 140 includes a switch 141, a suppression gain calculation unit 142, a smoothing unit 143, and a tone suppression unit 144.

The switch 141 is a switch that switches the path of the low-frequency signal according to the control signal acquired from the determination unit 130. When the switch 141 does not receive a control signal, the switch 141 connects a terminal 141*a* and a terminal 141*b*, thereby passing through the low-frequency signal as it is. When the switch 141 receives the control signal, the switch 141 connects the terminal 141*a* and the terminal 141*c*, thereby inputting the low-frequency signal to the tone suppression unit 144.

The suppression gain calculation unit 142 is a processing unit that calculates a gain for suppressing the tone of the low-frequency signal below a dynamic masking threshold value. The dynamic masking threshold value is a threshold value determined by a set of the frequency at which the suppression target tone is present and the tone power.

Figure 6:
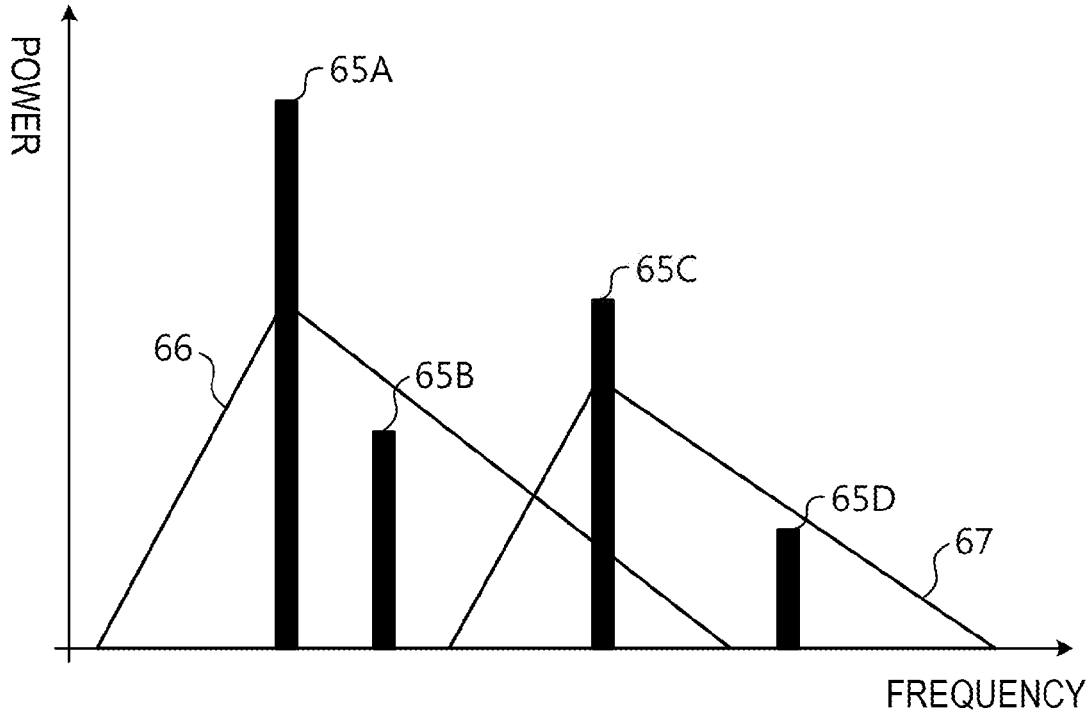
FIG. 6 is a diagram for explaining a dynamic masking threshold value.

FIG. 6 is a diagram for explaining a dynamic masking threshold value. In FIG. 6, the horizontal axis is an axis corresponding to the frequency and the vertical axis is an axis corresponding to the power. For example, when the tone is adjacent but the tone power is below the dynamic masking threshold value, the tone is not heard.

The dynamic masking threshold value of a tone 65A becomes a threshold value 66. Since the tone power of the tone 65A is above the threshold value 66, the sound of the tone 65A is heard. In the meantime, when the tone power of the tone 65A is suppressed and corrected to a tone 65B, the threshold value becomes less than 66, and the sound of the tone 65B is not heard.

The dynamic masking threshold value for a tone 65C becomes a threshold value 67. Since the tone power of the tone 65C is above a threshold value 67, the sound of the tone 65C is heard. In the meantime, when the tone power of the tone 65C is suppressed and corrected to a tone 65D, the threshold value becomes less than 67, and the sound of the tone 65D is not heard.

The suppression gain calculation unit 142 refers to a table that associates the tone frequency, the tone power, and the dynamic masking threshold value with each other to specify the dynamic masking threshold value. For example, the frequency of the tone is set to the frequency at the boundary between the low-frequency and the high-frequency. The suppression gain calculation unit 142 compares the tone power with the dynamic masking threshold value to specify a suppression gain at which the tone power is less than the dynamic masking threshold value. The suppression gain calculation unit 142 outputs the suppression gain to the smoothing unit 143.

The smoothing unit 143 is a processing unit that outputs a suppression gain that gradually increases to the tone suppression unit 144 in order to smoothly suppress the tone component of the low-frequency signal. For example, the smoothing unit 143 gradually increases the suppression gain from the initial value, and finally adjusts the magnitude of the suppression gain to the magnitude of the suppression gain notified from the suppression gain calculation unit 142.

The tone suppression unit 144 is a processing unit that suppresses the tone of the boundary by multiplying the tone component by the suppression gain acquired from the smoothing unit 143 and corrects the low-frequency signal. The tone suppression unit 144 outputs the corrected low-frequency signal to the low-frequency encoding unit 150.

Figure 7:
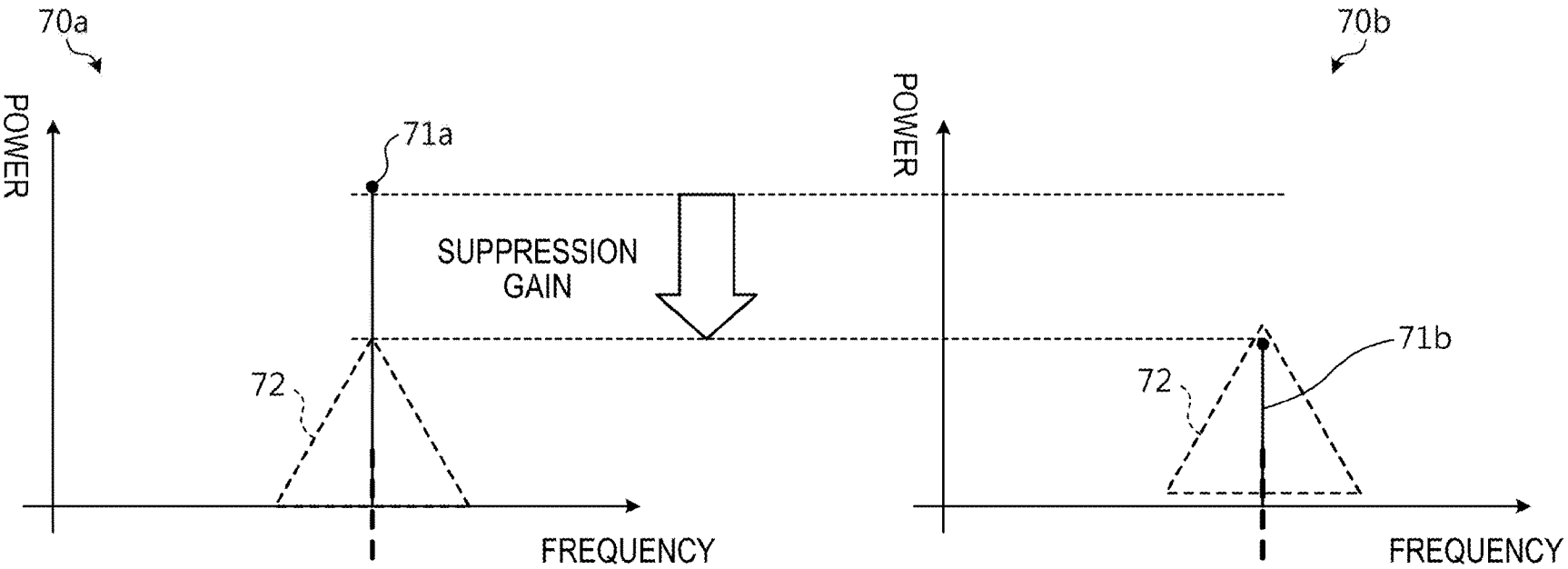
FIG. 7 is a diagram for explaining a processing of the low-frequency correction unit according to the first embodiment.

FIG. 7 is a diagram for explaining a processing of the low-frequency correction unit according to the first embodiment. In FIG. 7, the frequency spectrum of the low-frequency signal before correction is set to a frequency spectrum 70*a*. The frequency spectrum of the low-frequency signal after correction is set to a frequency spectrum 70*b*. The horizontal axis of the frequency spectra 70*a* and 70*b* is an axis that corresponds to the frequency, and the vertical axis of the frequency spectra 70*a* and 70*b* is an axis that corresponds to the power.

As illustrated in the frequency spectrum 70*a*, there is a tone 71*a* at the boundary. The dynamic masking threshold value corresponding to the tone 71*a* is set to a dynamic masking threshold value 72. The tone suppression unit 144 corrects the tone 71*a* to a tone 71*b* by giving a suppression gain such that the tone 71*a* is less than the dynamic masking threshold value 72. As a result, the tone 71*b* is less than the dynamic threshold value 72 and is not heard, so that the sound quality of the sound signal may deteriorate.

Referring back to FIG. 2, the low-frequency encoding unit 150 is a processing unit that acquires the low-frequency signal from the low-frequency correction unit and generates a low-frequency code by encoding the low-frequency signal into a bit string. For example, the low-frequency encoding unit 150 performs an encoding based on the AAC. The low-frequency encoding unit 150 outputs the low-frequency code to the multiplexing unit 180.

The high-frequency correction unit 160 is a processing unit that corrects the high-frequency information by suppressing the envelope power of the boundary included in the high-frequency information when the control signal is received from the determination unit 130. The high-frequency correction unit 160 outputs the corrected high-frequency information to the high-frequency encoding unit 170.

When the control signal is not received from the determination unit 130, the high-frequency correction unit 160 outputs the high-frequency information acquired from the high-frequency information extraction unit 120 to the high-frequency encoding unit 170 as it is.

Figure 8:
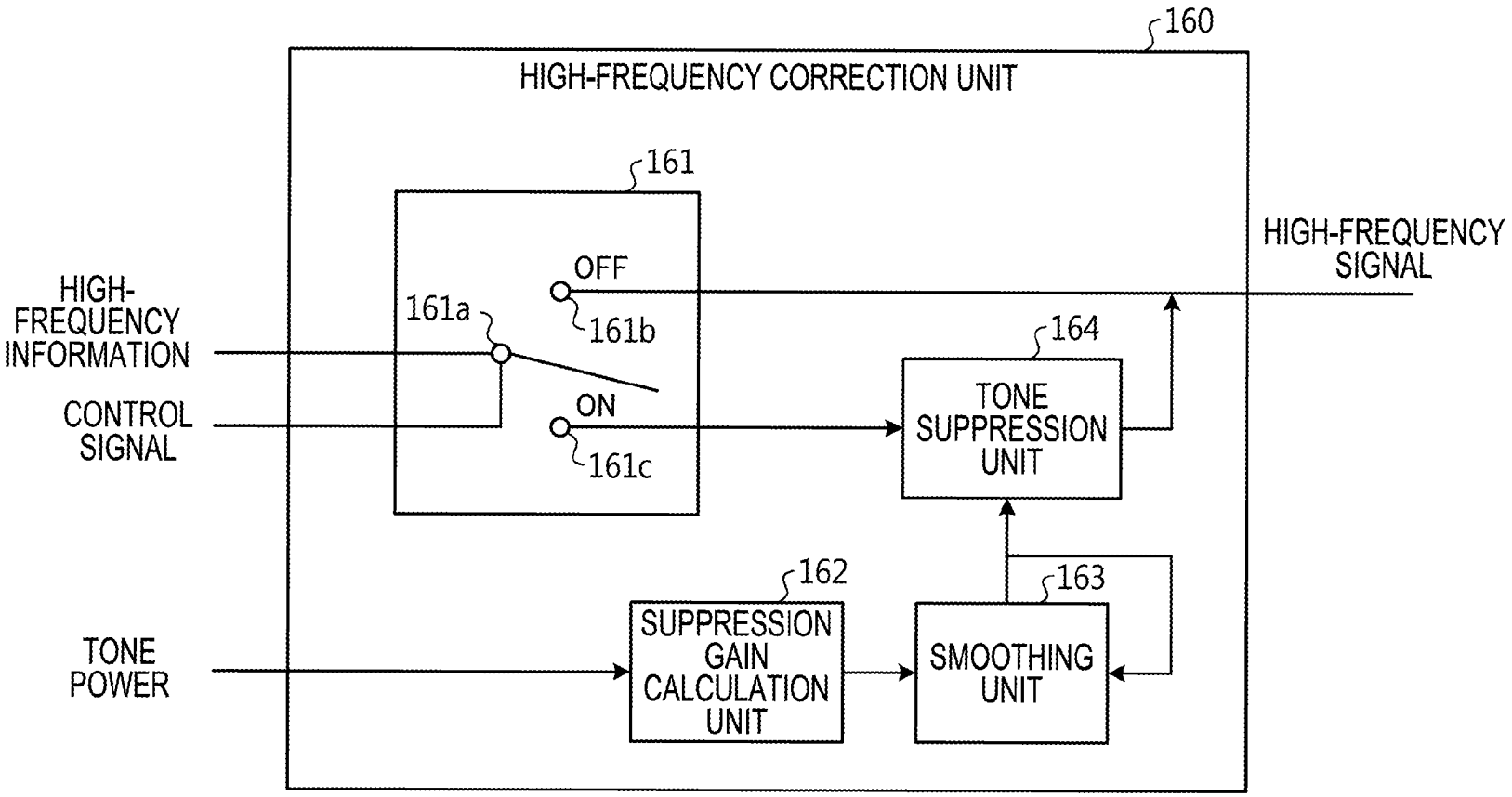
FIG. 8 is a functional block diagram illustrating the configuration of a high-frequency correction unit according to the first embodiment.

FIG. 8 is a functional block diagram illustrating the configuration of the high-frequency correction unit according to the first embodiment. As illustrated in FIG. 8, the high-frequency correction unit 160 includes a switch 161, a suppression gain calculation unit 162, a smoothing unit 163, and a tone suppression unit 164.

The switch 161 is a switch that switches the path of the high-frequency information according to the control signal obtained from the determination unit 130. When the switch 161 does not receive the control signal, the switch 161 connects a terminal 161*a* and a terminal 161*b*, thereby passing through the high-frequency information as it is. When the switch 161 receives the control signal, the switch 161 connects the terminal 161*a* and the terminal 161*c*, thereby inputting the high-frequency information to the tone suppression unit 164.

The suppression gain calculation unit 162 is a processing unit that calculates a gain that suppresses the envelope power (tone power) at the boundary included in the high-frequency information to the dynamic masking threshold value or less. The dynamic masking threshold is a threshold value determined by the frequency of the boundary and the envelope power of the boundary.

The suppression gain calculation unit 162 specifies the dynamic masking threshold value by referring to a table that associates the frequency of the boundary, the envelope power of the boundary, and the dynamic masking threshold value with each other. The suppression gain calculation unit 162 compares the envelope power at the boundary with the dynamic masking threshold value to specify the suppression gain at which the envelope power is less than the dynamic masking threshold value. The suppression gain calculation unit 162 outputs the suppression gain to the smoothing unit 163.

The smoothing unit 163 is a processing unit that outputs a suppression gain that gradually increases to the tone suppression unit 164 in order to smoothly suppress the value of the envelope power. For example, the smoothing unit 163 gradually increases the suppression gain from the initial value, and finally adjusts the magnitude of the suppression gain to the magnitude of the suppression gain notified from the suppression gain calculation unit 162.

The tone suppression unit 164 is a processing unit that corrects the high-frequency information by multiplying the suppression gain acquired from the smoothing unit 163 by the envelope power of the boundary. By suppressing the envelope power of the boundary, the tone of the boundary decoded by the decoding apparatus 20 is less than the dynamic masking threshold value. The tone suppression unit 164 outputs the corrected high-frequency information to the high-frequency encoding unit 170. Further, the tone suppression unit 164 corrects only the envelope power in the envelope power, the tone frequency, and the frequency resolution included in the high-frequency information, and does not correct the tone frequency and the frequency resolution.

Figure 9:
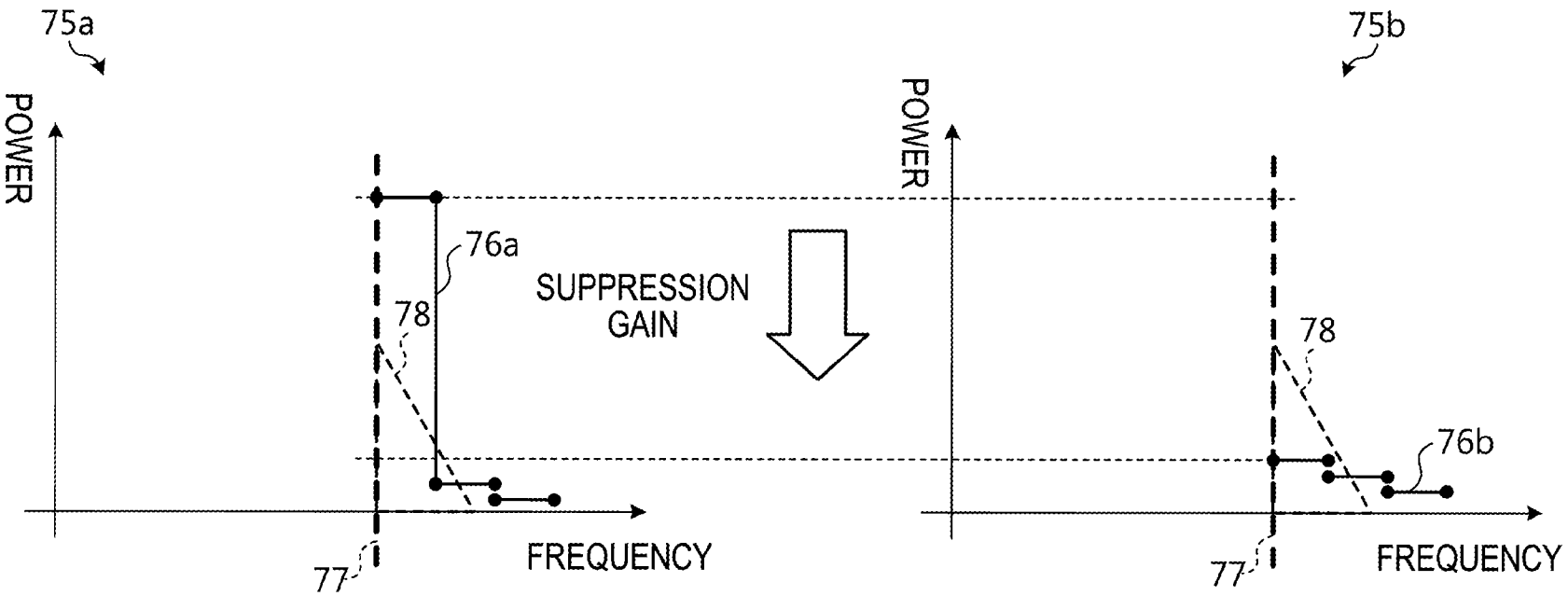
FIG. 9 is a diagram illustrating a processing of the high-frequency correction unit according to the first embodiment.

FIG. 9 is a diagram illustrating a processing of the high-frequency correction unit according to the first embodiment. In FIG. 9, an envelope power 76*a* before correction is illustrated on a frequency spectrum 75*a*. The envelope power 76*b* after correction is illustrated on a frequency spectrum 75*b*. The horizontal axis of the frequency spectra 75*a* and 75*b* is an axis corresponds to the frequency, and the vertical axis of the frequency spectra 75*a* and 75*b* is an axis corresponds to the power. Further, the boundary between the low-frequency and the high-frequency is defined as a boundary 77.

For example, the dynamic masking threshold corresponding to an envelope power 76*a* near the boundary 77 is set to a dynamic masking threshold value 78. The tone suppression unit 164 corrects the high-frequency information by generating an envelope power 76*b* which suppresses the envelope power 76*a* so that the envelope power 76*a* of the boundary 77 becomes less than the dynamic masking threshold value 78. Since the envelope power 76*b* is less than the dynamic masking threshold value 78, the tone component of the boundary which is decoded based on the envelope power 76*b* is suppressed.

Referring back to FIG. 2, the multiplexing unit 180 is a processing unit that generates a stream by multiplexing the low-frequency code and the high-frequency code. The multiplexing unit 180 transmits the stream to the decoding apparatus 20 via the network 50.

Figure 10:
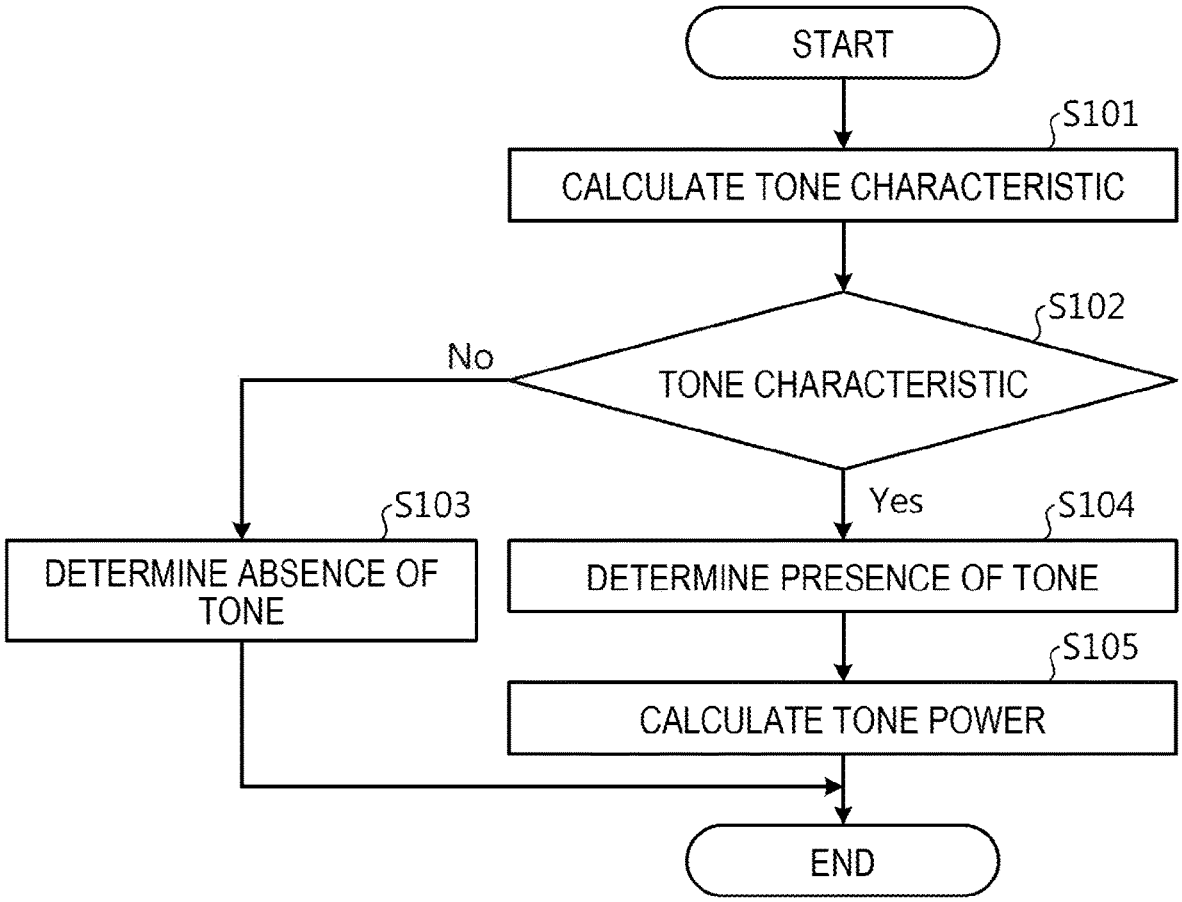
FIG. 10 is a flowchart (1) illustrating a processing procedure of the determination unit according to the first embodiment.

Next, the processing procedure of the determination unit 130 of the audio encoding apparatus 100 according to the first embodiment will be described. FIG. 10 is a flowchart (1) illustrating a processing procedure of the determination unit according to the first embodiment. As illustrated in FIG. 10, the determination unit 130 of the audio encoding apparatus 100 calculates a tone characteristic T (operation S101). In the operation S101, the determination unit 130 may calculate the tone characteristic T1 by the first tone detection processing, or may calculate a tone characteristic T2 by the second tone detection processing.

The determination unit 130 determines whether the tone characteristic T is larger than the threshold value TH (operation S102). In the operation S102, the determination unit 130 compares the tone characteristic T1 with the threshold value TH1 when the tone characteristic T1 is calculated. When the tone characteristic T2 is calculated, the determination unit 130 compares the tone characteristic T2 with the threshold value TH2.

When it is determined that the tone T is larger than the threshold value TH ("YES" in the operation S102), the determination unit 130 determines that a tone is present (operation S104). In the meantime, when it is determined that the tone characteristic T is not larger than the threshold value TH ("NO" in the operation S102), the determination unit 130 determines that no tone is present (operation S103). The determination unit 130 calculates the tone power (operation S105).

Figure 11:
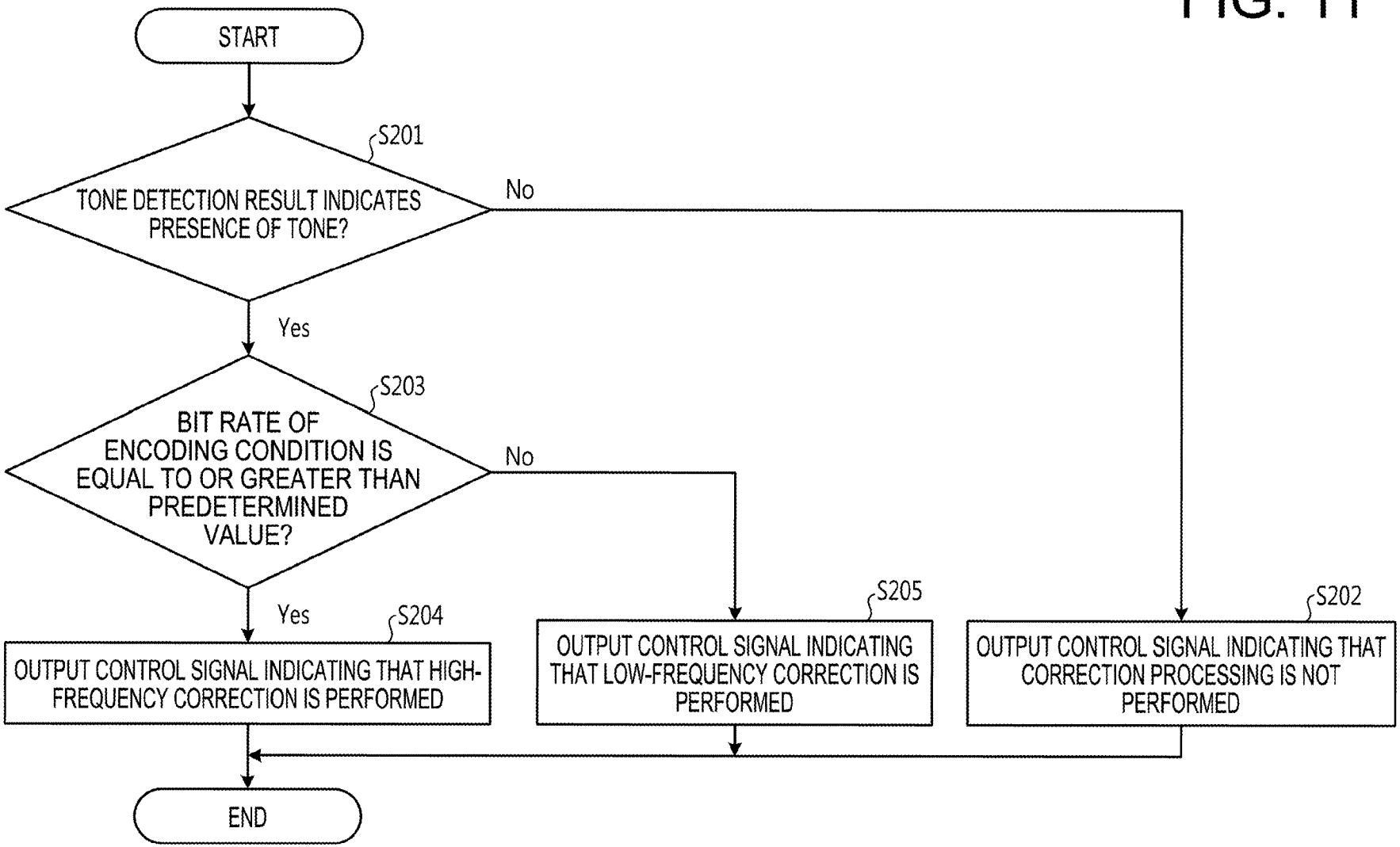
FIG. 11 is a flowchart (2) illustrating a processing procedure of the determination unit according to the first embodiment.

FIG. 11 is a flowchart (2) illustrating a processing procedure of the determination unit according to the first embodiment. As illustrated in FIG. 11, the determination unit 130 of the audio encoding apparatus 100 determines whether the tone detection result indicates the presence or absence of a tone (operation S201). When it is determined that the tone detection result does not indicate the presence of a tone ("NO" in the operation S201), the determination unit 130 outputs a control signal indicating that a correction processing is not performed (operation S202). In the operation S202, the determination unit 130 may suppress the output of the control signal when it is determined that the correction processing is not performed.

When it is determined that the tone detection result indicates the presence of a tone ("YES" in the operation S201), the determination unit 130 determines whether the bit rate of the encoding condition is equal to or greater than a predetermined value (operation S203). When it is determined that the bit rate of the encoding condition is equal to or greater than the predetermined value ("YES" in the operation S203), the determination unit 130 outputs a control signal indicating that a high-frequency correction is performed to the high-frequency correction unit 160 (operation S204).

When it is determined that the bit rate of the encoding condition is not equal to or greater than the predetermined value ("NO" in the operation S203), the determination unit 130 outputs a control signal indicating that a low-frequency correction is performed to the low-frequency correction unit 140 (operation S205).

Figure 12:
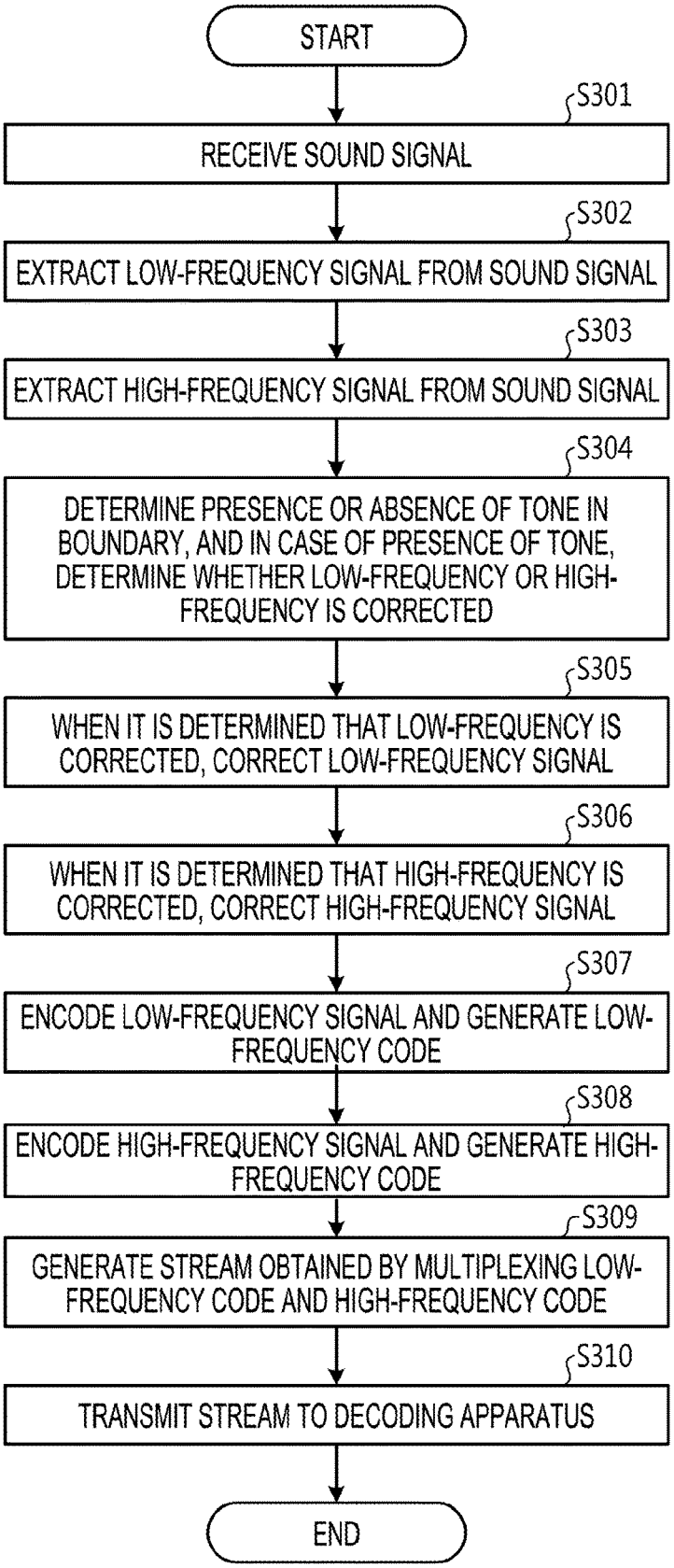
FIG. 12 is a flowchart illustrating a processing procedure of the audio encoding apparatus according to the first embodiment.

Next, an example of the processing procedure of the audio encoding apparatus 100 according to the first embodiment will be described. FIG. 12 is a flowchart illustrating a processing procedure of the audio encoding apparatus according to the first embodiment. As illustrated in FIG. 12, this audio encoding apparatus 100 receives a sound signal (operation S301).

The low-frequency signal extraction unit 110 of the audio encoding apparatus 100 extracts a low-frequency signal from the sound signal (operation S302). The high-frequency information extraction unit 120 of the audio encoding apparatus 100 extracts high-frequency information from the sound signal (operation S303).

The determination unit 130 of the audio encoding apparatus 100 determines the presence or absence of a tone at the boundary. When the tone is present, the determination unit 130 determines whether the low-frequency or the high-frequency is to be corrected (operation S304).

The low-frequency correction unit 140 of the audio encoding apparatus 100 corrects the low-frequency signal when it is determined that the low-frequency is corrected (operation S305). The high-frequency correction unit 160 of the audio encoding apparatus 100 corrects the envelope power of the high-frequency information when it is determined that the high-frequency is corrected (operation S306).

The low-frequency encoding unit 150 of the audio encoding apparatus 100 encodes the low-frequency signal to generate a low-frequency code (operation S307). The high-frequency encoding unit 170 of the audio encoding apparatus 100 encodes the high-frequency information to generate a high-frequency code (operation S308).

The multiplexing unit 180 of the audio encoding apparatus 100 generates a stream obtained by multiplexing the low-frequency code and the—high frequency code (operation S309). The multiplexing unit 180 transmits the stream to the decoding apparatus 20 (operation S310).

Next, the effect of the audio encoding apparatus 100 according to the first embodiment will be described. The audio encoding apparatus 100 suppresses one of the tones on the low-frequency side or the high-frequency side when the tone is detected at the boundary between the low-frequency and the high-frequency and then generates a stream obtained by multiplexing the low-frequency code and the high-frequency code. Thus, deterioration of the sound quality of the sound signal may be suppressed.

For example, the audio encoding apparatus 100 detects that the tone is at the boundary and suppresses the tone of the low-frequency signal, so that, for example, the tone 32*a* in FIG. 39 becomes smaller. As a result, vibration components are eliminated and deterioration of the sound quality may be suppressed. The audio encoding apparatus 100 detects that the tone is at the boundary and suppresses the tone of the high-frequency information (envelope power), so that, for example, the tone 32*b* in FIG. 39 becomes smaller. As a result, vibration components are eliminated and deterioration of the sound quality may be suppressed.

The audio encoding apparatus 100 determines whether the low-frequency tone or the high-frequency tone is suppressed by comparing the bit rate of the encoding condition with the threshold value and suppresses the tone of the bandwidth according to the determination result. As a result, it is possible to make a correction in the bandwidth with poor sound quality, depending on the bit rate. For example, when the bit rate is high, since the sound quality of the high-frequency is poor, the high-frequency is corrected. In the meantime, when the bit rate is low, since the sound quality of the low-frequency is poor, the low-frequency is corrected.

Figure 13:
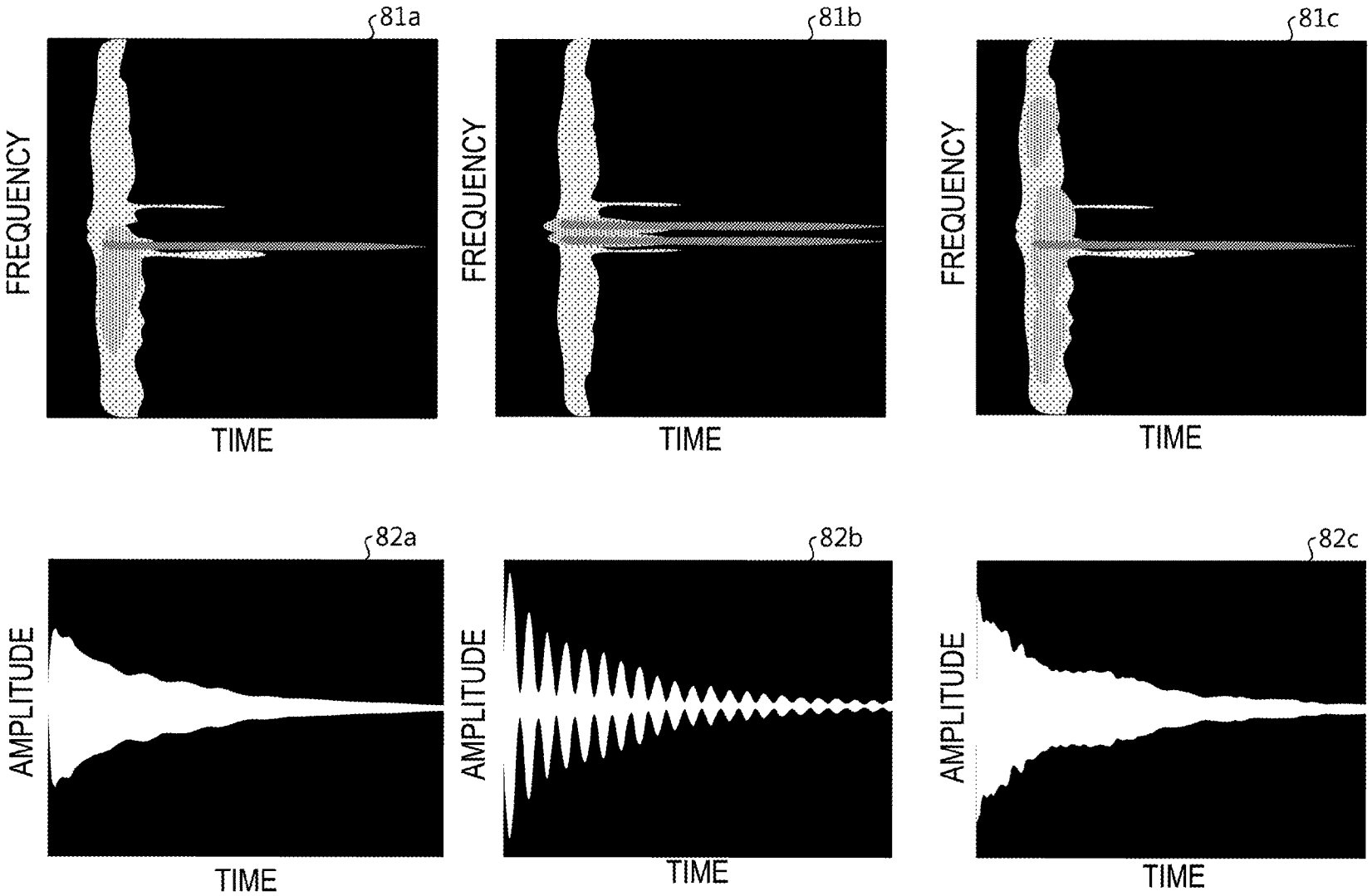
FIG. 13 is a diagram for explaining the effect of the audio encoding apparatus according to the first embodiment.

FIG. 13 is a diagram for explaining the effect of the audio encoding apparatus according to the first embodiment. In FIG. 13, a spectrum 81*a* and a time waveform 82*a* are the spectrum and the time waveform of the original sound (positive solution), respectively. As an example, the tone, in which the resonance of a cembalo decreases (16 bit, 48 kHz, or mono), is used as the original sound. Further, the boundary between the low-frequency and the high-frequency is set to 6.7 kHz.

A spectrum 81*b* and a time waveform 82*b* are the spectrum and the time waveform related to a signal that is obtained by decoding the stream encoded by the encoding apparatus 10 in the related art by the decoding apparatus 20. A spectrum 81*c* and a time waveform 82*c* are the spectrum and the time waveform related to a signal that is obtained by decoding the stream encoded by the audio encoding apparatus 100 by the decoding apparatus 20.

The horizontal axis of the spectra 81*a* to 81*c* is an axis corresponding to the time, and the vertical axis thereof is an axis corresponding to the frequency. Further, the spectra 81*a* to 81*c* represent the magnitude of the power value due to light and darkness, and the bright part represents a large power, while the dark part represents a low power. The horizontal axis of the time waveforms 82*a* to 82*c* is an axis corresponds to the time, and the vertical axis thereof is an axis corresponding to the amplitude.

Upon comparing the spectra 81*a* to 81*c* and comparing the time waveforms 82*a* to 82*c*, the encoding of the audio encoding apparatus 100 may suppress the fluctuation and suppress the deterioration of the sound quality compared with the technology in the related art.

The audio encoding apparatus 100 illustrated in FIG. 2 may have only one of the low-frequency correction unit 140 and the high-frequency correction unit 160, or may not necessarily have both the low-frequency correction unit 140 and the high-frequency correction unit 160.

For example, when the audio encoding apparatus 100 includes the low-frequency correction unit 140 and does not include the high-frequency correction unit 160, the low-frequency correction unit 140 corrects the low-frequency signal every time the tone of the boundary is detected. In the meantime, when the audio encoding apparatus 100 does not include the low-frequency correction unit 140 and includes the high-frequency correction unit 160, the high-frequency correction unit 160 corrects the envelope power of the high-frequency information every time the tone of the boundary is detected. With this configuration, it is possible to save the hardware resources of the audio encoding apparatus 100 and suppress the deterioration of the sound signal.

Second Embodiment

Figure 14:
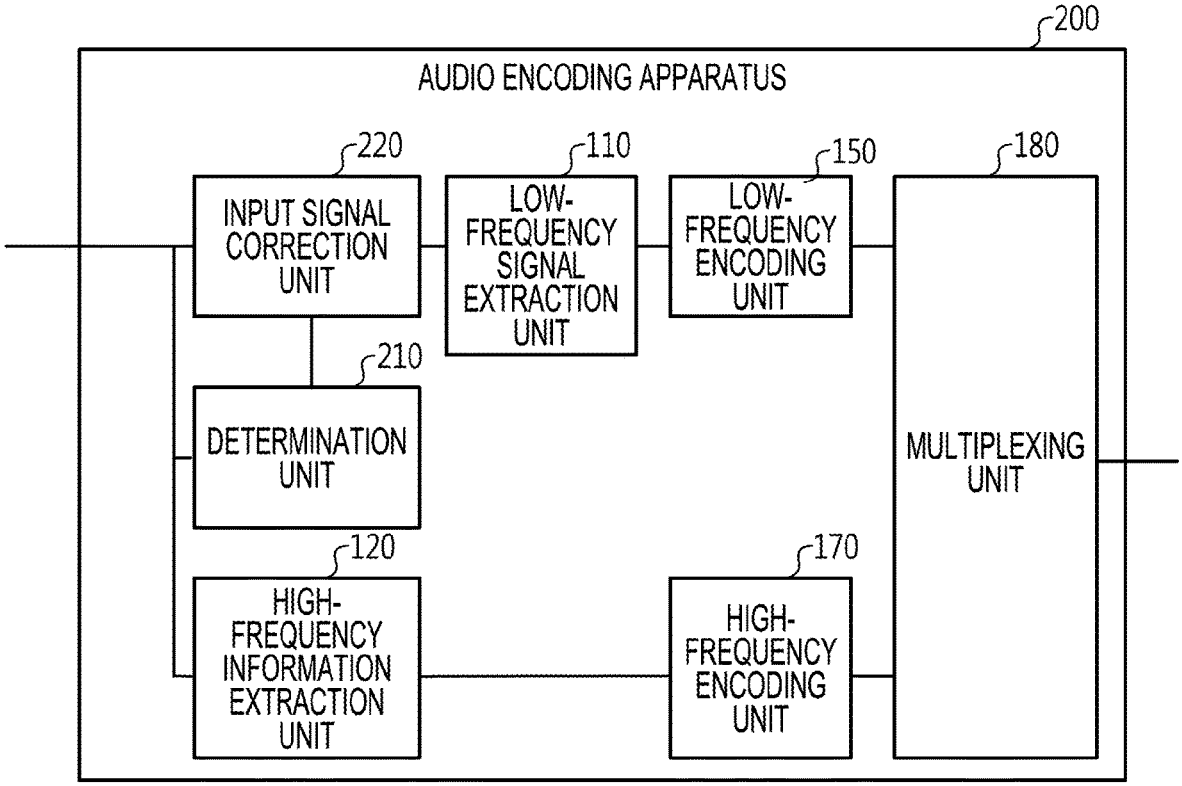
FIG. 14 is a functional block diagram illustrating the configuration of an audio encoding apparatus according to a second embodiment.

FIG. 14 is a functional block diagram illustrating the configuration of an audio encoding apparatus according to a second embodiment. As illustrated in FIG. 14, this audio encoding apparatus 200 includes a determination unit 210 and an input signal correction unit 220. The audio encoding apparatus 200 includes a low-frequency signal extraction unit 110, a high-frequency information extraction unit 120, a low-frequency encoding unit 150, a high-frequency encoding unit 170, and a multiplexing unit 180.

The determination unit 210 is a processing unit that acquires a sound signal from an external device and determines whether the tone is included in the boundary between the low-frequency and the high-frequency of the sound signal. Further, when the determination unit 210 determines that the tone is included in the boundary, the determination unit 210 outputs the control signal and the tone power to the input signal correction unit 220. A processing of determining by the determination unit 210 whether the tone is included in the boundary is the same as a processing of the determination unit 130 illustrated in the first embodiment.

The input signal correction unit 220 is a processing unit that corrects the sound signal by suppressing the tone component of the boundary included in the sound signal when a control signal is received from the determination unit 210. The input signal correction unit 220 outputs the corrected sound signal to the low-frequency signal extraction unit 110.

Figure 15:
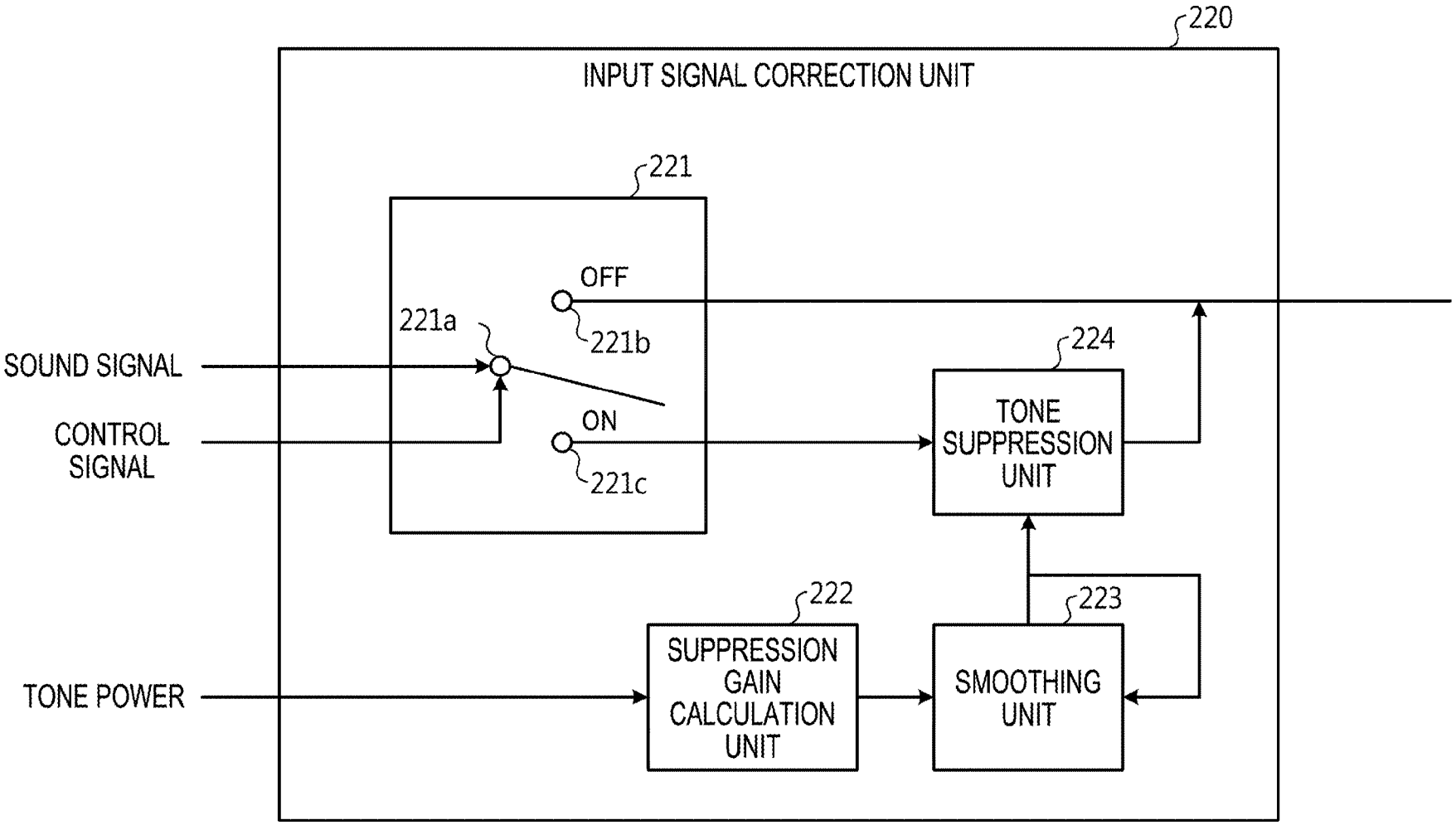
FIG. 15 is a functional block diagram illustrating the configuration of an input signal correction unit according to the second embodiment.

FIG. 15 is a functional block diagram illustrating the configuration of an input signal correction unit according to the second embodiment. As illustrated in FIG. 15, this input signal correction unit 220 includes a switch 221, a suppression gain calculation unit 222, a smoothing unit 223, and a tone suppression unit 224.

The switch 221 is a switch that switches the path of the sound signal according to the control signal obtained from the determination unit 210. When the switch 221 does not receive a control signal, the switch 221 connects a terminal 221*a* and a terminal 221*b*, thereby passing through the sound signal as it is. When the switch 221 receives the control signal, the switch 221 connects the terminal 221*a* and the terminal 221*c*, thereby inputting the sound signal to the tone suppression unit 224.

The suppression gain calculation unit 222 is a processing unit that calculates a gain for suppressing the tone located at the boundary of the sound signal below the dynamic masking threshold value. The suppression gain calculation unit 222 outputs the suppression gain to the smoothing unit 223. A processing of calculating the suppression gain by the suppression gain calculation unit 222 corresponds to a processing of the suppression gain calculation unit 142 illustrated in the first embodiment.

The smoothing unit 223 is a processing unit that outputs a suppression gain that gradually increases to the tone suppression unit 224 in order to smoothly suppress the tone component of the sound signal. For example, the smoothing unit 223 gradually increases the suppression gain from the initial value, and finally adjusts the magnitude of the suppression gain to the magnitude of the suppression gain notified from the suppression gain calculation unit 222.

The tone suppression unit 224 is a processing unit that suppresses the tone of the boundary by multiplying the suppression gain acquired from the smoothing unit 223 by the tone component at the boundary of the sound signal and corrects the low-frequency signal. The tone suppression unit 224 outputs the corrected sound signal to the low-frequency signal extraction unit 110.

Referring back to FIG. 14, the descriptions of the low-frequency signal extraction unit 110, the high-frequency information extraction unit 20, the low-frequency encoding unit 150, the high-frequency encoding unit 170, and the multiplexing unit 180 are the same as that of the low-frequency signal extraction unit 110, the high-frequency information extraction unit 120, the low-frequency encoding unit 150, the high-frequency encoding unit 170, and the multiplexing unit 180 described in the first embodiment, respectively. Thus, these elements are denoted by the same reference numerals and the description thereof is omitted.

Next, the effect of the audio coding apparatus 200 according to the second embodiment will be described. When the tone is detected at the boundary between the low-frequency and the high-frequency, the tone of the boundary of the sound signal is suppressed, and then a stream in which the low-frequency code and the high-frequency code are multiplexed is generated. As a result, deterioration of the sound quality of the sound signal may be suppressed. In addition, since the tone of the original sound signal is suppressed, it is possible to skip the processing of determining whether the low-frequency tone or the high-frequency tone is to be suppressed, so that the processing load may be reduced. It also makes it possible to save hardware resources.

Third Embodiment

Figure 16A:
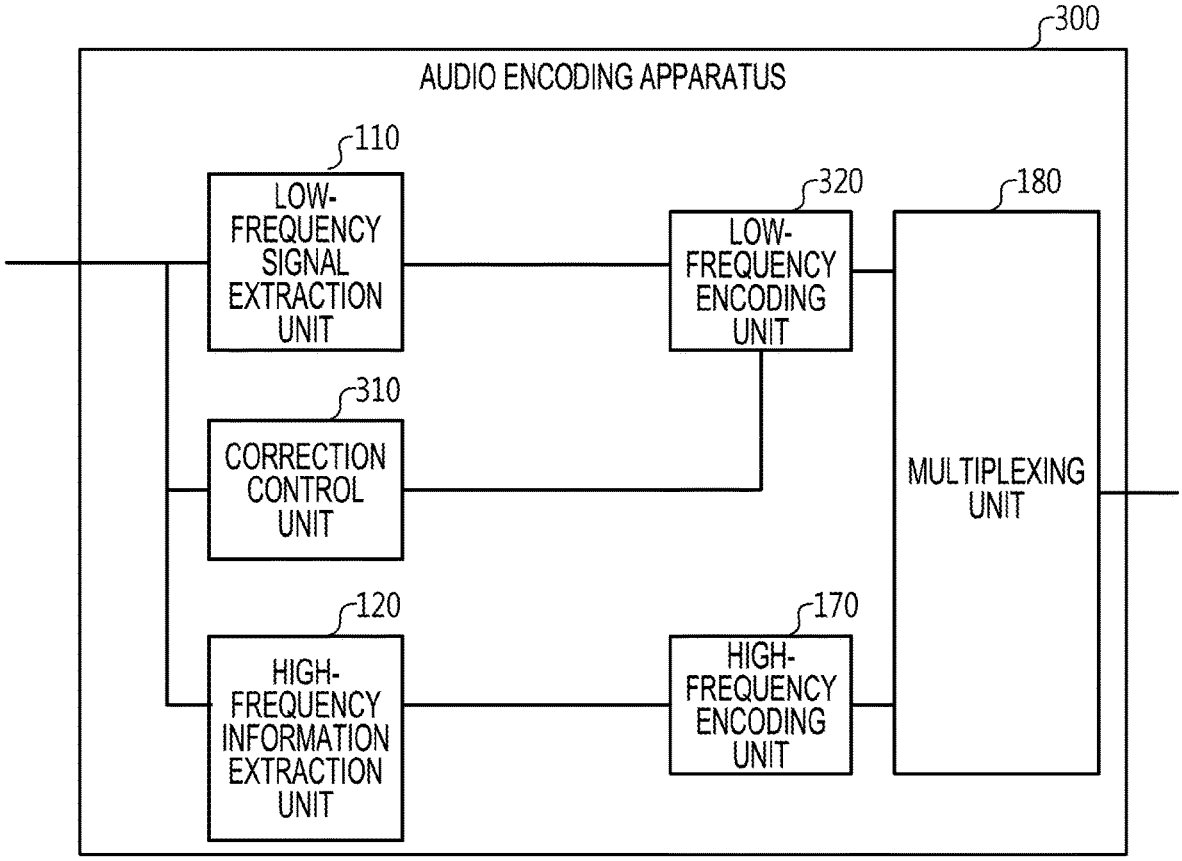
FIG. 16A is a functional block diagram illustrating the configuration of an audio encoding apparatus according to a third embodiment.

FIG. 16A is a functional block diagram illustrating the configuration of an audio encoding apparatus according to a third embodiment. As illustrated in FIG. 16A, the audio encoding apparatus 300 includes a low-frequency signal extraction unit 110, a high-frequency information extraction unit 120, a high-frequency encoding unit 170, a multiplexing unit 180, a correction control unit 310, and a low-frequency encoding unit 320.

The descriptions of the low-frequency signal extraction unit 110, the high-frequency information extraction unit 120, the high-frequency encoding unit 170, and the multiplexing unit 180 are the same as that of the low-frequency signal extraction unit 110, the high-frequency information extraction unit 120, the high-frequency encoding unit 170, and the multiplexing unit 180 described in the first embodiment, respectively.

The correction control unit 310 is a processing unit that limits a bandwidth to be encoded when encoding the low-frequency signal. The correction control unit 310 is an example of an encoding unit. With respect to the third embodiment, in the following description, the bandwidth to be encoded when encoding the low-frequency signal is expressed as an "encoding target bandwidth."

Figure 16B:
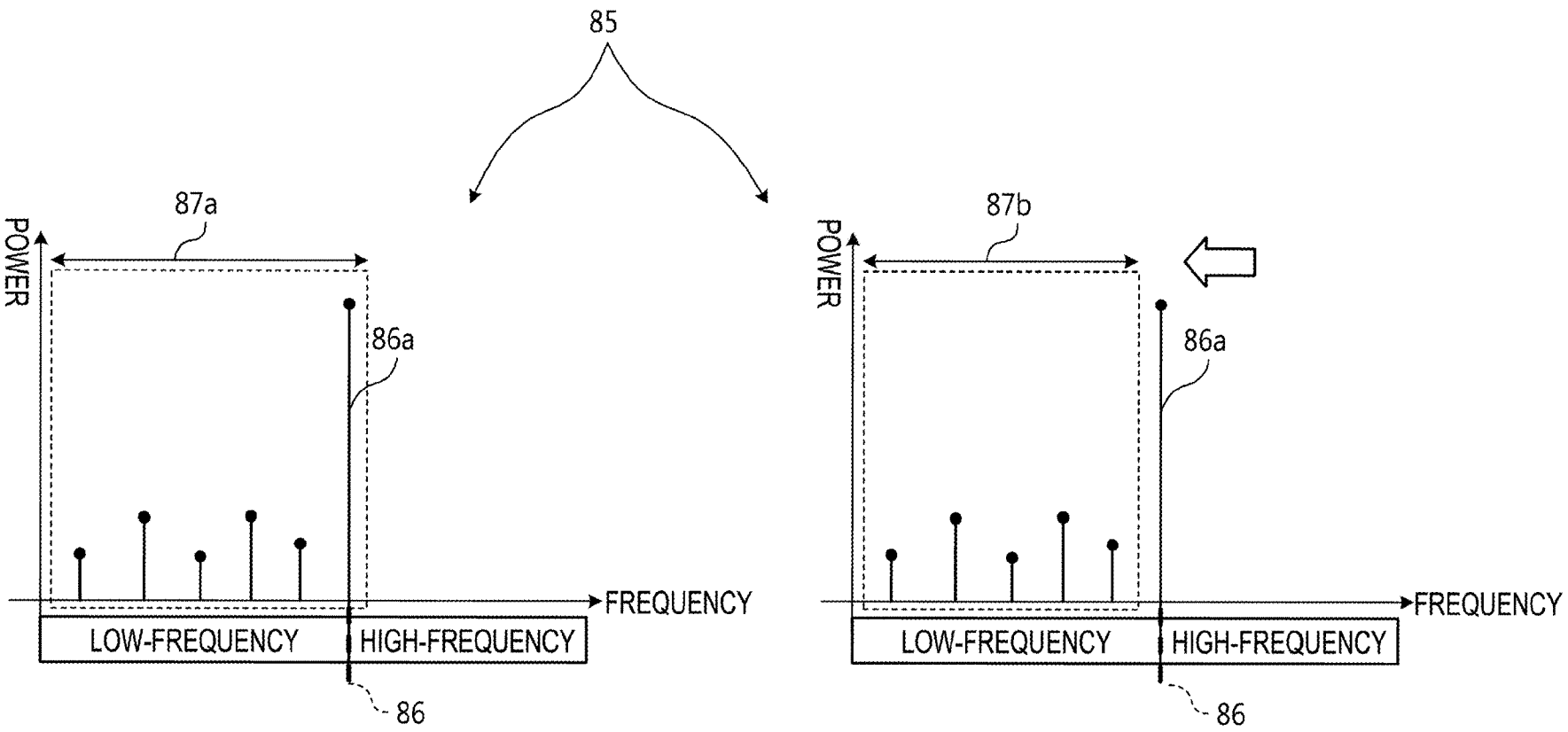
FIG. 16B is a diagram for explaining a processing of a correction control unit according to the third embodiment.

FIG. 16B is a diagram for explaining the processing of a correction control unit according to the third embodiment. The horizontal axis of a frequency spectrum 85 illustrated in FIG. 16B is an axis corresponding to the frequency, and the vertical axis thereof is an axis corresponding to the power (value) of the sound signal. For example, a tone 86*a* is present at a boundary 86 of the sound signal.

For example, the default bandwidth of an encoding target bandwidth is an encoding target bandwidth 87*a*. The correction control unit 310 corrects the encoding target bandwidth 87*a* to an encoding target bandwidth 87*b*. For example, in the correction control unit 310, the encoding target bandwidth 87*b* corresponds to a case where the upper limit of the encoding target band 87*a* is shifted to the low-frequency by one sub-band. The correction control unit 310 outputs information of the corrected encoding target bandwidth to the low-frequency encoding unit 320.

The low-frequency encoding unit 320 is a processing unit that acquires a low-frequency signal from the low-frequency signal extraction unit 110 and generates a low-frequency code by encoding the low-frequency signal into a bit string. The low-frequency encoding unit 320 outputs the low-frequency code to the multiplexing unit 180. Further, the low-frequency encoding unit 320 encodes a low-frequency signal that is included in the encoding target bandwidth 87*b* received from the correction control unit 310. Since the encoding target bandwidth 87*b* does not include the tone 86*a* at the boundary 86, the tone 86*a* is not included in the low-frequency code, and as a result, the deterioration of the sound quality may be suppressed.

Next, the effect of the audio encoding apparatus 300 according to the third embodiment will be described. When the low-frequency signal is encoded, the audio encoding apparatus 300 performs an encoding on the sound signal of the encoding target bandwidth excluding a boundary where the tone is present. This makes it possible to suppress the deterioration of the sound quality since the tone of the boundary is not included in the low-frequency signal.

Fourth Embodiment

Figure 17A:
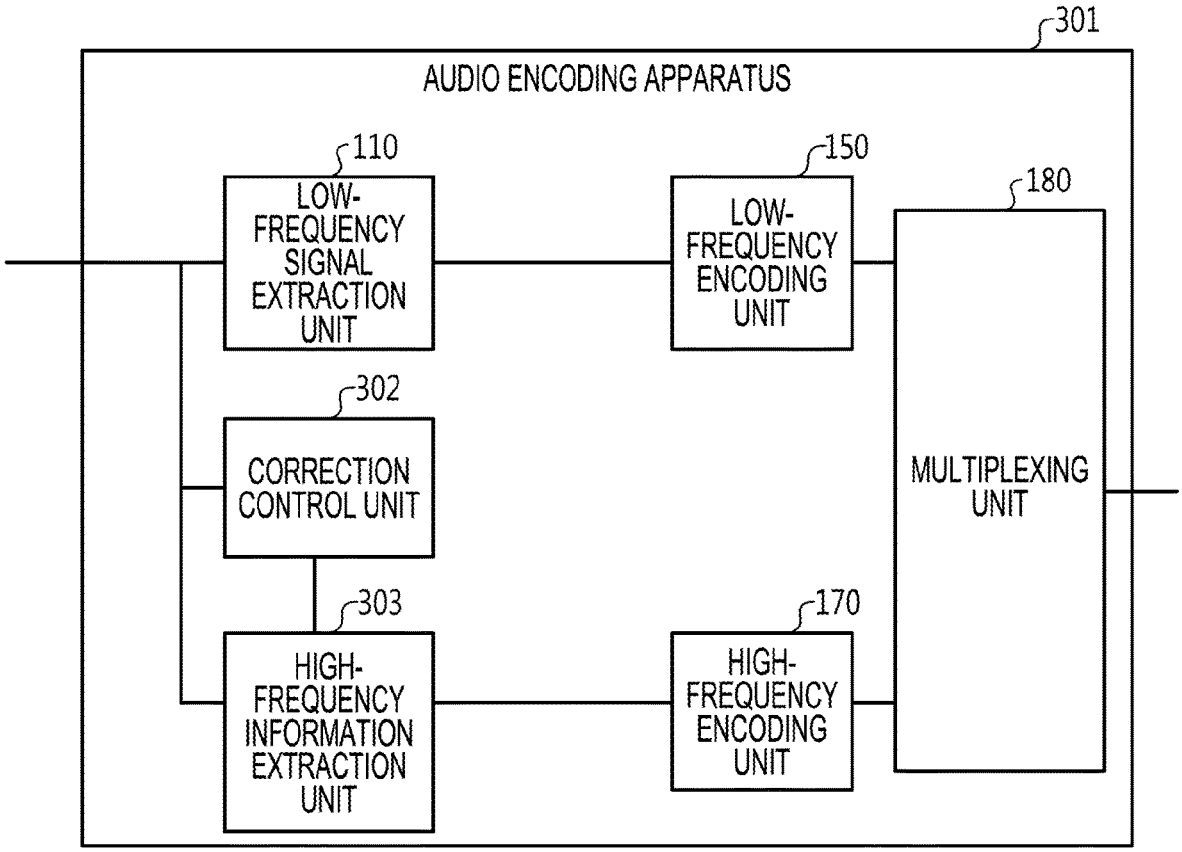
FIG. 17A is a functional block diagram illustrating the configuration of an audio encoding apparatus according to a fourth embodiment.

FIG. 17A is a functional block diagram illustrating the configuration of an audio encoding apparatus according to a fourth embodiment. As illustrated in FIG. 17A, the audio encoding apparatus 301 includes a low-frequency signal extraction unit 110, a low-frequency encoding unit 150, a high-frequency encoding unit 170, a multiplexing unit 180, a correction control unit 302, and a high-frequency information extraction unit 303.

The descriptions of the low-frequency signal extraction unit 110, the low-frequency encoding unit 150, the high-frequency encoding unit 170, and the multiplexing unit 180 are the same as that of the low-frequency signal extraction unit 110, the low-frequency encoding unit 150, the high-frequency encoding unit 170, and the multiplexing unit 180 described in the first embodiment, respectively.

The correction control unit 302 is a processing unit that limits a target bandwidth when encoding a high-frequency signal. The correction control unit 302 is an example of an encoding unit. Regarding a fourth embodiment, in the following description, a bandwidth to be used when encoding a high-frequency signal is expressed as an "encoding target bandwidth."

Figure 17B:
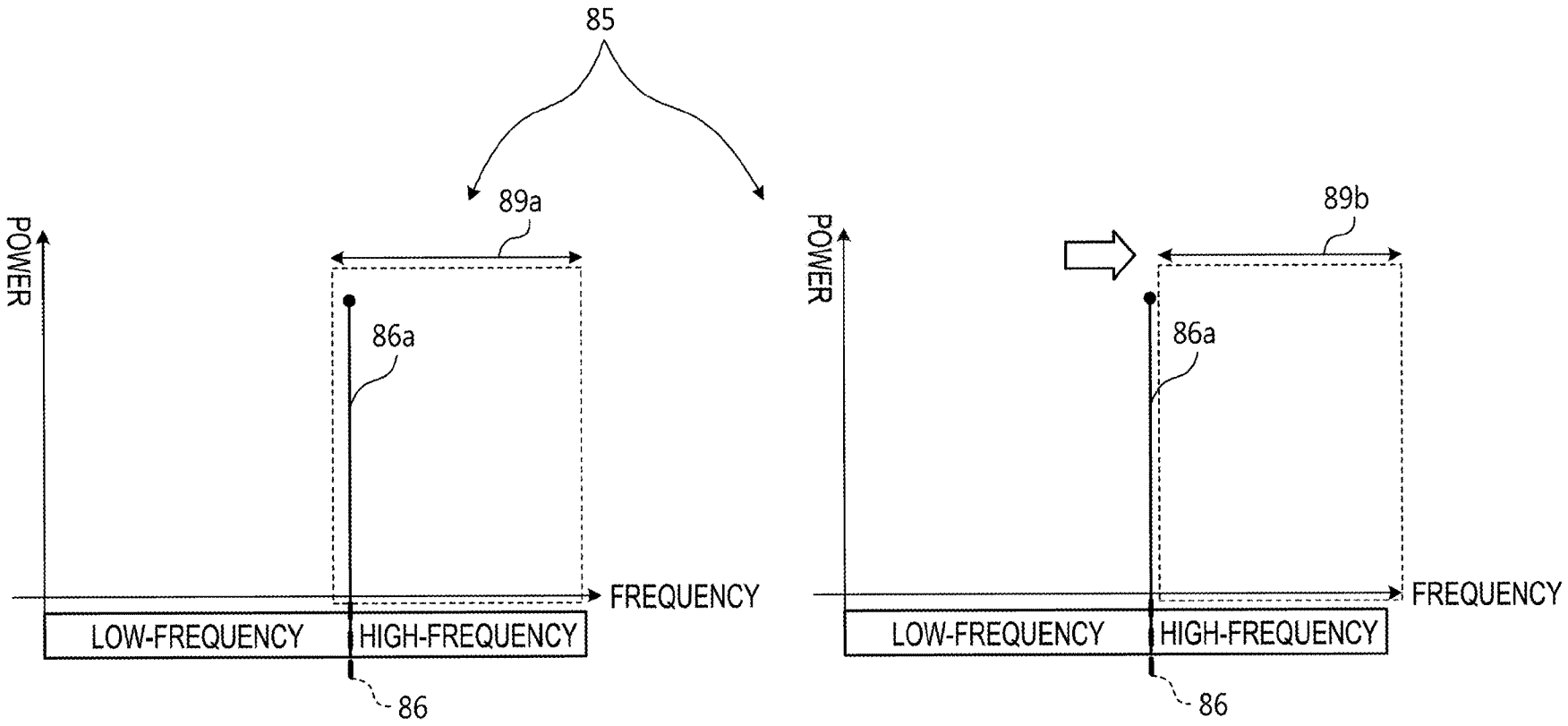
FIG. 17B is a diagram for explaining a processing of a correction control unit according to the fourth embodiment.

FIG. 17B is a diagram for explaining a processing of a correction control unit according to the fourth embodiment. The horizontal axis of the frequency spectrum 85 illustrated in FIG. 17B is an axis corresponding to the frequency, and the vertical axis thereof is an axis corresponding to the power (value) of the sound signal. For example, the tone 86*a* is present at the boundary 86 of the sound signal.

For example, the default bandwidth of an encoding target bandwidth is an encoding target bandwidth 89*a*. The correction control unit 302 corrects the encoding target bandwidth 89*a* to an encoding target bandwidth 89*b*. For example, the encoding target bandwidth 89*b* corresponds to a case where the lower limit of the encoding target bandwidth 89*a* is shifted to the high-frequency by one sub-band. The correction control unit 302 outputs the corrected information of the encoding target bandwidth to the high-frequency information extraction unit 303.

The high-frequency information extraction unit 303 is a processing unit that acquires a sound signal from an external device and extracts high-frequency information from the high-frequency of the sound signal (an encoding target bandwidth 89*b* illustrated in FIG. 17B). The high-frequency information extraction unit 303 outputs the high-frequency information to the high-frequency encoding unit 170. As described with reference to FIG. 17B, there is no tone 86*a* in the encoding target bandwidth 89*b*.

Next, the effect of the audio encoding apparatus 301 according to the fourth embodiment will be described. When the high-frequency signal is encoded, the audio encoding apparatus 301 encodes the sound signal of the encoding target bandwidth excluding a boundary where the tone is present. This makes it possible to suppress deterioration of the sound quality since the tone of the boundary is not included in the high-frequency signal.

Fifth Embodiment

Figure 18:
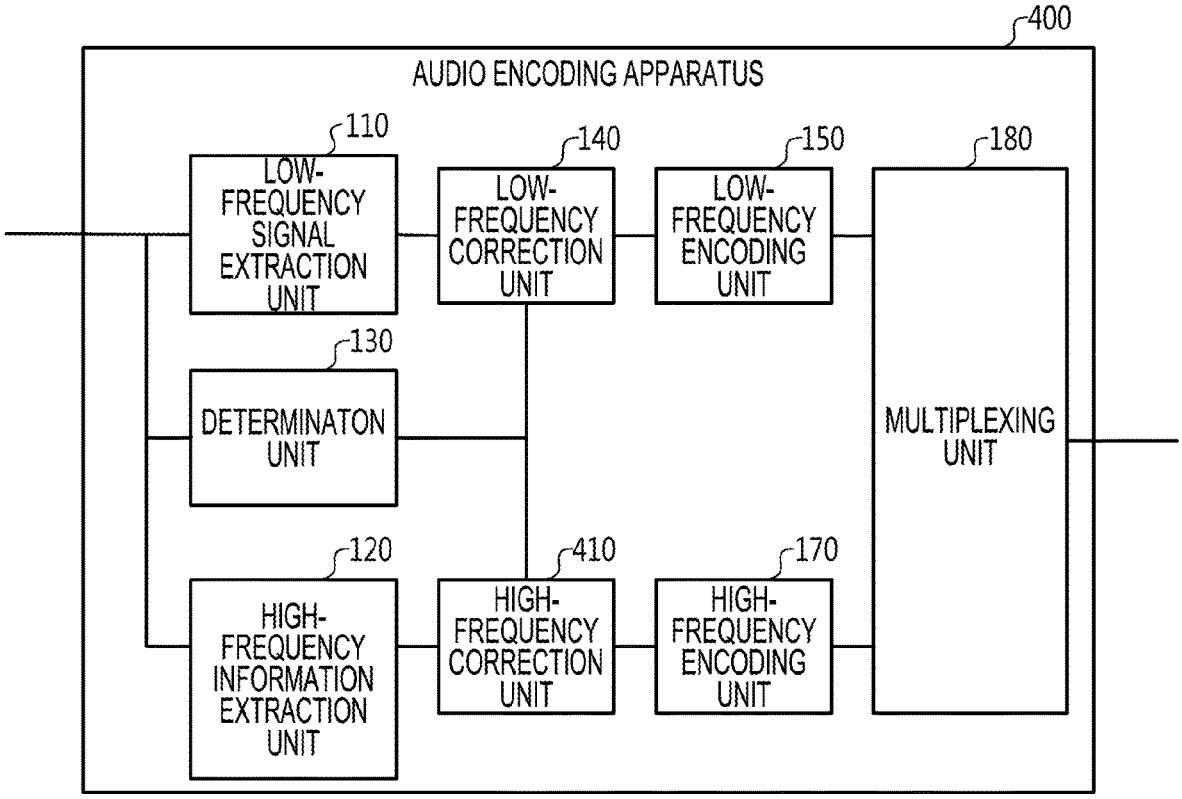
FIG. 18 is a functional block diagram illustrating the configuration of an audio encoding apparatus according to a fifth embodiment.

FIG. 18 is a functional block diagram illustrating the configuration of an audio encoding apparatus according to a fifth embodiment. As illustrated in FIG. 18, the configuration of the audio encoding apparatus 400 includes a low-frequency signal extraction unit 110, a high-frequency information extraction unit 120, a determination unit 130, a low-frequency correction unit 140, a low-frequency encoding unit 150, a high-frequency encoding unit 170, a multiplexing unit 180, and a high-frequency correction unit 410. The high-frequency correction unit 410 is an example of an encoding unit.

The descriptions of the low-frequency signal extraction unit 110, the high-frequency information extraction unit 120, the determination unit 130, the low-frequency correction unit 140, the low-frequency encoding unit 150, the high-frequency encoding unit 170, and the multiplexing unit 180 are the same as that of the respective processing units illustrated in FIG. 2, respectively. Thus, these processing units are denoted by the same reference numerals and the description thereof is omitted.

The high-frequency correction unit 410 is a processing unit that corrects high-frequency information by correcting the tone frequency included in the high-frequency information when a control signal is received from the determination unit 130. For example, the information of the tone frequency includes information on the presence or absence of a tone for a plurality of high-frequency bandwidths divided according to the resolution. When the presence or absence of the tone in the bandwidth corresponding to the boundary is indicated as "presence," the high-frequency correction unit 410 corrects the presence or absence of the tone in the bandwidth corresponding to the boundary to "absence."

Figure 19:
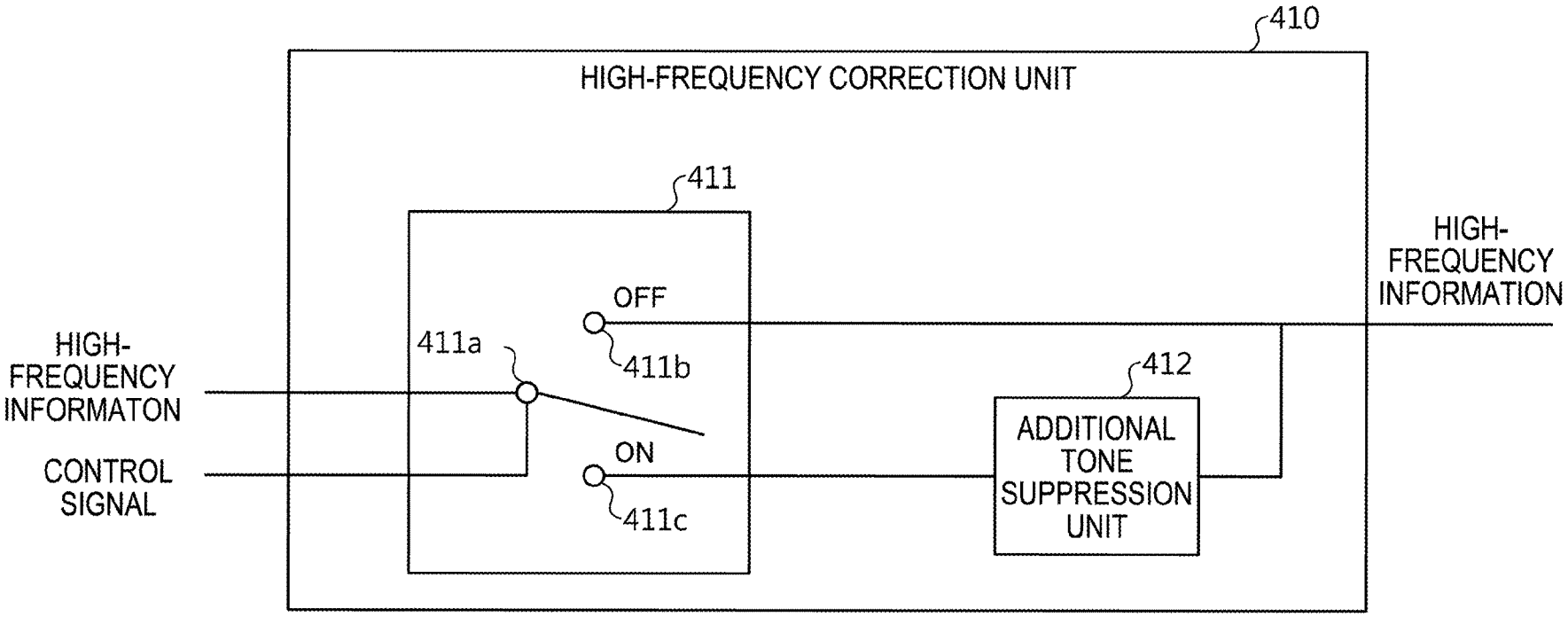
FIG. 19 is a functional block diagram illustrating the configuration of a high-frequency correction unit according to the fifth embodiment.

FIG. 19 is a functional block diagram illustrating the configuration of a high-frequency correction unit according to the fifth embodiment. As illustrated in FIG. 19, the high-frequency correction unit 410 includes a switch 411 and an additional tone suppression unit 412.

The switch 411 is a switch that switches the path of the high-frequency information according to the control signal acquired from the determination unit 130. When the switch 411 does not receive a control signal, a terminal 411*a* and a terminal 411*b* are connected to each other to allow the high-frequency information to pass therethrough. When the control signal is received, the switch 411 inputs the high-frequency information to the additional tone suppression unit 412 by connecting the terminal 411*a* and the terminal 411*c*.

Figure 20:
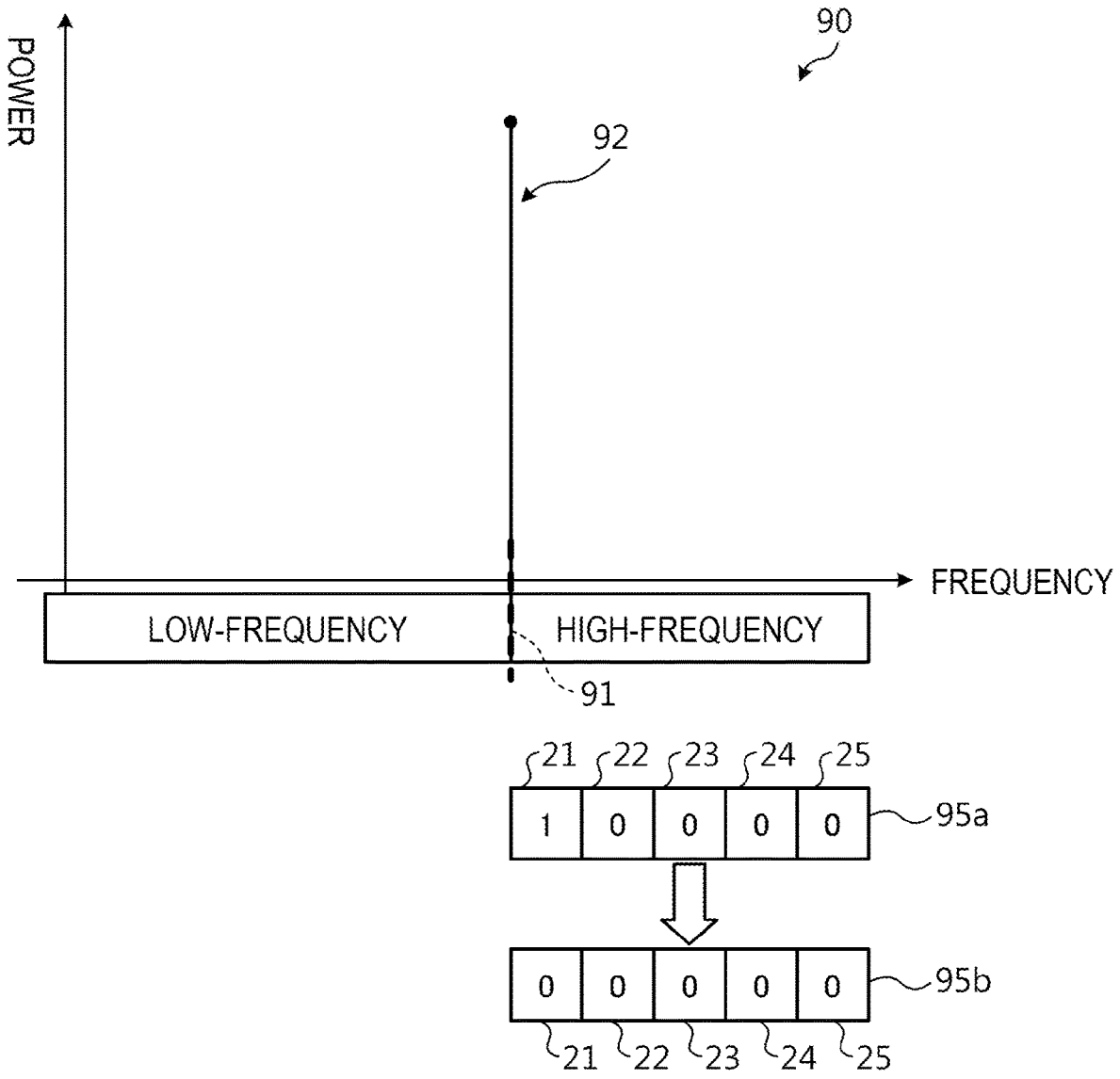
FIG. 20 is a diagram for explaining a processing of the high-frequency correction unit according to the fifth embodiment.

The additional tone suppression unit 412 is a processing unit that corrects the tone frequency included in the high-frequency information. FIG. 20 is a diagram for explaining a processing of the high-frequency correction unit according to the fifth embodiment. In FIG. 20, the horizontal axis of a frequency spectrum 90 is an axis corresponding to the frequency, and the vertical axis thereof is an axis corresponding to the signal power. In the example illustrated in FIG. 20, a boundary 91 includes a tone 92.

For example, the tone frequency is information that indicates whether there is a tone in the corresponding bandwidth by "0" or "1," and the fineness of the divided bandwidths depends on the frequency resolution. When there is a tone, "1" is set for the block of the corresponding bandwidth, and when there is no tone, "0" is set for the block of the corresponding bandwidth.

Tone frequencies 95*a* and 95*b* illustrated in FIG. 20 include blocks 21 to 25 corresponding to the respective bandwidths. Here, the block 21 is a block corresponding to the bandwidth of the boundary 91. The tone frequency 95*a* is the tone frequency before correction, and the tone frequency 95*b* is the tone frequency after correction.

When the block 21 having the tone frequency 95*a* is set to "1," the additional tone suppression unit 412 generates the tone frequency 95*b* by correcting the block 21 to "0." The additional tone suppression unit 412 outputs the high-frequency information including the corrected tone frequency 95*b*, the envelope power, and the frequency resolution to the high-frequency encoding unit 170.

Next, the effect of the audio encoding apparatus 400 according to the fifth embodiment will be described. When the tone is present at the boundary, the audio encoding apparatus 400 corrects the tone frequency of the high-frequency information so that the tone is not present at the boundary. This makes it possible to suppress the deterioration of the sound quality because no tone is generated at the boundary of the high-frequency signal that is decoded based on the corrected high-frequency information.

The processing of the audio encoding apparatuses 100 to 400 illustrated in the first to fifth embodiments is an example. Herein, descriptions will be made of the other processing of the audio encoding device. Here, such descriptions will be made using a block diagram of the audio encoding apparatus 100 illustrated in FIG. 2.

The determination unit 130 of the audio encoding apparatus 100 may compare the error power of the low-frequency with the error power of the high-frequency to determine whether the low-frequency tone or the high-frequency tone is suppressed.

For example, a low-frequency signal of a sound signal (original sound) is referred to as a first low-frequency signal, and a low-frequency signal obtained by decoding the low-frequency signal is referred to as a second low-frequency signal. The error power of the low-frequency is regarded as a difference value between the first low-frequency signal and the second low-frequency signal. The high-frequency signal of the sound signal (original sound) is referred to as a first high-frequency signal, and the high-frequency signal decoded based on the high-frequency code is referred to as a second high-frequency signal. The error power of the high-frequency is regarded as a difference value between the first high-frequency signal and the second high-frequency signal.

When the error power of the low-frequency is higher than the error power of the high-frequency, the determination unit 130 determines that the high-frequency tone is suppressed. In the meantime, when the error power of the low-frequency is equal to or lower than the error power of the high-frequency, the determination unit 130 determines that the low-frequency tone is suppressed.

Figure 21:
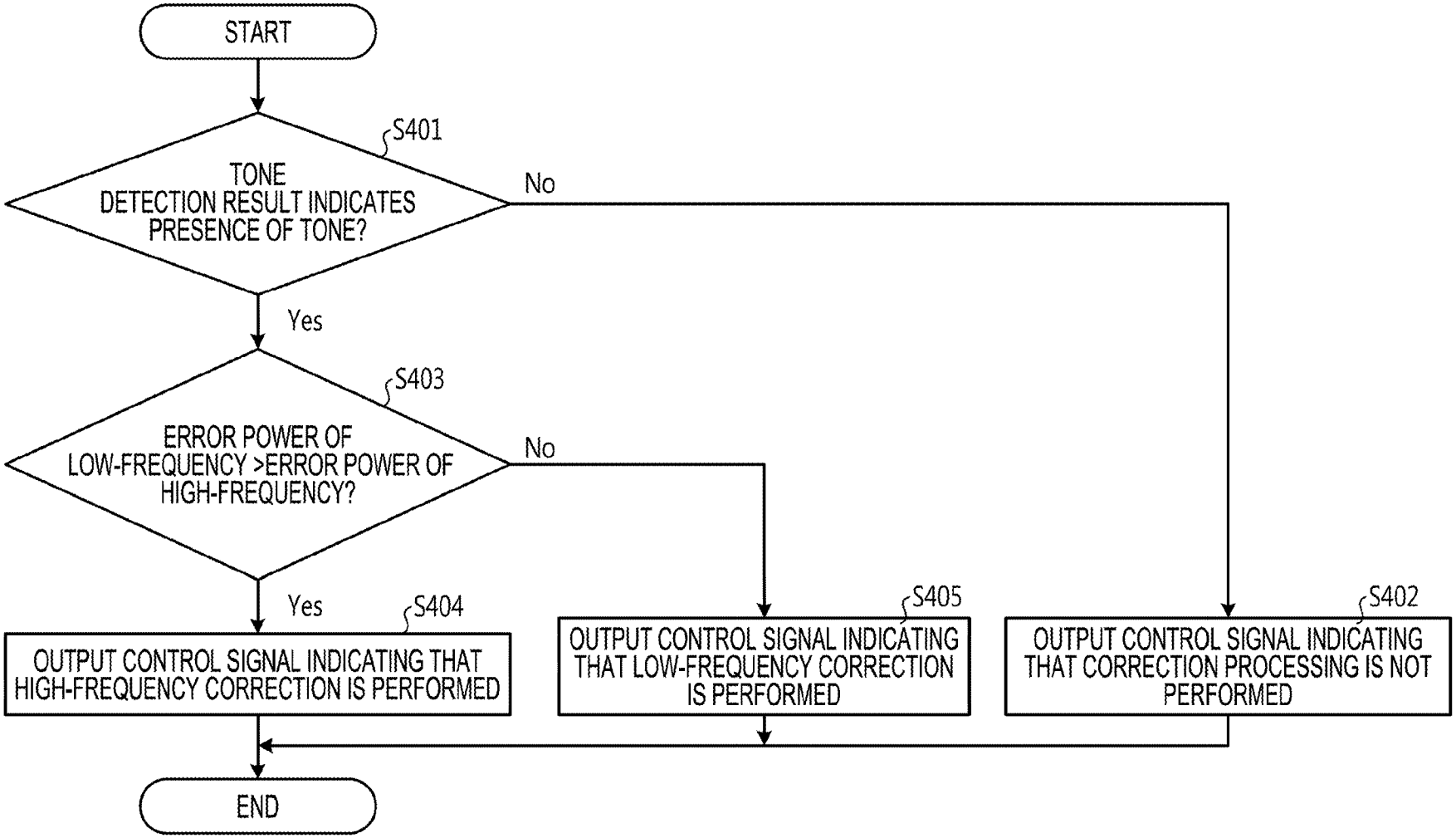
FIG. 21 is a flowchart illustrating another processing procedure of a determination unit.

FIG. 21 is a flowchart illustrating another processing procedure of a determination unit. As illustrated in FIG. 21, the determination unit 130 of the audio encoding apparatus 100 determines whether the tone detection result indicates the presence of a tone (operation S401). When it is determined that the tone detection result does not indicate the presence of a tone ("NO" in the operation S401), the determination unit 130 outputs a control signal indicating that the correction processing is not performed (operation S402). Also, in the operation S402, the determination unit 130 may suppress the output of the control signal when it is determined that the correction processing is not performed.

When it is determined that the tone detection result indicates the presence of a tone ("YES" in the operation S401), the determination unit 130 determines whether the error power of the low-frequency is higher than the error power of the high-frequency (operation S403). When it is determined that the error power of the low-frequency is higher than the error power of the high-frequency ("YES" in the Operation S403), the determination unit 130 outputs a control signal indicating that the high-frequency correction is performed to the high-frequency correction unit 160 (Operation S404).

When it is determined that the error power of the low-frequency is not higher than the error power of the high-frequency ("NO" in the operation S403), the determination unit 130 outputs a control signal indicating that the low-frequency correction is performed to the low-frequency correction unit 140 (operation S405).

As described above, it is possible to appropriately select a bandwidth that suppresses the tone to improve the sound quality by feedbacking whether the bandwidth in which the tone has actually been suppressed is appropriate based on a comparison of the error power of the low-frequency and the error power of the high-frequency as described above.

Sixth Embodiment

Prior to describing a sixth embodiment, the problem of the audio encoding apparatus 100 described in the first embodiment will be described. When the decoding apparatus 20 decodes the encoded stream generated by the audio encoding apparatus 100, the quality of the sound signal after decoding may deteriorate depending on the setting of the inverse filter mode of the decoding apparatus 20, as described in FIG. 22.

Figure 22:
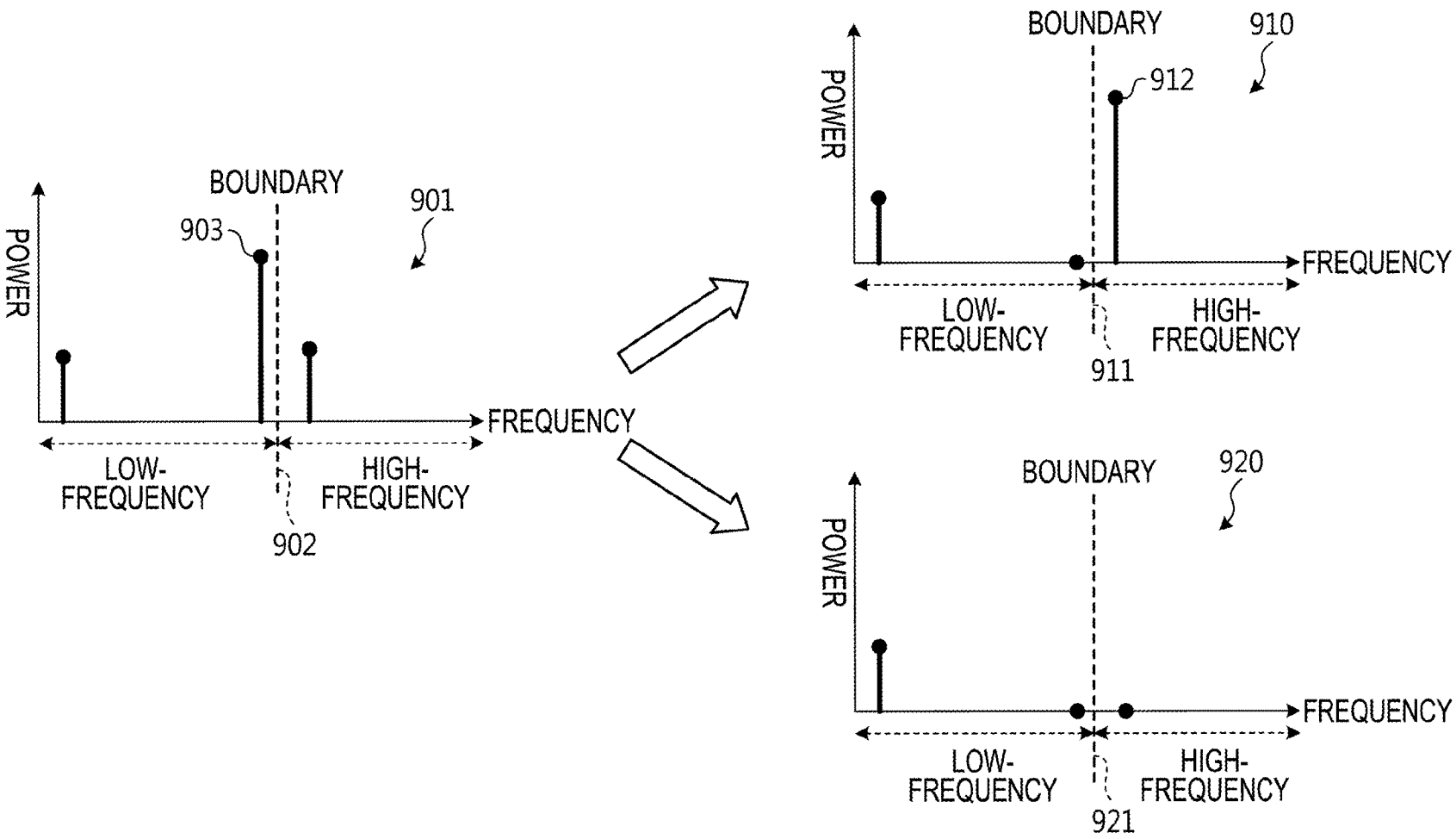
FIG. 22 is a diagram for explaining the problem of an audio encoding apparatus.

FIG. 22 is a diagram for explaining the problem of an audio encoding apparatus. In a frequency spectrum 901 of the sound signal illustrated in FIG. 22, the horizontal axis is an axis corresponding to the frequency, and the vertical axis is an axis corresponding to the power (value). A tone 903 is included near a boundary 902 between the low-frequency and the high-frequency of the frequency spectrum 901.

For example, when the audio encoding apparatus 100 detects a tone 903 near the boundary 902, the low-frequency signal is corrected by suppressing the tone 903 included in the low-frequency, thereby generating a low-frequency code in which the low-frequency signal is encoded. The audio encoding apparatus 100 generates an encoded stream by multiplexing the low-frequency code and the high-frequency code obtained by encoding the high-frequency information, and outputs the generated encoded stream to the decoding apparatus 20.

The decoding apparatus 20 generates a frequency spectrum 910 by decoding the encoded stream received from the audio encoding apparatus 100. Here, a frequency spectrum 920 may be generated depending on the processing of the decoding apparatus 20. For the frequency spectra 910 and 920, the horizontal axis is an axis corresponding to the frequency and the vertical axis is an axis corresponding to the power (value).

The frequency spectrum 910 is an appropriately decoded frequency spectrum and includes a tone 912 near a boundary 911. In the meantime, the frequency spectrum 920 does not include the tone near a boundary 921, and the quality of the sound signal deteriorates.

Next, descriptions will be made of the reason why the tone is not generated near the boundary 921 of the frequency spectrum 920. For example, the decoding apparatus 20 that uses an SBR technology has a function of turning ON/OFF the reverse filter mode.

When the inverse filter mode is "OFF," the decoding apparatus 20 replicates the low-frequency of the frequency spectrum to the high-frequency to generate a sound signal. In this way, when the decoding apparatus 20 performs a processing of replicating the frequency spectrum of the low-frequency to the high-frequency, the frequency spectrum 910 illustrated in FIG. 22 is generated, and the quality of the sound signal is not deteriorated.

In the meantime, when the inverse filter mode is "ON," the decoding apparatus 20 generates a sound signal by decorrelating the low-frequency of the frequency spectrum and then replicating it to the high-frequency. Thus, when the decoding apparatus 20 decorrelates the low-frequency signal and then replicates the high-frequency, no tone is generated in the high-frequency, and the frequency spectrum 920 illustrated in FIG. 22 is generated, thereby resulting in the deterioration of the quality of the sound signal.

Figure 23:
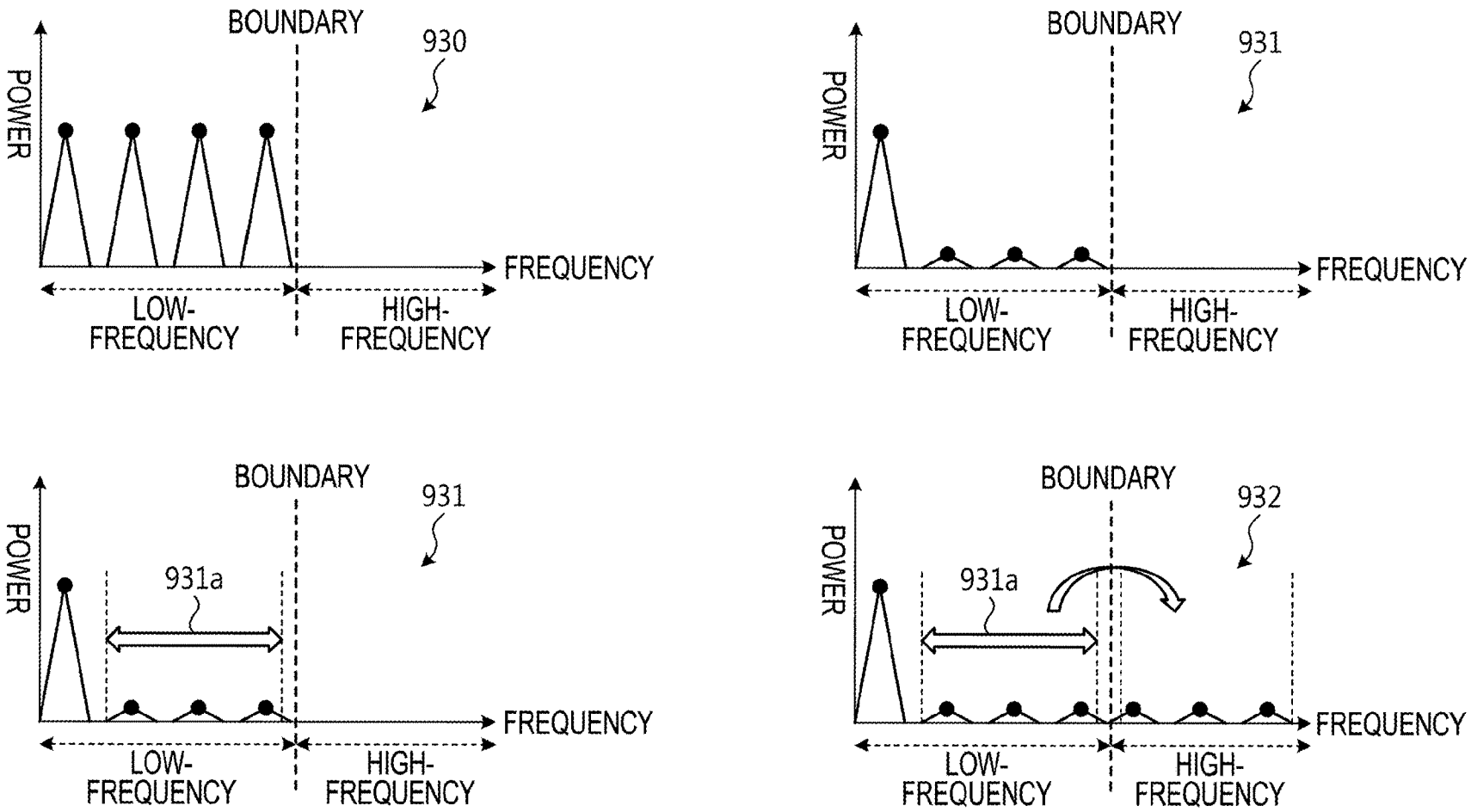
FIG. 23 is a diagram for explaining a problem caused by decorrelation of a low-frequency signal.

FIG. 23 is a diagram for explaining a problem caused by decorrelation of a low-frequency signal. In FIG. 23, the horizontal axis of each of the frequency spectra 930 to 932 is an axis corresponding to the frequency, and the vertical axis thereof is an axis corresponding to the power (value).

The decoding apparatus 20 generates the frequency spectrum 931 by decorrelating the low-frequency of the frequency spectrum 930. The decoding apparatus 20 generates the frequency spectrum 932 by selecting a bandwidth 931*a* of the frequency spectrum 931 and replicating the frequency spectrum of the selected bandwidth 931*a* to the high-frequency. The decoding apparatus 20 decodes the final frequency spectrum by performing an envelope adjustment on the frequency spectrum 932. As described in FIG. 23, when the low-frequency signal is decorrelated and then the high-frequency is replicated, a high-frequency tone is not generated in the decoded frequency spectrum.

In order to solve the problem described with reference to FIGS. 22 and 23, the audio encoding apparatus according to the sixth embodiment controls the presence or absence of correction of the low-frequency signal in accordance with the ON/OFF of the inverse filter mode. For example, when the inverse filter mode is "OFF," the audio encoding device suppresses the tone by correcting the low-frequency signal. In the meantime, when the inverse filter mode is "ON," the audio encoding device does not suppress the tone of the low-frequency signal by not correcting the low-frequency signal. In this way, the suppression of the tone is controlled according to the ON/OFF of the inverse filter mode, and the problem of quality deterioration of the sound signal is resolved when the decoding apparatus 20 performs a decoding.

Figure 24:
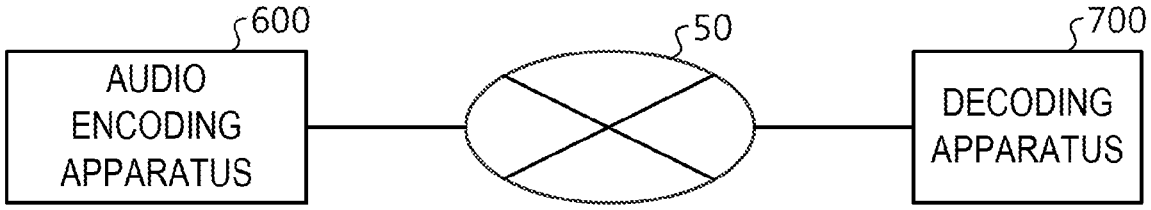
FIG. 24 is a diagram illustrating the configuration of a system according to a sixth embodiment.

FIG. 24 is a diagram illustrating the configuration of a system according to the sixth embodiment. As illustrated in FIG. 24, this system includes an audio encoding apparatus 600 and a decoding apparatus 700. The audio encoding apparatus 600 is connected to the decoding apparatus 700 via the network 50.

Figure 25:
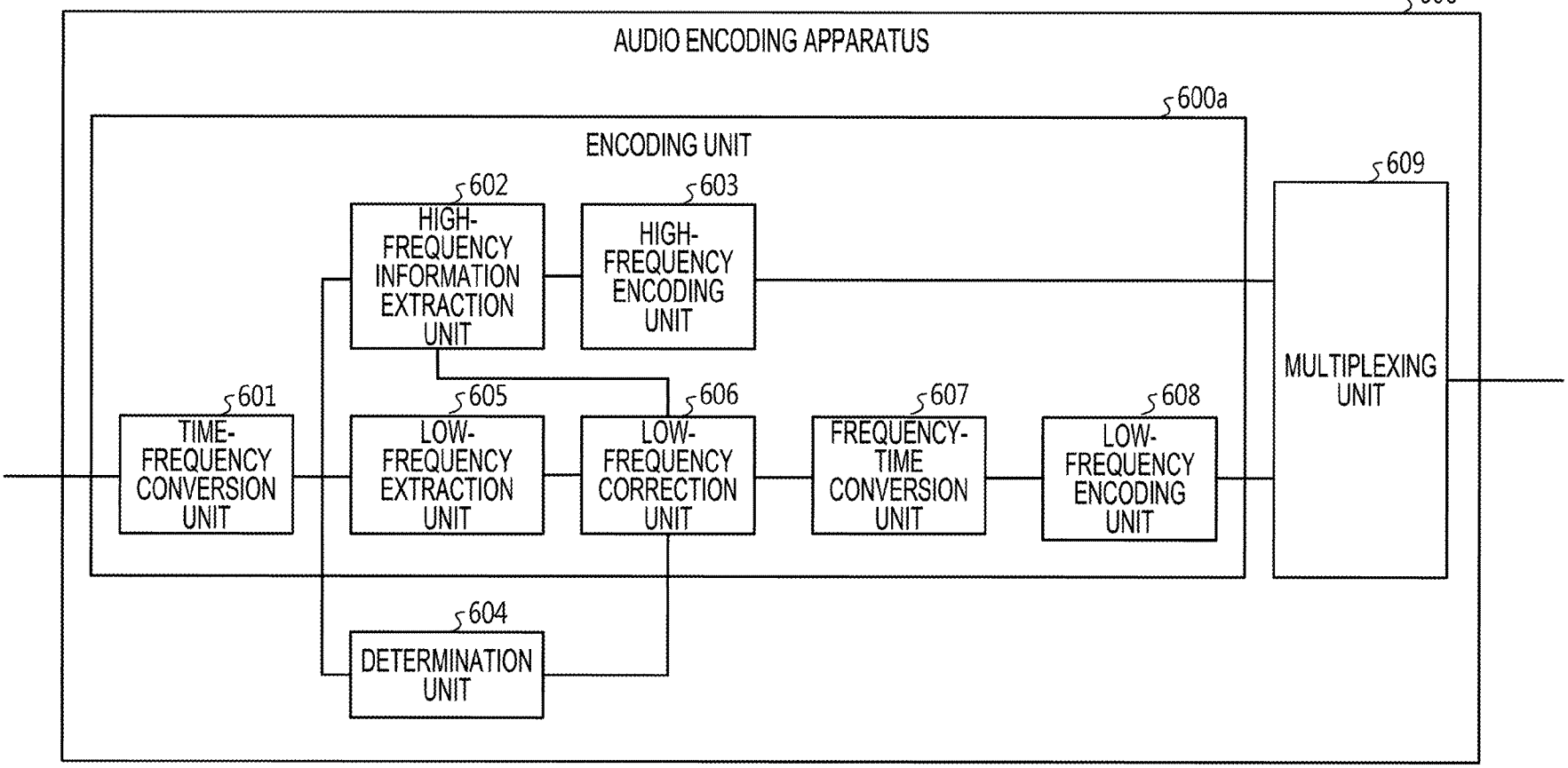
FIG. 25 is a functional block diagram illustrating the configuration of an audio encoding apparatus according to the sixth embodiment.

FIG. 25 is a functional block diagram illustrating the configuration of an audio encoding apparatus according to the sixth embodiment. As illustrated in FIG. 25, this audio encoding apparatus 600 includes an encoding unit 600*a*, a determination unit 604, and a multiplexing unit 609. The encoding unit 600*a* includes a time-frequency conversion unit 601, a high-frequency information extraction unit 602, a high-frequency encoding unit 603, a low-frequency extraction unit 605, a low-frequency correction unit 606, a frequency-time conversion unit 607, and a low-frequency encoding unit 608.

The time-frequency conversion unit 601 is a processing unit that converts the sound signal into a time-frequency signal. The time-frequency conversion unit 601 outputs the time-frequency signal to the high-frequency information extraction unit 602, the determination unit 604, and the low-frequency extraction unit 605.

For example, the time-frequency conversion unit 601 converts a sound signal s[n] into a frequency signal S[k][n] using a quadrature mirror filter (QMF) filter bank defined by an equation (3). In the equation (3), n is a variable representing time, and k is a variable representing a frequency.

$$S[k][n] = s(n) \cdot \exp\left[j\frac{\pi}{N}(k+0.5)(2n+1)\right], \quad 0 \le k < K,\ 0 \le n < N \tag{3}$$

Figure 26:
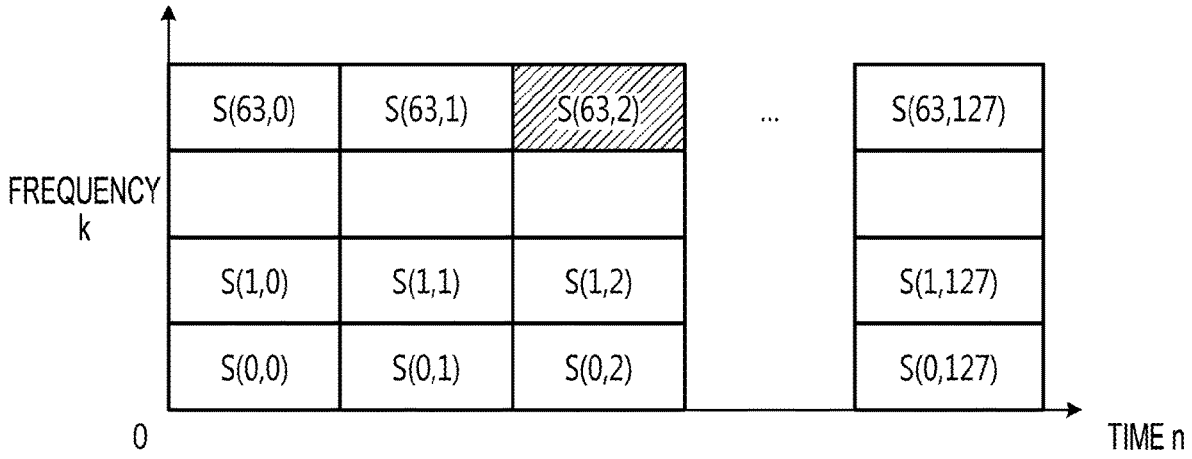
FIG. 26 is a diagram illustrating an example of a data structure of a time-frequency signal.

The time-frequency conversion unit 601 generates a time-frequency signal L[k][n] by associating each time with a frequency signal S of each frequency. FIG. 26 is a diagram illustrating an example of a data structure of a time-frequency signal. In FIG. 26, the horizontal axis is an axis corresponding to the time, and the vertical axis is an axis corresponding to the frequency. The time-frequency signal includes information of the frequency spectrum per time. For example, S(0,0), S(1,0), . . . S(63,0) is frequency spectrum information representing a relationship between the frequency and the value of the frequency signal S at time n=0 (corresponding to the power value).

Referring back to FIG. 25, the high-frequency information extraction unit 602 is a processing unit that extracts high-frequency information from the high-frequency of the time-frequency signal. The high-frequency information extraction unit 602 outputs the extracted high-frequency information to the high-frequency encoding unit 603. The high-frequency information includes an envelope power, a tone frequency, and a frequency resolution. A processing of extracting the high-frequency information is the same as the processing of the high-frequency information extraction unit 120 described in the first embodiment.

Further, the high-frequency information extraction unit 602 estimates whether the inverse filter mode set in the decoding apparatus 700 is ON or OFF based on the time-frequency signal. The high-frequency information extraction unit 602 outputs information of the estimated inverse filter mode to the low-frequency correction unit 606.

The high-frequency information extraction unit 602 calculates an average value of the tone components of the time-frequency signal. The average value of the tone components is expressed as a "bandwidth tone component." The high-frequency information extraction unit 602 calculates the average power in a frame using the bandwidth tone component. The frame corresponds to the data obtained by dividing the time-frequency signal by a predetermined time. The high-frequency information extraction unit 602 smoothes the bandwidth tone component of the current frame using the bandwidth tone component of the previous frame.

Figure 27:
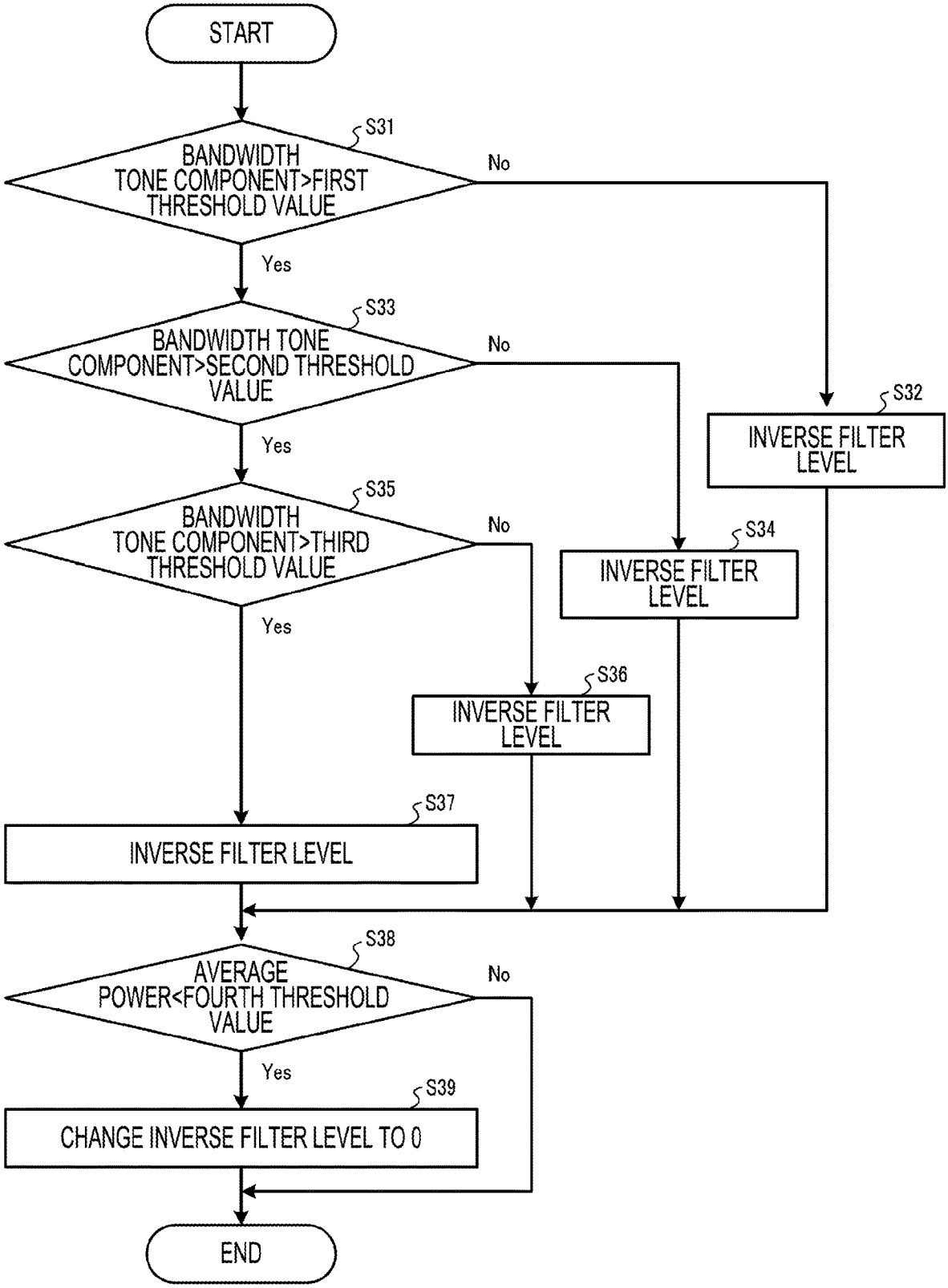
FIG. 27 is a flowchart illustrating the determination procedure of an inverse filter level.

The high-frequency information extraction unit 602 determines whether the inverse filter mode is ON or OFF based on the smoothed bandwidth tone component and the average power. For example, the high-frequency information extraction unit 602 determines the inverse filter level by performing a threshold value comparison as described with reference to FIG. 27. FIG. 27 is a flowchart illustrating the determination procedure of an inverse filter level. The first through fourth threshold values illustrated in FIG. 27 are set in advance. Further, the magnitude relationship among the first threshold value to the third threshold value is the first threshold value<the second threshold value<the third threshold value.

As illustrated in FIG. 27, when it is determined that the bandwidth tone component is less than the first threshold value ("NO" in the operation S31), the high-frequency information extraction unit 602 determines that the inverse filter level is 0 (operation S32) and proceeds to the operation S38.

When it is determined that the bandwidth tone component is equal to or larger than the first threshold value ("YES" in the operation S31), the high-frequency information extraction unit 602 proceeds to the operation S33. When it is determined that the bandwidth tone component is less than the second threshold value ("NO" in the operation S33), the high-frequency information extraction unit 602 determines that the inverse filter level is 1 (operation S34) and proceeds to the operation S38.

When it is determined that the bandwidth tone component is equal to or greater than the second threshold value ("YES" in the operation S33), the high-frequency information extraction unit 602 proceeds to the operation S35. When it is determined that the bandwidth tone component is less than the third threshold value ("NO" in the operation S35), the high-frequency information extraction unit 602 determines that the inverse filter level is 2 (operation S36) and proceeds to the operation S38.

When it is determined that the bandwidth tone component is equal to or greater than the third threshold value ("YES" in the operation S35), the high-frequency information extraction unit 602 determines that the inverse filter level is 3 (operation S37) and proceeds to the operation S38.

The high-frequency information extraction unit 602 determines whether the average power is less than the fourth threshold value (operation S38). When it is determined that the average power is less than the fourth threshold value ("YES" in the operation S38), the high-frequency information extraction unit 602 updates the inverse filter level to 0 (operation S39), and ends the processing of determining the inverse filter level. In the meantime, when it is determined that the average power is equal to or greater than the fourth threshold value ("NO" in the operation S38), the high-frequency information extraction unit 602 ends the processing of determining the inverse filter level.

In order to avoid a processing of a reverse filter for the signals which are mostly silent, the inverse filter level is set to "0" when the average power is very small. For this reason, the fourth threshold value is set to a very small value.

The high-frequency information extraction unit 602 executes the processing illustrated in FIG. 27, and when the inverse filter level is "0," the information of the inverse filter mode "OFF" is output to the low-frequency correction unit 606. When the inverse filter level is equal to or higher than "1," the high-frequency information extraction unit 602 outputs information of the inverse filter mode "on" to the low-frequency correction unit 606.

Referring back to FIG. 25, the high-frequency encoding unit 603 generates a high-frequency code by encoding the high-frequency information. The high-frequency encoding unit 603 outputs the high-frequency code to the multiplexing unit 609.

The determination unit 604 is a processing unit that determines whether the tone is included in the boundary between the low-frequency and the high-frequency of the sound signal based on the time-frequency signal. When it is determined that the tone is included in the boundary, the determination unit 604 outputs the control signal to the low-frequency correction unit 606. A processing of determining by the determination unit 604 whether the tone is included in the boundary between the low-frequency and the high-frequency of the sound signal is the same as the processing of the determination unit 130.

The low-frequency extraction unit 605 is a processing unit that extracts low-frequency information of a time-frequency signal. The low-frequency extraction unit 605 outputs the extracted low-frequency information to the low-frequency correction unit 606. An administrator is configured to set the upper limit frequency of the low-frequency in advance.

The low-frequency correction unit 606 is a processing unit that performs a low-frequency correction based on the information of the inverse filter mode and the control signal. Specifically, the low-frequency correction unit 606 performs the low-frequency correction when the inverse filter mode is "OFF" and the control signal is received (when the tone is included). The low-frequency correction unit 606 performs the low-frequency correction for the low-frequency of the time-frequency signal. For example, the low-frequency correction unit 606 performs the low-frequency correction by suppressing the tone component included in the low-frequency of the time-frequency signal. The low-frequency correction unit 606 outputs the time-frequency signal subjected to the low-frequency correction to the frequency-time conversion unit 607.

In the meantime, the low-frequency correction unit 606 does not perform the low-frequency correction when the inverse filter mode is "ON" or when the control signal is not received (when the tone is not included), and outputs the low-frequency information of the time-frequency signal to the frequency-time conversion unit 607.

Figure 28:
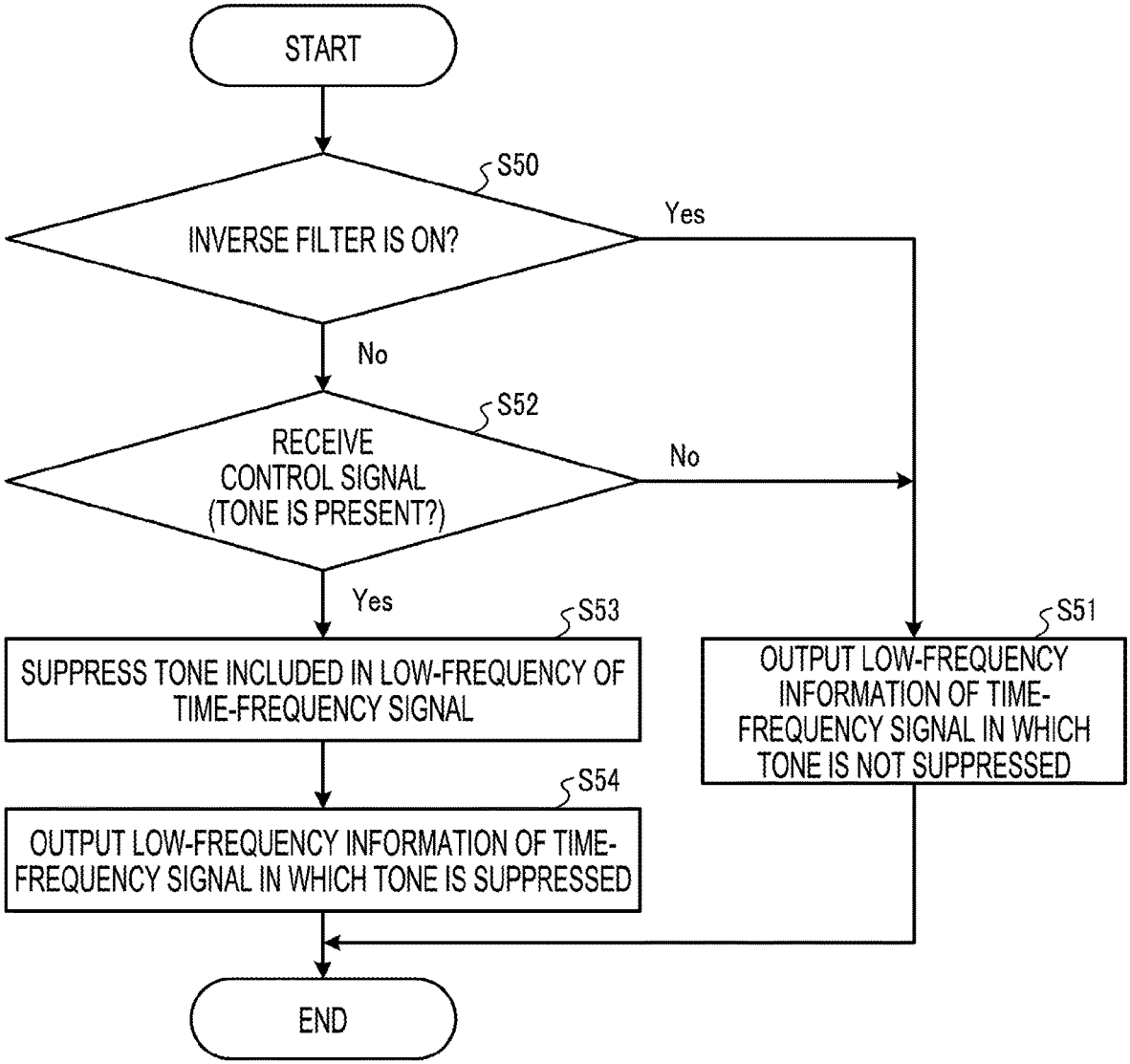
FIG. 28 is a flowchart illustrating the processing procedure of a low-frequency correction unit according to the sixth embodiment.

FIG. 28 is a flowchart illustrating the processing procedure of a low-frequency correction unit according to the sixth embodiment. As illustrated in FIG. 28, the low-frequency correction unit 606 determines whether the inverse filter mode is on (operation S50). When it is determined that the inverse filter mode is on ("YES" in the operation S50), the low-frequency correction unit 606 outputs the low-frequency information of the time-frequency signal, for which the tone is not suppressed, to the frequency-time conversion unit 607 (operation S51).

In the meantime, when it is determined that the inverse filter mode is OFF ("NO" in the operation S50), the low-frequency correction unit 606 determines whether the control signal is received (operation S52). When it is determined that no signal is received ("NO" in the operation S52), the low-frequency correction unit 606 proceeds to the operation S51.

When it is determined that the control signal is received ("YES" in the operation S52), the low-frequency correction unit 606 suppresses the tone component included in the low-frequency of the time-frequency signal (operation S53). The low-frequency correction unit 606 outputs the low-frequency information of the time-frequency signal, for which the tone is suppressed, to the frequency-time conversion unit 607 (operation S54).

The description of FIG. 25 is referred to again. The frequency-time conversion unit 607 converts the time-frequency signal into a low-frequency signal. The frequency-time conversion unit 607 outputs the low-frequency signal to the low-frequency encoding unit 608.

For example, the frequency-time conversion unit 607 converts a time-frequency signal S'[k][n] into a low-frequency signal $S_{low}(n)$ according to the filter bank defined by an equation (4). In the equation (4), $K_{low}=32$ and $N_{low}=128$. Here, the time-frequency signal S'[k][n] corresponds to the time-frequency signal for which the low-frequency correction is performed by the low-frequency correction unit 606, or the time-frequency signal for which the low-frequency correction is not performed.

$$s_{low}[n] = S'[k][n] \cdot \frac{1}{2K_{low}} \exp\left[j\frac{\pi}{2K_{low}}\left(k+\frac{1}{2}\right)(2n - N_{low} - 1)\right], \quad 0 \le k < K_{low},\ 0 \le n < N_{low} \tag{4}$$

The low-frequency encoding unit 608 is a processing unit that generates a low-frequency code by encoding a low-frequency signal into a bit string. For example, the low-frequency encoding unit 608 performs an encoding based on the AAC. The low-frequency encoding unit 608 outputs the low-frequency code to the multiplexing unit 609.

The multiplexing unit 609 is a processing unit that generates an encoded stream by multiplexing the low-frequency code and the high-frequency code. The multiplexing unit 609 transmits the encoded stream to the decoding apparatus 700 via the network 50.

Figure 29:
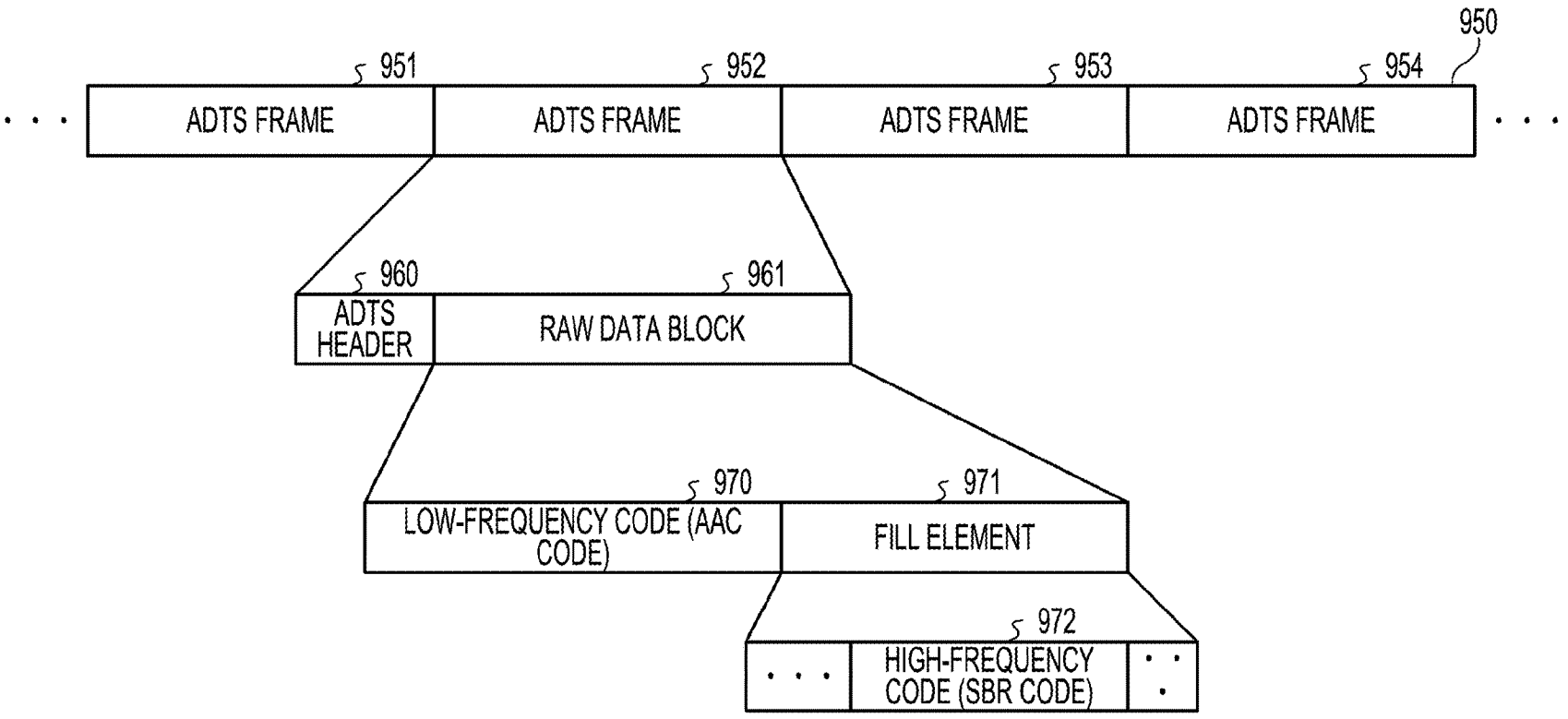
FIG. 29 is a diagram illustrating an example of a data structure of an encoded stream.

For example, the multiplexing unit 609 outputs the encoded stream in an MPEG-4 ADTS (audio data transport stream) format. FIG. 29 is a diagram illustrating an example of a data structure of an encoded stream. As illustrated in FIG. 29, an encoded stream 950 includes a plurality of ADTS frames 951 to 954. Although not illustrated, the encoded stream 950 includes ADTS frames other than the ADTS frames 951 to 954.

For example, the ADTS frame 952 includes an ADTS header 960 and a RAW data block 961. A low-frequency code 970 and a FILL element 971 are stored in the RAW data block 961. The high-frequency code 972 is also stored in the FILL element 971. The data structure of the ADTS frames 951, 953, and 954 is the same as the data structure of the ADTS frame 952.

Figure 30:
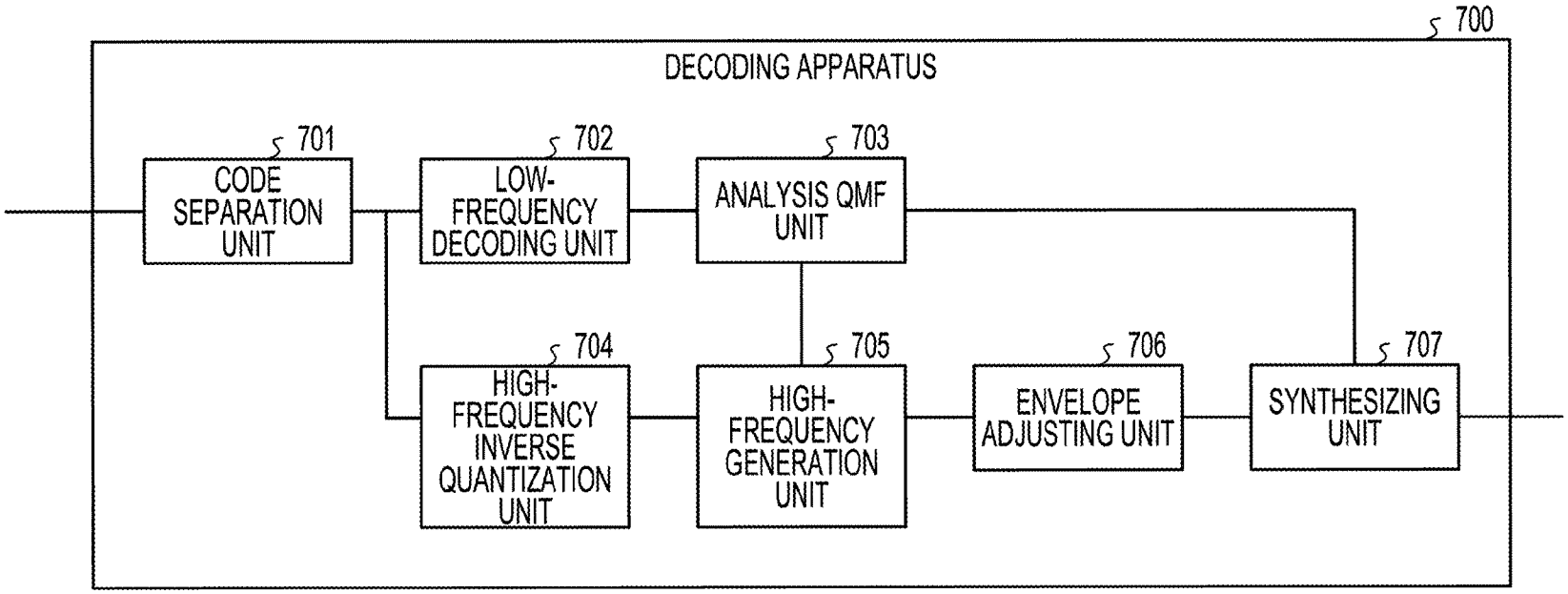
FIG. 30 is a functional block diagram illustrating the configuration of a decoding apparatus according to the sixth embodiment.

Next, the decoding apparatus 700 illustrated in FIG. 24 will be described. FIG. 30 is a functional block diagram illustrating the configuration of a decoding apparatus according to the sixth embodiment. As illustrated in FIG. 30, this decoding apparatus 700 includes a code separation unit 701, a low-frequency decoding unit 702, an analysis QMF unit 703, a high-frequency inverse quantization unit 704, a high-frequency generation unit 705, an envelope adjusting unit 706, and a synthesizing unit 707.

The code separation unit 701 is a processing unit that receives the encoded stream from the audio encoding apparatus 600 and separates the low-frequency code and the high-frequency code included in the encoded stream. The code separation unit 701 outputs the low-frequency code to the low-frequency decoding unit 702. The code separation unit 701 outputs the high-frequency code to the high-frequency inverse quantization unit 704.

The low-frequency decoding unit 702 is a processing unit that generates a low-frequency signal by decoding the low-frequency code. The low-frequency decoding unit 702 outputs the low-frequency signal to the analysis QMF unit 703.

The analysis QMF unit 703 is a processing unit that converts the low-frequency signal into a time-frequency signal using the QMF filter bank defined by the equation (3). This time-frequency signal is information corresponding to the frequency spectrum of the low-frequency of each time. In the following description, the time-frequency signal obtained by converting the low-frequency signal is referred to as a "low-frequency signal."

The high-frequency inverse quantization unit 704 is a processing unit that extracts high-frequency information by decoding the high-frequency code. The high-frequency inverse quantization unit 704 outputs the extracted high-frequency information to the high-frequency generation unit 705. The high-frequency information includes an envelope power, a tone frequency, and a frequency resolution.

The high-frequency generation unit 705 is a processing unit that generates a high-frequency signal based on the low-frequency signal. The high-frequency signal generated by the high-frequency generation unit 705 is information corresponding to the frequency spectrum of the high-frequency representing a relationship between the time and the frequency. The high-frequency generation unit 705 outputs the high-frequency signal and the high-frequency information to the envelope adjusting unit 706.

Hereinafter, descriptions will be made of the processing of the high-frequency generation unit 705 when the inverse filter mode is OFF and the processing of the high-frequency generation unit 705 when the inverse filter mode is ON. The ON/OFF of the inverse filter mode is set in the high-frequency generation unit 705 in advance.

Descriptions will be made of the processing of the high-frequency generation unit 705 when the inverse filter mode is "OFF." The high-frequency generation unit 705 generates a high-frequency signal by replicating the low-frequency signal to the high-frequency side as it is.

Descriptions will be made of the processing of the high-frequency generation unit 705 when the inverse filter mode is "ON." When the inverse filter mode is "ON," the high-frequency generation unit 705 generates a high-frequency signal by performing an inverse filter (performing a decorrelation) on the low-frequency signal and replicating the low-frequency signal on which the inverse filter is performed to the high-frequency side. The decorrelation performed by the high-frequency generation unit 705 on the low-frequency signal is an example of correction for the low-frequency signal.

The envelope adjusting unit 706 is a processing unit that adjusts the high-frequency signal based on the frequency resolution and the envelope power included in the high-frequency information. The envelope adjusting unit 706 also gives a tone component to the high-frequency signal based on the tone frequency. The envelope adjusting unit 706 outputs the adjusted high-frequency signal to the synthesizing unit 707.

The synthesizing unit 707 is a processing unit that decodes the sound signal by synthesizing the low-frequency signal output from the analysis QMF unit 703 and the adjusted high-frequency signal output from the envelope adjusting unit 706. The synthesizing unit 707 outputs the decoded sound signal.

Figure 31:
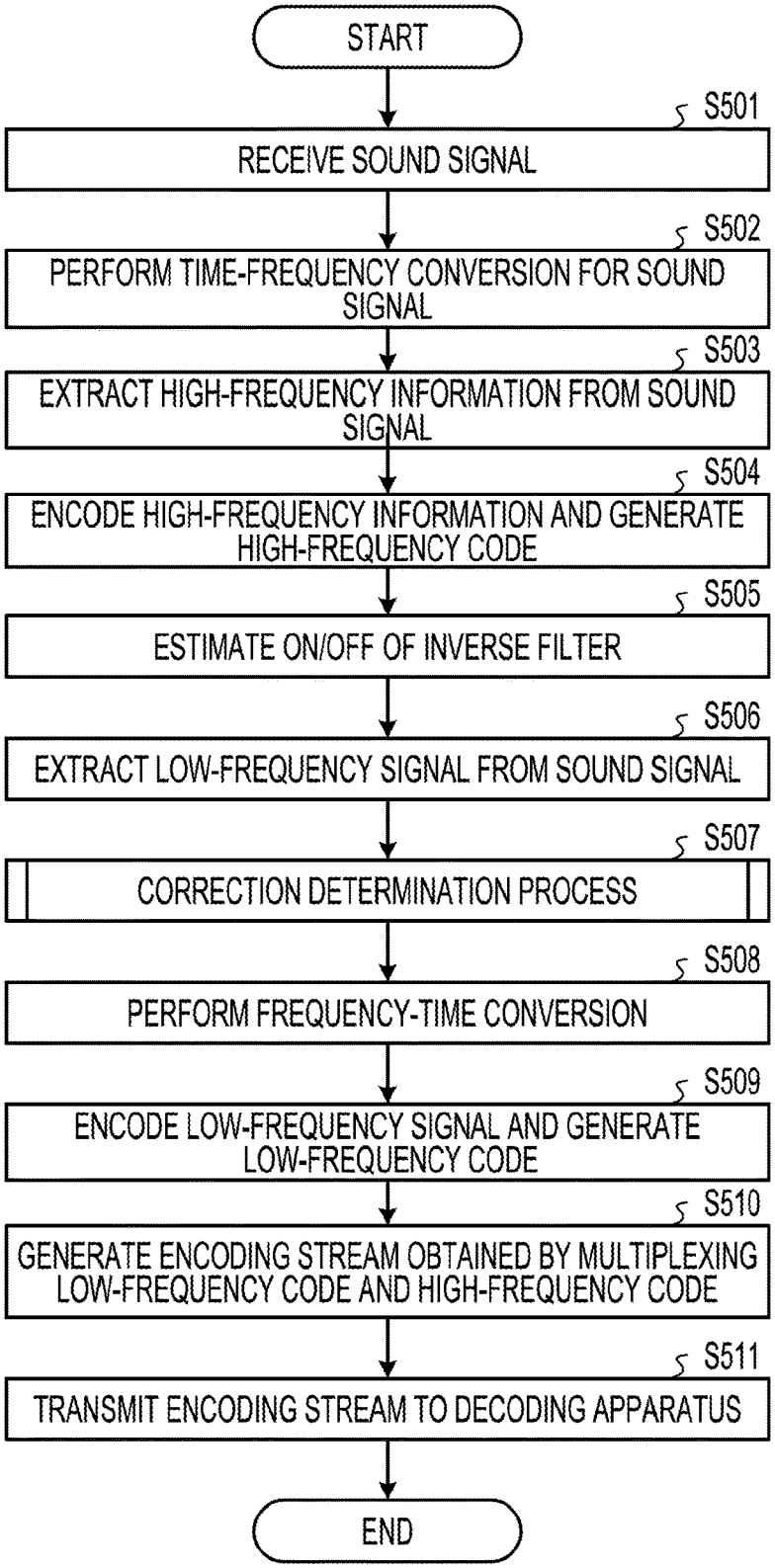
FIG. 31 is a flowchart illustrating the processing procedure of an audio encoding apparatus according to the sixth embodiment.

Next, an example of the processing procedure of the audio encoding apparatus 600 according to the sixth embodiment will be described. FIG. 31 is a flowchart illustrating the processing procedure of the audio encoding apparatus according to the sixth embodiment. As illustrated in FIG. 31, the time-frequency conversion unit 601 of the audio encoding apparatus 600 receives a sound signal (operation S501). The time-frequency conversion unit 601 performs a time-frequency conversion on the sound signal (operation S502).

The high-frequency information extraction unit 602 of the audio encoding apparatus 600 extracts high-frequency information from a sound signal (time-frequency signal) (operation S503). The high-frequency encoding unit 603 of the audio encoding apparatus 600 encodes the high-frequency information and generates a high-frequency code (operation S504). The high-frequency information extraction unit 602 estimates the ON/OFF of the inverse filter mode (operation S505).

The low-frequency extraction unit 605 of the audio encoding apparatus 600 extracts a low-frequency signal from a sound signal (time-frequency signal) (operation S506). The low-frequency correction unit 606 performs a correction determination processing (operation S507). The processing procedure of the correction determination processing of the operation S507 corresponds to the processing procedure described with reference to FIG. 28.

The frequency-time conversion unit 607 of the audio encoding apparatus 600 performs a frequency-time conversion with respect to the low-frequency signal (operation S508). The low-frequency encoding unit 608 encodes the low-frequency signal and generates a low-frequency code (operation S509).

The multiplexing unit 609 of the audio encoding apparatus 600 generates an encoded stream by multiplexing the low-frequency code and the high-frequency code (operation S510). The multiplexing unit 609 transmits the encoded stream to the decoding apparatus 700 (operation S511).

Figure 32:
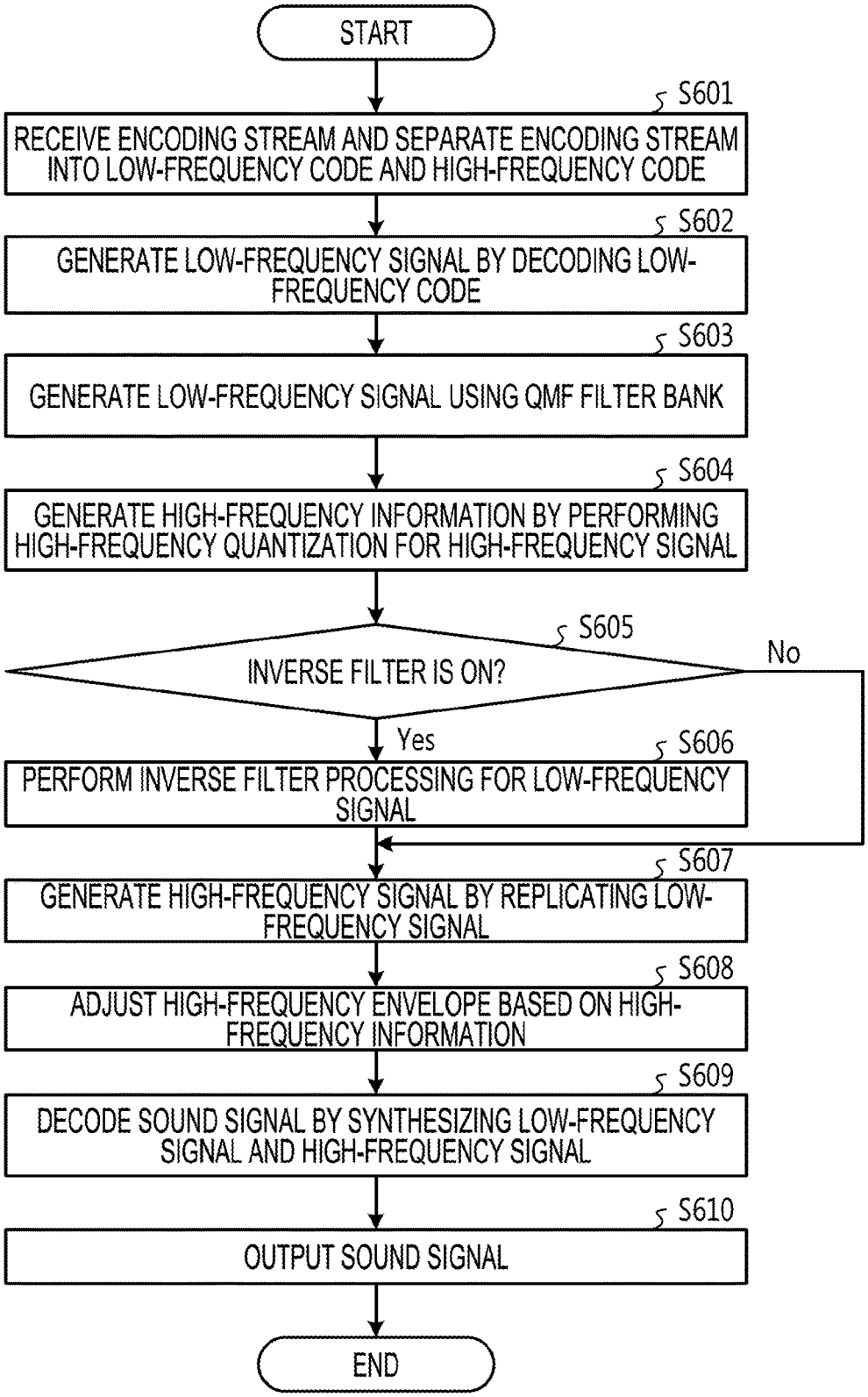
FIG. 32 is a flowchart illustrating the processing procedure of the decoding apparatus according to the sixth embodiment.

Next, an example of the processing procedure of the decoding apparatus 700 according to the sixth embodiment will be described. FIG. 32 is a flowchart illustrating the processing procedure of the decoding apparatus according to the sixth embodiment. As illustrated in FIG. 32, the code separation unit 701 of the decoding apparatus 700 receives the encoded stream and separates the low-frequency code and the high-frequency code (operation S601).

The low-frequency decoding unit 702 of the decoding apparatus 700 generates a low-frequency signal by decoding the low-frequency code (operation S602). The analysis QMF unit 703 of the decoding apparatus 700 generates a low-frequency signal using the QMF filter bank (operation S603).

The high-frequency inverse quantization unit 704 of the decoding apparatus 700 generates high-frequency information by performing a high-frequency inverse quantization on the high-frequency code (operation S604). The high-frequency generation unit 705 of the decoding apparatus 700 determines whether the inverse filter mode is on (operation S605).

When it is determined that the inverse filter mode is OFF ("NO" in the operation S605), the high-frequency generation unit 705 proceeds to the operation S607. In the meantime, when it is determined that the inverse filter mode is ON ("YES" in the operation S605), the high-frequency generation unit 705 performs an inverse filter processing on the low-frequency signal (operation S606).

The high-frequency generation unit 705 generates a high-frequency signal by replicating the low-frequency signal (operation S607). The envelope adjusting unit 706 of the decoding apparatus 700 adjusts the enveloping of the high-frequency signal based on the high-frequency information (operation S608).

The synthesizing unit 707 of the decoding apparatus 700 decodes the sound signal by synthesizing the low-frequency signal and the high-frequency signal (operation S609). The synthesizing unit 707 outputs the sound signal (operation S610).

Next, the effect of the audio coding apparatus 600 according to the sixth embodiment will be described. The audio encoding apparatus 600 controls the presence or absence of correction of the low-frequency signal according to the ON/OFF of the inverse filter mode. For example, when the inverse filter mode is "OFF," the audio encoding apparatus 600 suppresses the tone by correcting the low-frequency signal. In the meantime, when the inverse filter mode is "ON," the audio encoding apparatus 600 does not suppress the low-frequency signal tone by not performing the low-frequency signal correction. In this way, the suppression of the tone is controlled according to the ON/OFF of the inverse filter mode, and the problem of quality deterioration of the sound signal is resolved when the decoding apparatus 700 performs a decoding.

When the inverse filter mode is "OFF," the audio encoding apparatus 600 suppresses the tone by performing the low-frequency signal correction, thereby suppressing the vibration caused by generation of a plurality of tones near the boundary between the low-frequency and the high-frequency and resolving the problem of quality deterioration of the sound signal.

In addition, when the inverse filter mode is "ON," the audio encoding apparatus 600 does not perform the low-frequency signal correction, thereby resolving the problem of quality deterioration of the sound signal which is caused by no generation of tones near the boundary between the low-frequency and the high-frequency.

The audio encoding apparatus 600 estimates whether the inverse filter mode is ON or OFF based on the average value of the tone components included in the sound signal and the average power of the sound signal. Thus, whether the inverse filter is executed on the decoding apparatus 700 side may be automatically estimated in accordance with the characteristics of the sound signal.

The decoding apparatus 700 according to the sixth embodiment corrects the frequency spectrum of the low-frequency signal (performs an inverse filter on the low-frequency) according to the ON/OFF of the inverse filter mode and decodes the high-frequency signal using the corrected frequency spectrum of the low-frequency signal. As described above, the tone component of the low-frequency signal is not corrected when the inverse filter mode is on. Thus, even when the inverse filter mode is performed, the audio encoding apparatus 600 may resolve the problem of sound quality deterioration since the tone component remains near the boundary of the decoded sound signal.

Figure 33:
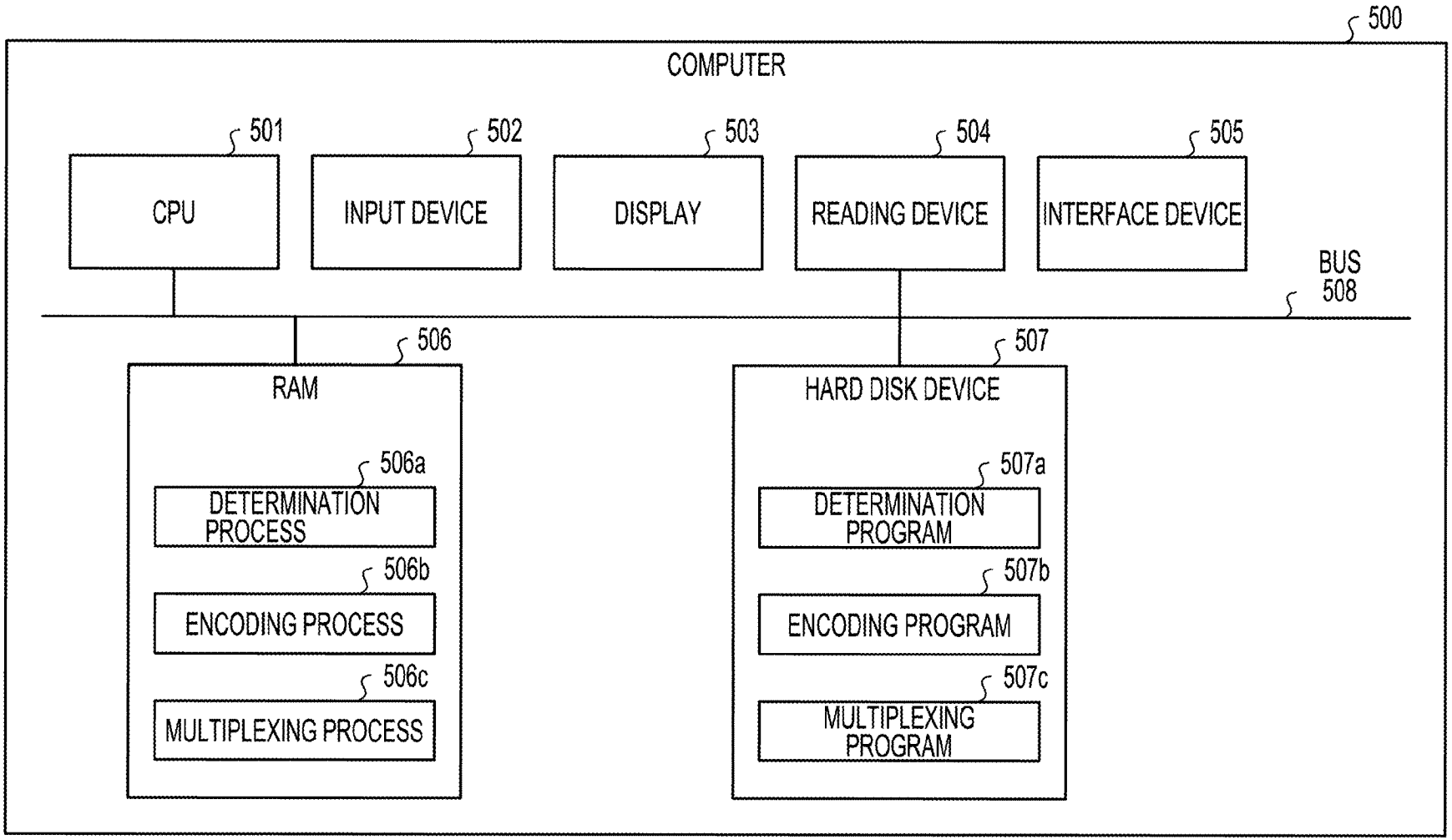
FIG. 33 is a diagram illustrating an example of a hardware configuration of a computer that implements the same functions as those of the audio encoding apparatus.

Next, descriptions will be made of an example of the hardware configuration of a computer that implements the same functions as those of the audio encoding apparatus 100 (200, 300, 301, 400, or 600) illustrated in the above-described embodiment. FIG. 33 is a diagram illustrating an example of the hardware configuration of a computer that implements the same functions as those of the audio encoding apparatus.

As illustrated in FIG. 33, the computer 500 includes a central processing unit (CPU) 501 that executes various arithmetic operations, an input device 502 that receives input of data from a user, and a display 503. The computer 500 also includes a reading device 504 that reads a program or the like from a storage medium and an interface device 505 that exchanges data with an external device. The computer 500 also includes a RAM 506 that temporarily stores various information and a hard disk device 507. Each of the devices 501 to 507 is connected to a bus 508.

The hard disk device 507 includes a determination program 507*a*, an encoding program 507*b*, and a multiplexing program 507*c*. The CPU 501 reads the determination program 507*a*, the encoding program 507, and the multiplexing program 507*c* to develop these programs in the RAM 506.

The determination program 507*a* functions as a determination processing 506*a*. The encoding program 507*b* functions as an encoding processing 506*b*. The multiplexing program 507*c* functions as a multiplexing processing 506*c*.

The determination processing 506*a* corresponds to the processing of the determination units 130, 210, and 604. The encoding processing 506*b* corresponds to the processing of a low-frequency signal extraction unit 110, a high-frequency information extraction unit 120, a low-frequency correction unit 140, an input signal correction unit 220, the low-frequency encoding units 150 and 320, the high-frequency correction units 160 and 410, a high-frequency encoding unit 170, and the encoding unit 600*a*. The multiplexing processing 506*c* corresponds to the processing of the multiplexing units 180 and 609.

Figure 34:
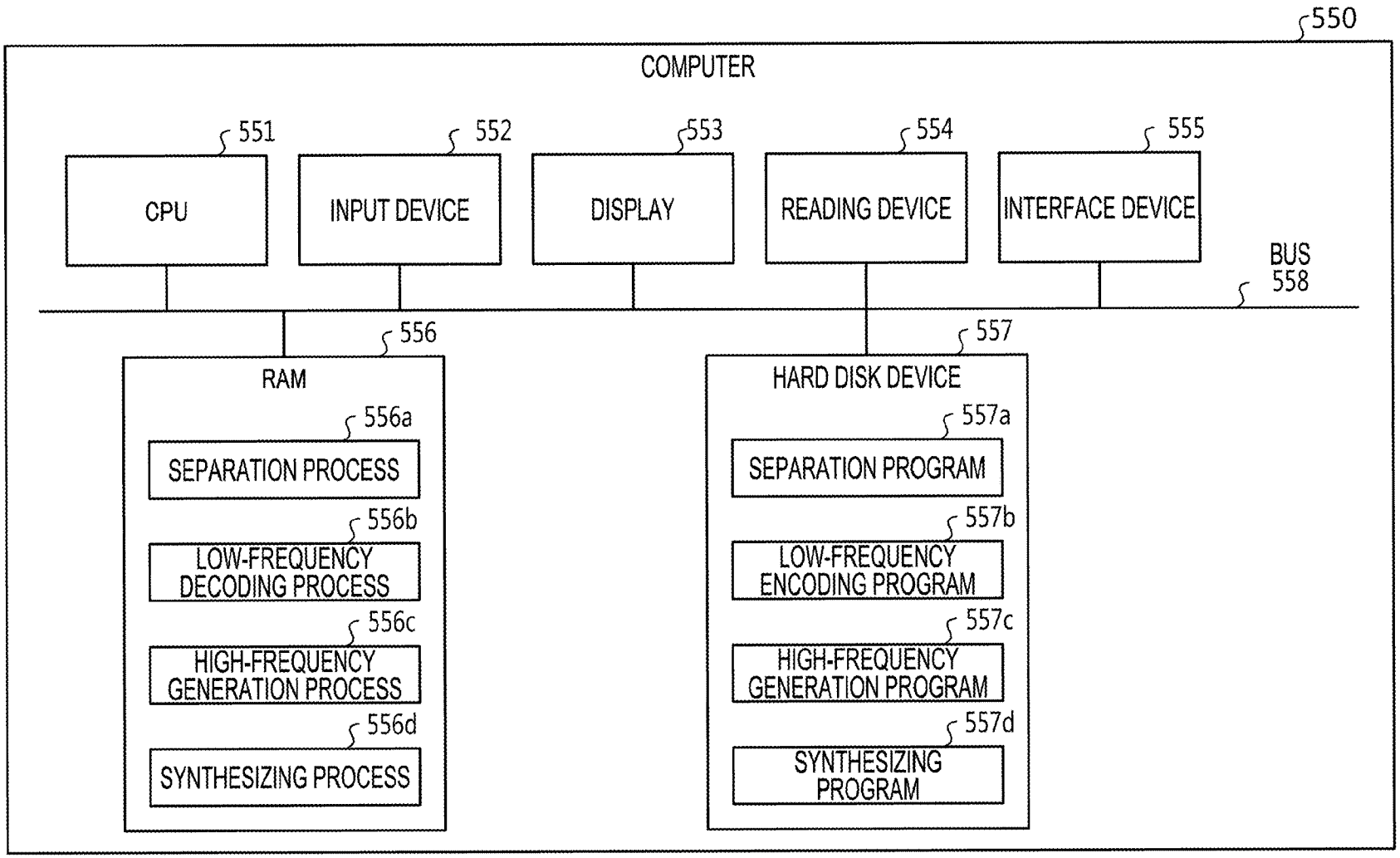
FIG. 34 is a diagram illustrating an example of a hardware configuration of a computer that implements the same functions as those of the decoding apparatus.
Figure 35:
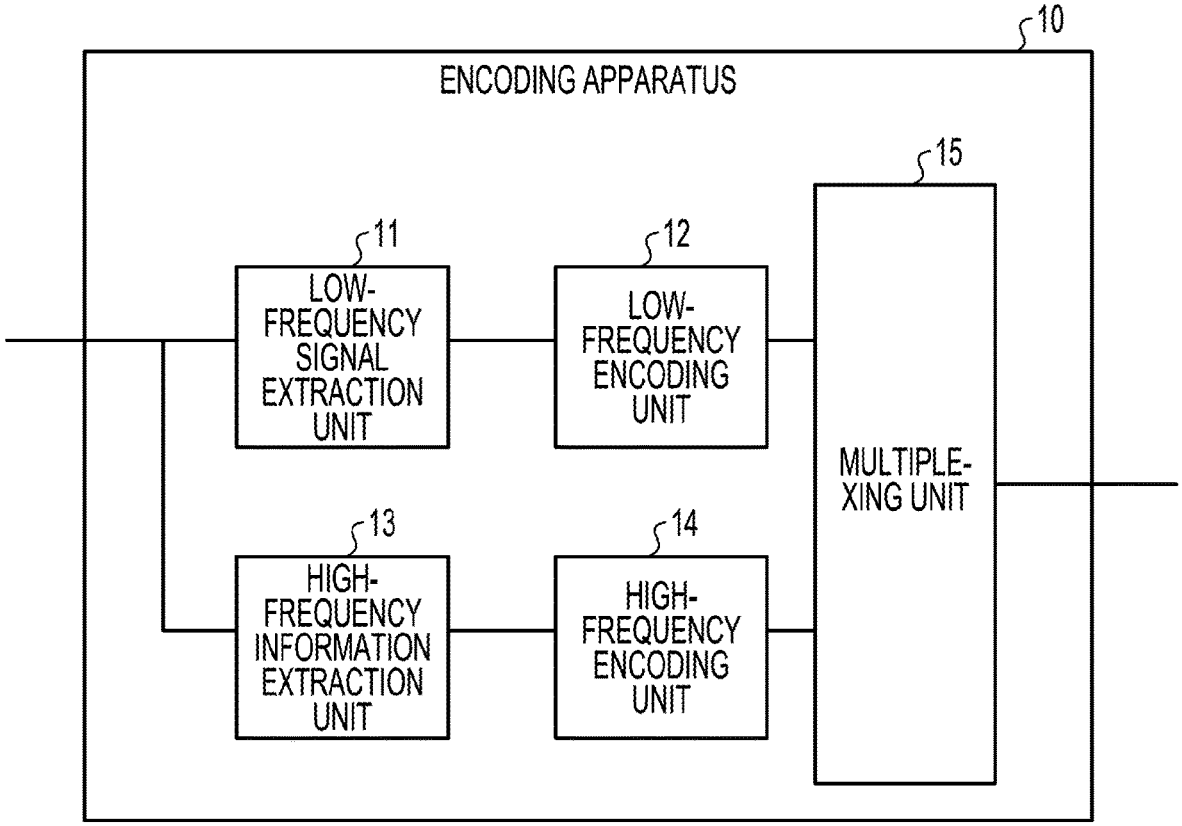
FIG. 35 RELATED ART
FIG. 35 is a diagram illustrating an example of an encoding apparatus in the related art.
Figure 36:
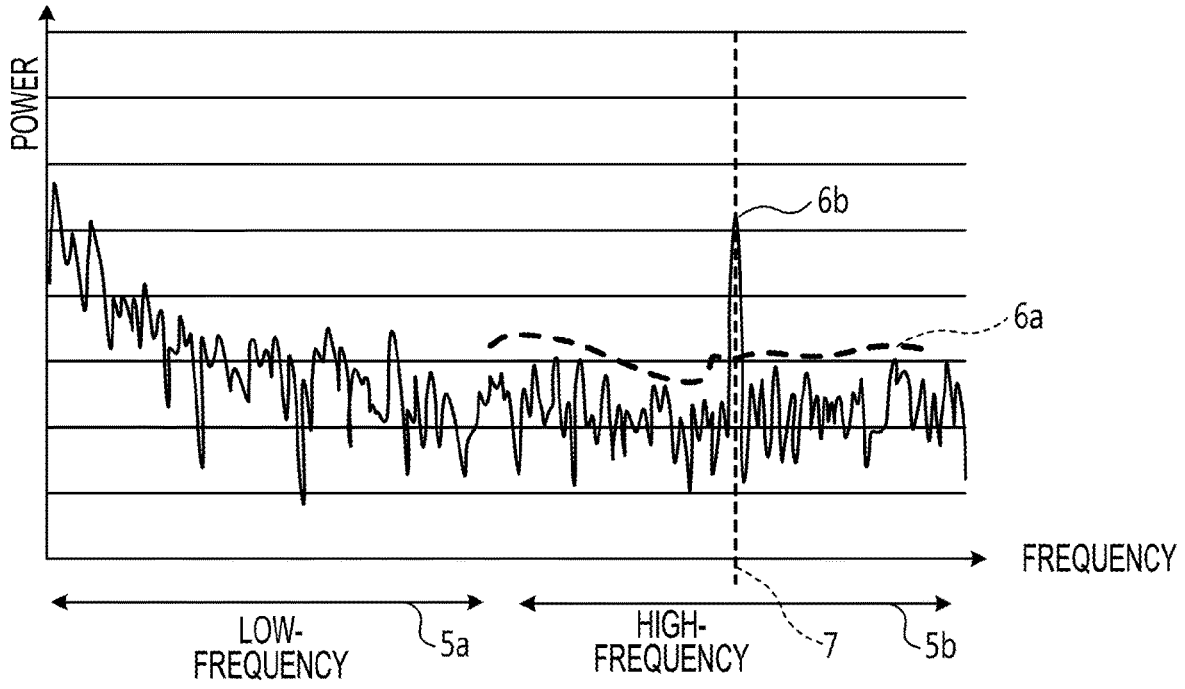
FIG. 36 RELATED ART
FIG. 36 is a diagram illustrating a frequency spectrum of a sound signal.

Next, descriptions will be made of an example of the hardware configuration of a computer that implements the same function as the decoding apparatus 700 illustrated in the above-described embodiment. FIG. 34 is a diagram illustrating an example of the hardware configuration of a computer that implements the same functions as those of the decoding apparatus.

As illustrated in FIG. 34, the computer 550 includes a CPU 551 that executes various arithmetic operations, an input device 552 that receives input of data from the user, and a display 553. The computer 550 also includes a reading device 554 that reads a program or the like from a storage medium and an interface device 555 that exchanges data with an external device. The computer 550 also includes a RAM 556 that temporarily stores various information and a hard disk device 557. Each of the devices 551 to 557 is connected to a bus 558.

The hard disk device 557 includes a separation program 557*a*, a low-frequency decoding program 557*b*, a high-frequency generation program 557*c*, and a synthesis program 557*d*. The CPU 551 reads the separation program 557*a*, the low-frequency decoding program 557*b*, the high-frequency generation program 557*c*, and the synthesis program 557*d* to develop these programs in the RAM 556.

The separation program 557*a* functions as a separation processing 556*a*. The low-frequency decoding program 557*b* functions as a low-frequency decoding processing 556*b*. The high-frequency generation program 557*c* functions as a high-frequency generation processing 556*c*. The synthesis program 557*d* functions as a synthesis processing 556*d*.

The separation processing 556*a* corresponds to the processing of the code separation unit 701. The low-frequency decoding processing 556*b* corresponds to the processing of the low-frequency decoding unit 702. The high-frequency generation processing 556*c* corresponds to the processing of the high-frequency generation unit 705. The synthesis processing 556*d* corresponds to the processing of the synthesizing unit 707.

Further, each of the programs 507*a* to 507*c* and 557*a* to 557*d* may not necessarily be stored in the hard disk devices 507 and 557 from the beginning. For example, each program is stored in a "portable physical medium" such as a flexible disk (FD), a CD-ROM, a DVD disk, a magneto-optical disk, or an IC card inserted in the computer 500 or 550. Then, the computers 500 and 550 may be configured to read and execute the programs 507*a* to 507*c* and 557*a* to 557*d*, respectively.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to an illustrating of the superiority and inferiority of the invention. Although the embodiments of the present invention have been described in detail, it should be understood that the various changes, substitutions, and alterations could be made hereto without departing from the spirit and scope of the invention.

What is claimed is:

1. An audio encoding apparatus comprising:

a memory; and a processor coupled to the memory and the processor configured to:

determine whether a tone is included within a portion of a frequency bandwidth near a boundary between a low-frequency that is a frequency bandwidth below a predetermined frequency of an input signal and a high-frequency that is a frequency bandwidth above the predetermined frequency of the input signal, the tone having the largest power in one of the low-frequency and the high-frequency;

suppress the tone in one of the low-frequency and the high-frequency when determined that the tone is included within the portion of the frequency bandwidth near the boundary;

encode a signal of the low-frequency included in the input signal to generate a low-frequency code;

encode a signal of the high-frequency included in the input signal to generate a high-frequency code; and generate an encoded stream, based on the suppressed tone, by multiplexing the low-frequency code and the high-frequency code, wherein, when the tone is included within the portion of the frequency bandwidth near the boundary, shift a frequency of a lower limit in the high-frequency to a high frequency side by a predetermined frequency or shift a frequency of an upper limit in the low-frequency to a low frequency side by a predetermined frequency to exclude the tone.

2. The audio encoding apparatus according to claim 1, wherein the processor is further configured to:

extract envelope information from a frequency spectrum of the input signal that has the high-frequency;

encode high-frequency information including the envelope information to encode the input signal that has the high-frequency; and when the tone in the high-frequency is suppressed, suppress a value of the envelope information within the portion of the frequency bandwidth near the boundary.

3. The audio encoding apparatus according to claim 1, wherein the processor is configured to:

determine whether the tone in one of the low-frequency and the high-frequency is suppressed, based on a comparison result of a bit rate of the input signal to be encoded with a threshold value.

4. The audio encoding apparatus according to claim 1, wherein the processor is further configured to:

calculate a first error between the input signal that has the low-frequency and a decoded input signal obtained by decoding the low-frequency code;

calculate a second error between the input signal that has the high-frequency and a decoded input signal obtained by decoding the high-frequency code; and determine whether the tone in one of the low-frequency and the high-frequency is suppressed, based on a comparison result of the first error with the second error.

5. The audio encoding apparatus according to claim 1, wherein, when the tone is suppressed, the processor is further configured to gradually decrease a power of the tone.

6. The audio encoding apparatus according to claim 2, wherein the high-frequency information further includes information of a tone frequency for indicating a presence or absence of the tone for each bandwidth in which the high-frequency is divided by a predetermined width, and when the tone within the portion of the frequency bandwidth near the boundary is indicated as presence, the processor is further configured to set the tone within the portion of the frequency bandwidth near the boundary to the absence.

7. The audio encoding apparatus according to claim 1, wherein, when a decoding apparatus that decodes the encoded stream replicates the low-frequency of the input signal and generate the high-frequency of the input signal, the processor is further configured to suppress the tone included in the low-frequency, and generate the low-frequency code, and wherein, when the decoding apparatus de-correlates the low-frequency of the input signal, replicates the low-frequency of the input signal, and generates the high-frequency of the input signal, the processor is further configured not to suppress the tone included in the low-frequency and generate the low-frequency code.

8. The audio encoding apparatus according to claim 7, wherein the processor is further configured to determine whether the low-frequency code is generated, based on an average value of a tone component included in the input signal and an average power of the input signal, after the decoding apparatus de-correlates the low-frequency of the input signal.

9. An audio encoding method comprising:

determining whether a tone is included within a portion of a frequency bandwidth near a boundary between a low-frequency that is a frequency bandwidth below a predetermined frequency of an input signal and a high-frequency that is a frequency bandwidth above the predetermined frequency of the input signal, the tone having the largest power in one of the low-frequency and the high-frequency;

suppressing the tone in one of the low-frequency and the high-frequency when determined that the tone is included within the portion of the frequency bandwidth near the boundary;

encoding a signal of the low-frequency included in the input signal to generate a low-frequency code;

encoding a signal of the high-frequency included in the input signal to generate a high-frequency code; and generating an encoded stream, based on the suppressed tone, by multiplexing the low-frequency code and the high-frequency code, by a processor wherein, when the tone is included within the portion of the frequency bandwidth near the boundary, shift a frequency of a lower limit in the high-frequency to a high frequency side by a predetermined frequency or shift a frequency of an upper limit in the low-frequency to a low frequency side by a predetermined frequency to exclude the tone.

10. The audio encoding method according to claim 9, wherein the processor is configured to:

extract envelope information from a frequency spectrum of the input signal that has the high-frequency;

encode high-frequency information including the envelope information to encode the input signal that has the high-frequency; and when the tone in the high-frequency is suppressed, suppress a value of the envelope information within the portion of the frequency bandwidth near the boundary.

11. The audio encoding method according to claim 9, wherein the processor is configured to:

determine whether the tone in one of the low-frequency and the high-frequency is suppressed, based on a comparison result of a bit rate of the input signal to be encoded with a threshold value.

12. The audio encoding method according to claim 9, wherein the processor is configured to:

calculate a first error between the input signal that has the low-frequency and a decoded input signal obtained by decoding the low-frequency code;

calculate a second error between the input signal that has the high-frequency and a decoded input signal obtained by decoding the high-frequency code; and determine whether the tone in one of the low-frequency and the high-frequency is suppressed, based on a comparison result of the first error with the second error.

13. The audio encoding apparatus method according to claim 9, wherein, when the tone is suppressed, the processor is further configured to gradually decrease a power of the tone.

14. The audio encoding method according to claim 10, wherein the high-frequency information further includes information of a tone frequency for indicating a presence or absence of the tone for each bandwidth in which the high-frequency is divided by a predetermined width, and when the tone within the portion of the frequency bandwidth near the boundary is indicated as presence, the processor is configured to set the tone within the portion of the frequency bandwidth near the boundary to the absence.

15. The audio encoding method according to claim 9, wherein, when a decoding apparatus that decodes the encoded stream replicates the low-frequency of the input signal and generate the high-frequency of the input signal, the processor is configured to suppress the tone included in the low-frequency, and generate the low-frequency code, and wherein, when the decoding apparatus de-correlates the low-frequency of the input signal, replicates the low-frequency of the input signal, and generates the high-frequency of the input signal, the processor is configured not to suppress the tone included in the low-frequency and generate the low-frequency code.

* * * * *